US008736531B2

(12) United States Patent
Gondo

(10) Patent No.: US 8,736,531 B2
(45) Date of Patent: May 27, 2014

(54) DRIVING DEVICE FOR LIQUID CRYSTAL DISPLAY PANEL

(75) Inventor: Kenji Gondo, Tokyo (JP)

(73) Assignee: OPTREX Corporation, Tokyo (JP)

( * ) Notice: Subject to any disclaimer, the term of this patent is extended or adjusted under 35 U.S.C. 154(b) by 387 days.

(21) Appl. No.: 13/295,524

(22) Filed: Nov. 14, 2011

(65) Prior Publication Data

US 2012/0127143 A1 May 24, 2012

(30) Foreign Application Priority Data

Nov. 17, 2010 (JP) ..... 2010-256628

(51) Int. Cl.
*G09G 3/36* (2006.01)

(52) U.S. Cl.
USPC ..... 345/94

(58) Field of Classification Search
USPC ..... 345/208
See application file for complete search history.

(56) References Cited

U.S. PATENT DOCUMENTS 7,304,623 B2 * 12/2007 Tomizawa et al. ..... 345/88
7,477,224 B2 * 1/2009 Song et al. ..... 345/96
7,999,782 B2 * 8/2011 Lin et al. ..... 345/100
8,179,346 B2 * 5/2012 Chung et al. ..... 345/88
2008/0001944 A1 * 1/2008 Chang ..... 345/214
2009/0195492 A1 8/2009 Takahashi

FOREIGN PATENT DOCUMENTS

JP 2009-181100 8/2009

OTHER PUBLICATIONS

U.S. Appl. No. 13/300,994, filed Nov. 21, 2011, Gondo.

* cited by examiner

*Primary Examiner* — Quan-Zhen Wang
*Assistant Examiner* — David Lee
(74) *Attorney, Agent, or Firm* — Oblon, Spivak, McClelland, Maier & Neustadt, L.L.P.

(57) ABSTRACT

A driving device drives a liquid crystal display panel in which the number of source lines is by one larger than the number of columns of pixel electrodes and in which the columns of pixel electrodes are arranged between the source lines. The driving device has a configuration in which potential output terminals, in a central region, are not connected to any source line. A voltage follower is connected to an output switching section. Additionally, potential output terminals are connected through switches to input terminals, respectively. The switch connects a first terminal to a second terminal with control signal at a high level and connects the first terminal to a third terminal with at a low level.

13 Claims, 23 Drawing Sheets

Fig.10
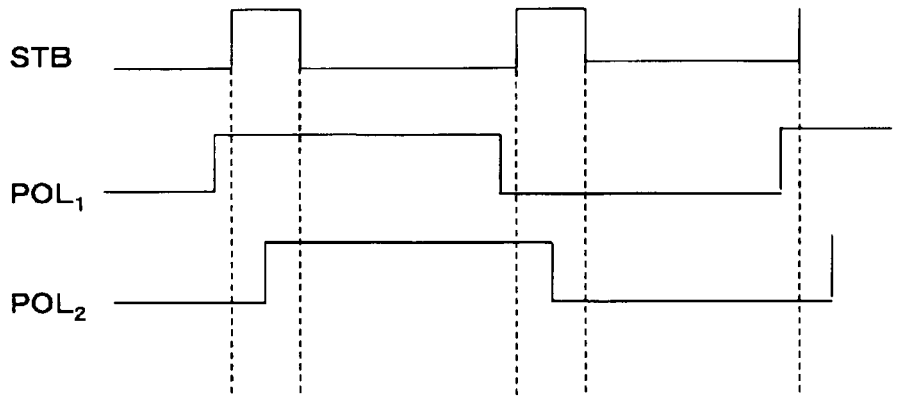
Fig.11
| | | | | | | | |
|---|---|---|---|---|---|---|---|
| ODD-NUMBERED ROW | + | − | + | − | + | − | ··· |
| EVEN-NUMBERED ROW | − | + | − | + | − | + | ··· |
Fig.12
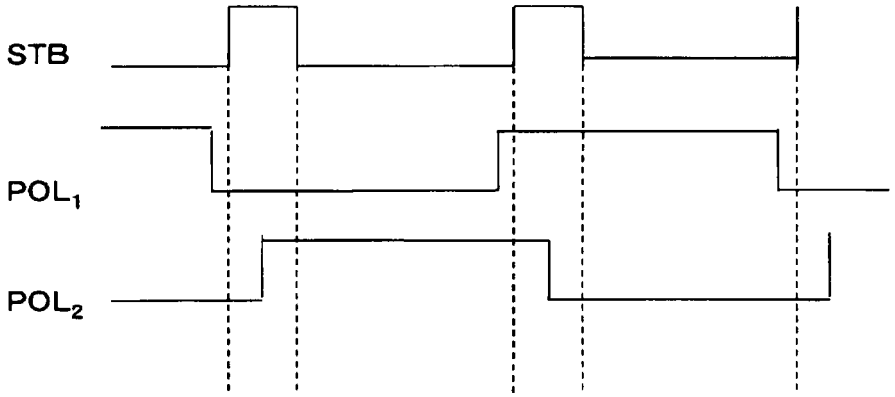

| | | | | | | | |
|---|---|---|---|---|---|---|---|
| ODD-NUMBERED ROW | − | + | − | + | − | + | ... |
| EVEN-NUMBERED ROW | + | − | + | − | + | − | ... |

DRIVING DEVICE FOR LIQUID CRYSTAL DISPLAY PANEL

BACKGROUND OF INVENTION

1. Field of Invention

The present invention relates to a driving device for driving an active matrix LCD (Liquid Crystal Display) panel.

2. Discussion of Background

An active matrix LCD device has a liquid crystal interposed between a common electrode and a plurality of pixel electrodes. Each pixel electrode is provided with an active device such as a TFT (Thin Film Transistor) and the active device is used to control whether a voltage of a source line is to be set for the pixel electrode.

The common electrode is set at a predetermined potential and each pixel electrode is set at a potential according to each pixel value of a display image. A state in which the potential of the pixel electrode is higher than the potential of the common electrode will be referred to as positive polarity. Furthermore, a state in which the potential of the pixel electrode is lower than the potential of the common electrode will be referred to as negative polarity.

FIG. 29 is an explanatory drawing showing an example of the potential of the common electrode and potentials to set the pixel in white or in black by each of polarities. The below will describe an example of the normally white case. The potential of the common electrode is denoted by $V_{COM}$. In FIG. 29, $V_{pb}$, $V_{pw}$, $V_{COM}$, $V_{nw}$, and $V_{nb}$ represent respective potentials, which are in the relation of $V_{nb}<V_{nw}<V_{COM}<V_{pw}<V_{pb}$. For displaying the pixel in black by positive polarity, the potential of the source line connected to the pixel is set at $V_{pb}$; for displaying the pixel in white by positive polarity, the potential of the source line connected to the pixel is set at $V_{pw}$. For setting the pixel in halftone display by positive polarity, the potential of the source line connected to the pixel is set at a potential higher than $V_{pw}$ and lower than $V_{pb}$. For displaying the pixel in black by negative polarity, the potential of the source line connected to the pixel is set at $V_{nb}$; for displaying the pixel in white by negative polarity, the potential of the source line connected to the pixel is set at $V_{nw}$. For setting the pixel in halftone display by negative polarity, the potential of the source line connected to the pixel is set at a potential lower than $V_{nw}$ and higher than $V_{nb}$.

The active matrix LCD device is preferably driven so as to minimize consecutive arrangement of pixels of the same polarity, for prevention of crosstalk. FIG. 30 is an explanatory drawing showing a general LCD device. As shown in FIG. 30, pixel electrodes 50 are arranged in a matrix pattern and each pixel electrode is provided with a TFT 51. In FIG. 30, pixels for red display are denoted by "R," pixels for green display by "G," and pixels for blue display by "B."

As shown in FIG. 30, the device is provided with a source driver 60 for setting potentials of the respective source lines $S_1$ to $S_n$ and the source lines are connected to respective output terminals $D_1$ to $D_n$ of the source driver 60. In the example shown in FIG. 30, each TFT 51 is disposed on the left side of the pixel electrode 50 and is connected to the source line present on the left side of the pixel electrode 50. Furthermore, gate lines $G_1$, $G_2$, $G_3$, . . . are provided for respective rows of pixels and each gate line is connected to TFTs 51 of the respective pixel electrodes in the corresponding row. The gate lines are sequentially selected and the TFTs 51 in the selected row make the pixel electrodes 50 conductive to the respective source lines. As a consequence, the pixel electrodes 50 in the selected row are controlled to potentials equal to those of the source lines present on the left side of the pixel electrodes. The TFTs 51 in non-selected rows keep the pixel electrodes 50 nonconductive to the source lines. As the gate lines are sequentially selected, the source driver 60 sets the potentials of the respective source lines to potentials according to pixel values of the respective pixels in each selected row, thereby displaying an image according to image data.

In the general LCD device shown in FIG. 30, the source driver 60 controls the polarities of adjacent pixels so as to be different from each other, for example, as described below. During selection of a gate line of an odd-numbered row in a certain frame, the source driver 60 sets potentials of the source lines $S_1$, $S_3$, $S_6$, . . . of the odd-numbered columns to potentials higher than the potential $V_{COM}$ of the common electrode (not shown) and sets potentials of the source lines $S_2$, $S_4$, $S_6$, . . . of the even-numbered columns to potentials lower than $V_{COM}$. During selection of a gate line of an even-numbered row, the source driver 60 sets potentials of the source lines $S_1$, $S_3$, $S_5$, . . . of the odd-numbered columns to potentials lower than $V_{COM}$ and sets potentials of the source lines $S_2$, $S_4$, $S_6$, . . . of the even-numbered columns to potentials higher than $V_{COM}$. As a consequence, the display panel is controlled to make adjacent pixels alternately positive and negative, as shown in FIG. 30. In FIG. 30, "+" represents positive polarity and "−" negative polarity.

Furthermore, the source driver 60 switches the potentials of the source lines so as to invert the polarities of the individual pixels at every switch of frame. Namely, in the next frame to the foregoing frame, the source driver 60 sets the potentials of the source lines of the odd-numbered columns to potentials lower than $V_{COM}$ and sets the potentials of the source lines of the even-numbered columns to potentials higher than $V_{COM}$ during selection of a gate line of each odd-numbered row. During selection of a gate line of each even-numbered row, the source driver 60 sets the potentials of the source lines of the odd-numbered columns to potentials higher than $V_{COM}$ and sets the potentials of the source lines of the even-numbered columns to potentials lower than $V_{COM}$. As a result, the polarities of the respective pixels become opposite to those of the pixels shown in FIG. 30.

In this driving method, every time the selected row is switched, the potentials of the individual source lines are varied from the potentials higher than $V_{COM}$ to the potentials lower than $V_{COM}$ or from the potentials lower than $V_{COM}$ to the potentials higher than $V_{COM}$. For this reason, power consumption becomes greater. Particularly, since power consumption of the LCD panel is proportional to the square of a potential difference in each source line upon switching of the selected row, the increase in the number of potential switching times of the source lines leads to increase in power consumption.

There is a proposed LCD device capable of implementing control to make the polarities of adjacent pixels different, while reducing power consumption (cf. Patent Document 1). In the LCD device described in Patent Document 1, the TFTs connected to the gate lines of the odd-numbered rows are formed on the left side of the source lines and the TFTs connected to the gate lines of the even-numbered rows are formed on the right side of the source lines. This configuration prevents the potentials of the source lines from varying from potentials higher than $V_{COM}$ to potentials lower than $V_{COM}$ or from varying from potentials lower than $V_{COM}$ to potentials higher than $V_{COM}$, at every select period.

CITATION LIST

Patent Document

Patent Document 1: JP-A-2009-181100 (cf. Paragraphs [0008]-[0018] and FIGS. 1-6)

SUMMARY OF INVENTION

Technical Problem

It can be contemplated that the LCD panel is constructed in a configuration in which the number of source lines is by one larger than the number of columns of pixel electrodes and each column of pixel electrodes is arranged between source lines. In this configuration, for example, each pixel electrode in the odd-numbered rows is connected to the left source line through a TFT. Each pixel electrode in the even-numbered rows is connected to the right source line through a TFT. The number of source lines in this configuration is n+1. During a select period of an odd-numbered row, potentials according to respective pixel values in the selected row are set for the leftmost source line to the n-th source line, thereby setting potentials of n pixel electrodes in one row. During a select period of an even-numbered row, potentials according to respective pixel values in the selected row are set for the second source line to the (n+1)th source line from the left, thereby setting potentials of n pixel electrodes in one row. This operation enables the pixel electrodes in each row to be set to potentials according to respective pixel values.

Furthermore, there are cases where only some of output terminals of the source driver are connected to the source lines to drive the LCD panel. For example, when the number of output terminals of one source driver is smaller than the number of source lines of the LCD panel, a plurality of source drivers can be used to drive one LCD panel. In this case, if the total number of output terminals of the source drivers is larger than the number of source lines of the LCD panel, some of the output terminals of each source driver are connected to the respective source lines and the potentials of the source lines are set by the connected output terminals. Therefore, there are output terminals that are not connected to any source line and that do not contribute to the potential setting of the source lines.

In general, in the case where only some of output terminals of a source driver are connected to source lines, the output terminals in the central region in the source driver are not connected to any source line, whereas the output terminals arranged on both sides thereof are connected to the source lines.

However, this connection configuration wherein the output terminals arranged on both sides are connected to the source lines without connecting the output terminals in the central region in the source driver to any source line has been applied heretofore to the LCD panel of the configuration illustrated in FIG. 30.

For this reason, there were no conventional driving devices for driving the LCD panel wherein the number of source lines was by one greater than the number of columns of pixel electrodes and wherein the columns of pixel electrodes were arranged between the source lines, while allowing the potential output terminals in the central region out of a plurality of potential output terminals be unconnected to any source line. In other words, the conventional driving devices for driving such LCD panel failed to realize a driving mode of setting potentials according to respective pixel values in the selected row for the leftmost source line to the n-th source line in a select period of each odd-numbered row and setting potentials according to respective pixel values in the selected row for the second source line to the (n+1)th source line from the left in a select period of each even-numbered row, in the configuration wherein the potential output terminals in the central region were not connected to any source line.

It is therefore an object of the present invention to provide a driving device for driving an LCD panel in which the number of source lines is by one larger than the number of columns of pixel electrodes and in which columns of pixel electrodes are arranged between source lines, which allows potential output terminals in a central region out of a plurality of potential output terminals be unconnected to any source line.

Solution to Problem

A driving device for a liquid crystal display panel according to the present invention is an LCD panel driving device for driving a liquid crystal display panel which comprises a common electrode, a plurality of pixel electrodes arranged in a matrix pattern, and source lines the number of which is by one larger than the number of columns of the pixel electrodes, in which each column of the pixel electrodes is arranged between adjacent source lines, and in which when rows of the pixel electrodes are grouped so that each group includes one row or a plurality of consecutive rows, each pixel electrode in each row in each odd-numbered group is connected to a source line on a predetermined side among source lines present on both sides of the pixel electrode and each pixel electrode in each row in each even-numbered group is connected to a source line on the opposite side to the predetermined side out of source lines present on both sides of the pixel electrode, the driving device comprising: an output switching section having m input terminals and (m+1) output terminals, and configured so that when the k-th input terminal from the predetermined side is defined as $I_k$, when the k-th and the (k+1)th output terminals from the predetermined side are defined as $O_k$ and $O_{k+1}$, respectively, and when k is defined as each value from 1 to m, the output switching section connects the input terminal $I_k$ to the output terminal $O_k$ if a control signal to define a terminal to be connected to the input terminal $I_k$ is at a first level and the output switching section connects the input terminal $I_k$ to the output terminal $O_{k+1}$ if the control signal is at a second level; and output means having m output terminals arranged in a row direction of pixels, and configured so that when, among the m output terminals, a plurality of output terminals consecutively arranged from the predetermined side are defined as a first output terminal group, a plurality of output terminals arranged following the first output terminal group are defined as a second output terminal group, and a plurality of output terminals arranged following the second output terminal group are defined as a third output terminal group, the second output terminal group does not contribute to potential setting for the source lines and so that the output means outputs data or signals about pixels from the first output terminal group and the third output terminal group, wherein the relation of a+c=n is met where n represents the number of pixels in one row, a the number of the output terminals belonging to the first output terminal group, b the number of the output terminals belonging to the second output terminal group, and c the number of the output terminals belonging to the third output terminal group, wherein the number of data or signals input to the input terminals of the output switching section is n, wherein the input terminals $I_1$ to $I_{a-1}$ of the output switching section are connected to the first to (a−1)th respective output terminals from the predetermined side belonging to the first output terminal group, the number of data or signals input to the input terminals $I_1$ to $I_{a-1}$ is (a−1), the input terminals $I_{a+b+1}$ to $I_m$ of the output switching section are connected to the respective output terminals belonging to the third output terminal group, and the number of data or signals input to the input terminals $I_{a+b+1}$ to $I_m$ is c, and wherein data or a signal output from the a-th output terminal from the predetermined side of the output means is input to the input terminal $I_a$ of the output switching section or to the input terminal $I_{a+b}$ of the output switching section.

The driving device may be configured as follows: it further comprises a switch having a first terminal, a second terminal, and a third terminal, and configured to connect the first terminal to the second terminal if the control signal is at the first level and to connect the first terminal to the third terminal if the control signal is at the second level; the data or signal output from the a-th output terminal from the predetermined side of the output means is supplied to the third terminal of the switch; the first terminal of the switch is connected to the input terminal $I_{a+b}$ of the output switching section and the second terminal of the switch is connected to the (a+b)th output terminal from the predetermined side of the output means; the output terminals $O_1$ to $O_a$ and $O_{a+b+1}$ to $O_{m+1}$ of the output switching section individually correspond to the source lines and are connected to the corresponding source lines or to respective paths continuous to the corresponding source lines.

The driving device may be configured as follows: it further comprises another switch having a first terminal, a second terminal, and a third terminal, and configured to connect the first terminal to the second terminal if the control signal is at the first level and to connect the first terminal to the third terminal if the control signal is at the second level; the first terminal of the other switch is connected to the a-th output terminal from the predetermined side of the output means and the second terminal of the other switch is connected to the input terminal $I_a$ of the output switching section; the third terminal of the other switch is connected to the third terminal of the afore-mentioned switch.

The driving device may be configured as follows: the output means is a D-A converter which converts data indicative of n pixel values in one row to potentials according to the pixel values and which outputs the potentials according to the pixel values in the individual pixels from the respective output terminals belonging to the first output terminal group and the respective output terminals belonging to the third output terminal group.

The driving device may be configured as follows: the input terminals $I_1$ to $I_{a-1}$ of the output switching section are connected through a voltage follower to the first to (a−1)th respective output terminals from the predetermined side belonging to the first output terminal group and the input terminals $I_{a+b+1}$ to $I_m$ of the output switching section are connected through the voltage follower to the respective output terminals belonging to the third output terminal group; the first terminal of the other switch is connected through the voltage follower to the a-th output terminal from the predetermined side of the output means.

The driving device may be configured as follows: the output means is a shift register having m output terminals and configured to sequentially output data read indication signals each to indicate read of a pixel value of one pixel, from the first to a-th output terminals from the predetermined side and the (a+b+1)th to m-th output terminals from the predetermined side; the driving device further comprises: a first latch section having (m+1) signal input terminals and (m+1) data output terminals, and configured to read and store data indicative of a pixel value of one pixel at every input of the sequential data read indication signals to n signal input terminals out of the first to a-th signal input terminals from the predetermined side and the (a+b+1)th to (m+1)th signal input terminals from the predetermined side among the (m+1) signal input terminals, and to output data indicative of pixel values of one row from n data output terminals corresponding to the respective signal input terminals receiving the data read indication signals; a second latch section having (m+1) data input terminals and (m+1) data output terminals, and configured to capture the data indicative of the pixel values of one row through the n data output terminals of the first latch section and through n data input terminals corresponding to the n data output terminals and to output the data indicative of the pixel values of one row from n data output terminals corresponding to the n data input terminals; a level shifter having (m+1) data input terminals and (m+1) data output terminals, and configured to capture the data indicative of the pixel values of one row through n data input terminals corresponding to the n data output terminals of the second latch section outputting the data indicative of the pixel values, to perform a level shift of the data, and to output the data after the level shift from n data output terminals corresponding to the n data input terminals; and a D-A converter having (m+1) data input terminals and (m+1) potential output terminals, and configured to capture the data indicative of the pixel values of one row from n data input terminals corresponding to the n data output terminals of the level shifter outputting the data indicative of the pixel values, and to output potentials according to the pixel values from n potential output terminals corresponding to the n data input terminals; the output terminals $O_1$ to $O_a$ of the output switching section are connected to the first to a-th respective signal input terminals from the predetermined side of the first latch section and the output terminals $O_{a+b+1}$ to $O_{m+1}$ of the output switching section are connected to the (a+b+1)th to (m+1)th respective signal input terminals from the predetermined side of the first latch section; the first to a-th potential output terminals from the predetermined side and the (a+b+1)th to (m+1)th potential output terminals from the predetermined side in the D-A converter individually correspond to the source lines and are connected through a voltage follower to the corresponding source lines.

The driving device may be configured as follows: it comprises a shift register having m signal output terminals, and configured to sequentially output data read indication signals each to indicate read of a pixel value of one pixel, from the first to a-th signal output terminals from the predetermined side and the (a+b+1)th to m-th signal output terminals from the predetermined side out of the m signal output terminals; the output means is a first latch section having m signal input terminals, and configured to read and store data indicative of a pixel value of one pixel at every input of the sequential data read indication signals to the first to a-th signal input terminals from the predetermined side and the (a+b+1)th to m-th signal input terminals from the predetermined side out of the m signal input terminals, and to output data indicative of pixel values of one row from n output terminals corresponding to the respective signal input terminals receiving the data read indication signals; the driving device further comprises: a second latch section having (m+1) data input terminals and (m+1) data output terminals, and configured to capture the data indicative of the pixel values of one row through n data input terminals corresponding to n output terminals of the output switching section becoming connected to the n output terminals of the first latch section, and to output the data indicative of the pixel values of one row from n data output terminals corresponding to the n data input terminals; a level shifter having (m+1) data input terminals and (m+1) data output terminals, and configured to capture the data indicative of the pixel values of one row through n data input terminals corresponding to the n data output terminals of the second latch section outputting the data indicative of the pixel values, to perform a level shift of the data, and to output the data after the level shift from n data output terminals corresponding to the n data input terminals; and a D-A converter having (m+1) data input terminals and (m+1) potential output terminals, and configured to capture the data indicative of the pixel values of one row through n data input terminals corresponding to the n data output terminals of the level shifter outputting the data indicative of the pixel values, and to output potentials according to the pixel values from n potential output terminals corresponding to the n data input terminals; the output terminals $O_1$ to $O_a$ of the output switching section are connected to the first to a-th respective data input terminals from the predetermined side of the second latch section and the output terminals $O_{a+b+1}$ to $O_{m+1}$ of the output switching section are connected to the (a+b+1)th to (m+1)th respective data input terminals from the predetermined side of the second latch section; the first to a-th potential output terminals from the predetermined side and the (a+b+1)th to (m+1)th potential output terminals from the predetermined side in the D-A converter individually correspond to the source lines and are connected through a voltage follower to the corresponding source lines.

The driving device may be configured as follows: it comprises: a shift register having m signal output terminals, and configured to sequentially output data read indication signals each to indicate read of a pixel value of one pixel, from the first to a-th signal output terminals from the predetermined side and the (a+b+1)th to m-th signal output terminals from the predetermined side out of the m signal output terminals; and a first latch section having m signal input terminals and m data output terminals, and configured to read and store data indicative of a pixel value of one pixel at every input of the sequential data read indication signals to the first to a-th signal input terminals from the predetermined side and the (a+b+1) th to m-th signal input terminals from the predetermined side out of the m signal input terminals, and to output data indicative of pixel values of one row from n data output terminals corresponding to the respective signal input terminals receiving the data read indication signals; the output means is a second latch section having m data input terminals, and configured to capture the data indicative of the pixel values of one row from the first latch section through the first to a-th data input terminals from the predetermined side and the (a+b+1) th to m-th data input terminals from the predetermined side, and to output the data indicative of the pixel values of one row from n output terminals corresponding to the n data input terminals capturing the data; the driving device further comprises: a level shifter having (m+1) data input terminals and (m+1) data output terminals, and configured to capture the data indicative of the pixel values of one row through n data input terminals corresponding to the n output terminals of the second latch section outputting the data indicative of the pixel values, to perform a level shift of the data, and to output the data after the level shift from n data output terminals corresponding to the n data input terminals; and a D-A converter having (m+1) data input terminals and (m+1) potential output terminals, and configured to capture the data indicative of the pixel values of one row through n data input terminals corresponding to the n data output terminals of the level shifter outputting the data indicative of the pixel values, and to output potentials according to the pixel values from n potential output terminals corresponding to the n data input terminals; the output terminals $O_1$ to $O_a$ of the output switching section are connected to the first to a-th respective data input terminals from the predetermined side of the level shifter and the output terminals $O_{a+b+1}$ to $O_{m+1}$ of the output switching section are connected to the (a+b+1)th to (m+1)th respective data input terminals from the predetermined side of the level shifter; the first to a-th potential output terminals from the predetermined side and the (a+b+1)th to (m+1)th potential output terminals from the predetermined side in the D-A converter individually correspond to the source lines and are connected through a voltage follower to the corresponding source lines.

The driving device may be configured as follows: it comprises a shift register having m signal output terminals, and configured to sequentially output data read indication signals each to indicate read of a pixel value of one pixel, from the first to a-th signal output terminals from the predetermined side and the (a+b+1)th to m-th signal output terminals from the predetermined side out of the m signal output terminals; a first latch section having m signal input terminals and m data output terminals, and configured to read and store data indicative of a pixel value of one pixel at every input of the sequential data read indication signals to the first to a-th signal input terminals from the predetermined side and the (a+b+1)th to m-th signal input terminals from the predetermined side out of the m signal input terminals, and to output data indicative of pixel values of one row from n output terminals corresponding to the respective signal input terminals receiving the data read indication signals; and a second latch section having m data input terminals and m data output terminals, and configured to capture the data indicative of the pixel values of one row from the first latch section through the first to a-th data input terminals from the predetermined side and the (a+b+1)th to m-th data input terminals from the predetermined side, and to output the data indicative of the pixel values of one row from n output terminals corresponding to the n data input terminals capturing the data; the output means is a level shifter having m data input terminals, and configured to capture the data indicative of the pixel values of one row from the second latch section through the first to a-th data input terminals from the predetermined side and the (a+b+1) th to m-th data input terminals from the predetermined side, to perform a level shift of the data, and to output the data after the level shift indicative of the pixel values of one row from n output terminals corresponding to the n data input terminals capturing the data; the driving device further comprises: a D-A converter having (m+1) data input terminals and (m+1) potential output terminals, and configured to capture the data indicative of the pixel values of one row through n data input terminals corresponding to the n data output terminals of the level shifter outputting the data indicative of the pixel values, and to output potentials according to the pixel values from n potential output terminals corresponding to the n data input terminals; the output terminals $O_1$ to $O_a$ of the output switching section are connected to the first to a-th respective data input terminals from the predetermined side of the D-A converter and the output terminals $O_{a+b+1}$ to $O_{m+1}$ of the output switching section are connected to the (a+b+1)th to (m+1)th respective data input terminals from the predetermined side of the D-A converter; the first to a-th potential output terminals from the predetermined side and the (a+b+1)th to (m+1) th potential output terminals from the predetermined side in the D-A converter individually correspond to the source lines and are connected through a voltage follower to the corresponding source lines.

Another driving device for a liquid crystal display panel according to the present invention is an LCD panel driving device for driving a liquid crystal panel which comprises a common electrode, a plurality of pixel electrodes arranged in a matrix pattern, and source lines the number of which is by one larger than the number of columns of the pixel electrodes, in which each column of the pixel electrodes is arranged between adjacent source lines, and in which when rows of the pixel electrodes are grouped so that each group includes one row or a plurality of consecutive rows, each pixel electrode in each row in each odd-numbered group is connected to a source line on a predetermined side out of source lines present on both sides of the pixel electrode and each pixel electrode in each row in each even-numbered group is connected to a source line on the opposite side to the predetermined side out of source lines present on both sides of the pixel electrode, the driving device comprising: an output switching section having m input terminals and (m+1) output terminals, and configured so that when the k-th input terminal from the predetermined side is defined as $I_k$, when the k-th and the (k+1)th output terminals from the predetermined side are defined as $O_k$ and $O_{k+1}$, respectively, and when k is defined as each value from 1 to m, the output switching section connects the input terminal $I_k$ to the output terminal $O_k$ if a control signal to define a terminal to be connected to the input terminal $I_k$ is at a first level and the output switching section connects the input terminal $I_k$ to the output terminal $O_{k+1}$ if the control signal is at a second level; and output means having m output terminals arranged in a row direction of pixels, and configured so that when, among the m output terminals, a plurality of output terminals consecutively arranged from the predetermined side are defined as a first output terminal group, a plurality of output terminals arranged following the first output terminal group are defined as a second output terminal group, and a plurality of output terminals arranged following the second output terminal group are defined as a third output terminal group, the second output terminal group does not contribute to potential setting for the source lines and so that the output means outputs data or signals about pixels from the first output terminal group and the third output terminal group, wherein the relation of a+c=n is met where n represents the number of pixels in one row, a the number of the output terminals belonging to the first output terminal group, b the number of the output terminals belonging to the second output terminal group, and c the number of the output terminals belonging to the third output terminal group, wherein the number of data or signals input to the input terminals of the output switching section is n+1, wherein the input terminals $I_1$ to $I_a$ of the output switching section are connected to the first to a-th respective output terminals from the predetermined side belonging to the first output terminal group, the number of data or signals input to the input terminals $I_1$ to $I_a$ is a, the input terminals $I_{a+b+1}$ to $I_m$ of the output switching section are connected to the respective output terminals belonging to the third output terminal group, and the number of data or signals input to the input terminals $I_{a+b+1}$ to $I_m$ is c, and wherein data or a signal input from the (a+b)th output terminal from the predetermined side of the output means to the input terminal $I_{a+b}$ of the output switching section is identical to data or a signal input from the a-th output terminal from the predetermined side of the output means to the input terminal $I_a$ of the output switching section.

The driving device may be configured as follows: the output means is a shift register having m signal output terminals, and configured to output data read indication signals each to indicate read of a pixel value of one pixel, from the first to a-th signal output terminals from the predetermined side and the (a+b+1)th to m-th signal output terminals from the predetermined side out of the m signal output terminals; the m input terminals of the output switching section are individually connected to the m signal output terminals of the shift register; the driving device further comprises: a first latch section having (m+1) signal input terminals individually connected to the output terminals $O_1$ to $O_{m+1}$ of the output switching section, and (m+1) data output terminals corresponding to the signal input terminals, and configured to read and store data indicative of a pixel value of one pixel according to input timing of a data read indication signal out of pixels in one row, with input of the data read indication signal to one or more signal input terminals out of the (m+1) signal input terminals, and to undergo capture of the stored data from a data output terminal corresponding to each signal input terminal receiving the data read indication signal; a second latch section having (m+1) data input terminals and (m+1) data output terminals, and configured to capture data from the first latch section through data output terminals of the first latch section corresponding to the signal input terminals of the first latch section receiving the data read indication signals and through data input terminals corresponding to the data output terminals, and to output the data from data output terminals corresponding to the data input terminals used in the capture of the data; a level shifter having (m+1) data input terminals and (m+1) data output terminals, and configured to capture the data through data input terminals corresponding to the data output terminals of the second latch section outputting the data indicative of pixel values, to perform a level shift of the data, and to output the data after the level shift from data output terminals corresponding to the data input terminals; and a D-A converter having (m+1) data input terminals and (m+1) potential output terminals, and configured to capture the data through data input terminals corresponding to the data output terminals of the level shifter outputting the data indicative of the pixel values, and to output potentials according to the data from potential output terminals corresponding to the data input terminals; the first to a-th potential output terminals from the predetermined side and the (a+b+1)th to (m+1)th potential output terminals from the predetermined side in the D-A converter individually correspond to the source lines and are connected through a voltage follower to the corresponding source lines; and the shift register sequentially outputs the data read indication signals from the first to (a−1)th signal output terminals from the predetermined side; the shift register simultaneously outputs the data read indication signals from the a-th and the (a+b)th signal output terminals from the predetermined side, after output of the data read indication signal from the (a−1)th signal output terminal from the predetermined side; the shift register sequentially outputs the data read indication signals from the (a+b+1)th to m-th signal output terminals from the predetermined side, after the simultaneous output of the data read indication signals from the a-th and (a+b)th signal output terminals.

The driving device may be configured as follows: it comprises a shift register having m signal output terminals, and configured to output data read indication signals each to indicate read of a pixel value of one pixel, from the first to a-th signal output terminals from the predetermined side and the (a+b+1)th to m-th signal output terminals from the predetermined side, out of the m signal output terminals; and a first latch section having m signal input terminals and m data output terminals, and configured to read and store data indicative of a pixel value of one pixel according to input timing of a data read indication signal out of pixels in one row, with input of the data read indication signal to one or more signal input terminals, and to undergo capture of stored data from the data output terminal corresponding to each signal input terminal receiving the data read indication signal; the m input terminals of the output switching section are individually connected to the m data output terminals of the first latch section; the driving device further comprises: a second latch section having (m+1) data input terminals individually connected to the output terminals $O_1$ to $O_{m+1}$ of the output switching section, and (m+1) data output terminals corresponding to the data input terminals, and configured to capture data from the first latch section through a data input terminal connected to an output terminal of the output switching section becoming connected to the data output terminal of the first latch section corresponding to each signal input terminal receiving the data read indication signal, and to output data indicative of a pixel value from a data output terminal corresponding to the data input terminal; a level shifter having (m+1) data input terminals and (m+1) data output terminals, and configured to capture data through data input terminals corresponding to the data output terminals of the second latch section outputting data indicative of pixel values, to perform a level shift of the data, and to output the data after the level shift from data output terminals corresponding to the data input terminals; and a D-A converter having (m+1) data input terminals and (m+1) potential output terminals, and configured to capture the data through data input terminals corresponding to the data output terminals of the level shifter outputting the data indicative of the pixel values, and to output potentials according to the data from potential output terminals corresponding to the data input terminals; the first to a-th potential output terminals from the predetermined side and the (a+b+1)th to (m+1)th potential output terminals from the predetermined side in the D-A converter individually correspond to the source lines and are connected through a voltage follower to the corresponding source lines; the first to (a−1)th signal output terminals from the predetermined side of the shift register are individually connected to the first to (a−1)th signal input terminals from the predetermined side of the first latch section, the a-th signal output terminal from the predetermined side of the shift register is connected to the a-th and the (a+b)th signal input terminals from the predetermined side of the first latch section, and the (a+b+1)th to m-th signal output terminals from the predetermined side of the shift register are individually connected to the (a+b+1)th to m-th signal input terminals from the predetermined side of the first latch section; the shift register sequentially outputs the data read indication signals from the first to a-th signal output terminals from the predetermined side and, subsequently, the shift register sequentially outputs the data read indication signals from the (a+b+1)th to m-th signal output terminals from the predetermined side.

Still another driving device for a liquid crystal display panel according to the present invention is an LCD panel driving device for driving a liquid crystal display panel which comprises a common electrode, a plurality of pixel electrodes arranged in a matrix pattern, and source lines the number of which is by one larger than the number of columns of pixel electrodes, in which the number of columns of the pixel electrodes is a multiple of 3, in which columns of red pixels, columns of green pixels, and columns of blue pixels are repeatedly alternated, in which each column of the pixel electrodes is arranged between adjacent source lines, in which each pixel electrode in each odd-numbered row is connected to a source line on a predetermined side out of source lines present on both sides of the pixel electrode, and in which each pixel electrode in each even-numbered row is connected to a source line on the opposite side to the predetermined side out of source lines present on both sides of the pixel electrode, the driving device comprising: a first latch section comprising an array of (m+1) latch circuits each of which has a signal input terminal for input of a data read indication signal to indicate read of data indicative of a pixel value of a pixel, a data read terminal for capture of data indicative of a pixel value of one pixel with input of the data read indication signal to the signal input terminal, and an output terminal for output of the data; a shift register having (m/3) signal output terminals for output of respective data read indication signals, and configured so that when, among the (m/3) signal output terminals, a plurality of signal output terminals consecutively arranged from the predetermined side are defined as a first output terminal group, a plurality of signal output terminals arranged following the first output terminal group are defined as a second output terminal group, and a plurality of signal output terminals up to the most distant signal output terminal from the predetermined side arranged following the second output terminal group are defined as a third output terminal group, the shift register outputs no data read indication signal from the second output terminal group and outputs the data read indication signals from the first output terminal group and the third output terminal group; a signal branch section having (m/3) signal input terminals corresponding to the (m/3) signal output terminals of the shift register, and (m+1) signal output terminals, and configured so that when the (m+1) signal output terminals are defined as $Y_1$ to $Y_{m+1}$ from the predetermined side, when the i-th signal input terminal from the predetermined side is defined as $X_i$, and when i is defined as each value from 1 to m/3, the signal branch section outputs the data read indication signal input to the signal input terminal $X_i$ from signal output terminals $Y_{3\cdot i-2}$, $Y_{3\cdot i-1}$, $Y_{3\cdot i}$ if a predetermined control signal is at a high level and outputs the data read indication signal input to the signal input terminal $X_i$ from signal output terminals $Y_{3\cdot i-1}$, $Y_{3\cdot i}$, $Y_{3\cdot i+1}$ if the predetermined control signal is at a low level; a first switch having a first terminal, a second terminal, and a third terminal, and configured to connect the first terminal to the second terminal if the control signal is at the high level and to connect the first terminal to the third terminal if the control signal is at the low level; a second switch having a first terminal, a second terminal, and a third terminal, and configured to connect the first terminal to the second terminal if the control signal is at the high level and to connect the first terminal to the third terminal if the control signal is at the low level; an output switching section having m input terminals and (m+1) output terminals, and configured so that when the k-th input terminal from the predetermined side is defined as $I_k$, when the k-th and the (k+1)th output terminals from the predetermined side are defined as $O_k$ and $O_w$, respectively, and when k is defined as each value from 1 to m, the output switching section connects the input terminal $I_k$ to the output terminal $O_k$ if a control signal to define a terminal to be connected to the input terminal $I_k$ is at a high level and the output switching section connects the input terminal $I_k$ to the output terminal $O_w$ if the control signal is at a low level; a second latch section having (m+1) data input terminals and (m+1) data output terminals, and configured to capture data from the first latch section through data input terminals corresponding to the latch circuits storing data in the first latch section and to output the data from data output terminals corresponding to the data input terminals; a level shifter having (m+1) data input terminals and (m+1) data output terminals, and configured to capture the data through data input terminals corresponding to the data output terminals of the second latch section outputting the data indicative of pixel values, to perform a level shift of the data, and to output the data after the level shift from data output terminals corresponding to the data input terminals; a D-A converter having (m+1) data input terminals and (m+1) potential output terminals, and configured to capture the data through data input terminals corresponding to the data output terminals of the level shifter outputting the data indicative of the pixel values, and to output potentials according to the data from potential output terminals corresponding to the data input terminals; a red data line for supply of data indicative of pixel values of red pixels; a green data line for supply of data indicative of pixel values of green pixels; and a blue data line for supply of data indicative of pixel values of blue pixels, wherein the relation of $3\cdot(a+c)=n$ is satisfied where n represents the number of pixels in one row, a the number of the signal output terminals belonging to the first output terminal group, b the number of the signal output terminals belonging to the second output terminal group, and c the number of the signal output terminals belonging to the third output terminal group, wherein the signal output terminals $Y_1$ to $Y_{3\cdot a}$ of the signal branch section are connected to the signal input terminals of the respective latch circuits from the first to the (3·a)th from the predetermined side, and the signal output terminals $Y_{3\cdot(a+b+1)-1}$ to $Y_{m+1}$ of the signal branch section are connected to the signal input terminals of the respective latch circuits from the $\{3\cdot(a+b+1)-1\}$th to the (m+1)th from the predetermined side, wherein the first terminal of the first switch is connected to the signal output terminal $Y_{3\cdot a+1}$ of the signal branch section and the second terminal of the first switch is connected to the signal output terminal of the (3·a+1)th latch circuit from the predetermined side, wherein the first terminal of the second switch is connected to the signal input terminal of the $\{3\cdot(a+b+1)-2\}$th latch circuit from the predetermined side and the second terminal of the second switch is connected to the signal output terminal $Y_{3\cdot(a+b+1)-2}$ of the signal branch section, wherein the third terminal of the first switch is connected to the third terminal of the second switch, wherein the input terminals of the output switching section are connected to respective data lines in an order of the red data line, the green data line, and the blue data line, starting from the input terminal on the predetermined side, wherein the output terminals of the output switching section are connected to the data read terminals of the respective latch circuits, in order from the output terminal on the predetermined side, and wherein the first to (3·a)th potential output terminals from the predetermined side and the $\{3\cdot(a+b+1)-2\}$th to (m+1)th potential output terminals from the predetermined side in the D-A converter are individually connected to the (n+1) source lines in order from the predetermined side.

Effect Of Invention

The driving device according to the present invention is able to drive the LCD panel in which the number of source lines is by one larger than the number of columns of pixel electrodes and in which the columns of pixel electrodes are arranged between the source lines, while the potential output terminals in the central region out of the plurality of potential output terminals of the driving device are not connected to any source line.

BRIEF DESCRIPTION OF DRAWINGS

FIG. 10 is an explanatory drawing showing an example of changes of STB, $POL_1$, and $POL_2$.

FIG. 11 is an explanatory drawing showing an example of polarities of respective pixels.

FIG. 12 is an explanatory drawing showing an example of changes of STB, $POL_1$, and $POL_2$.

DETAILED DESCRIPTION OF PREFERRED EMBODIMENTS

Embodiments of the present invention will be described below with reference to the drawings.

[Embodiment 1]

Figure 1:
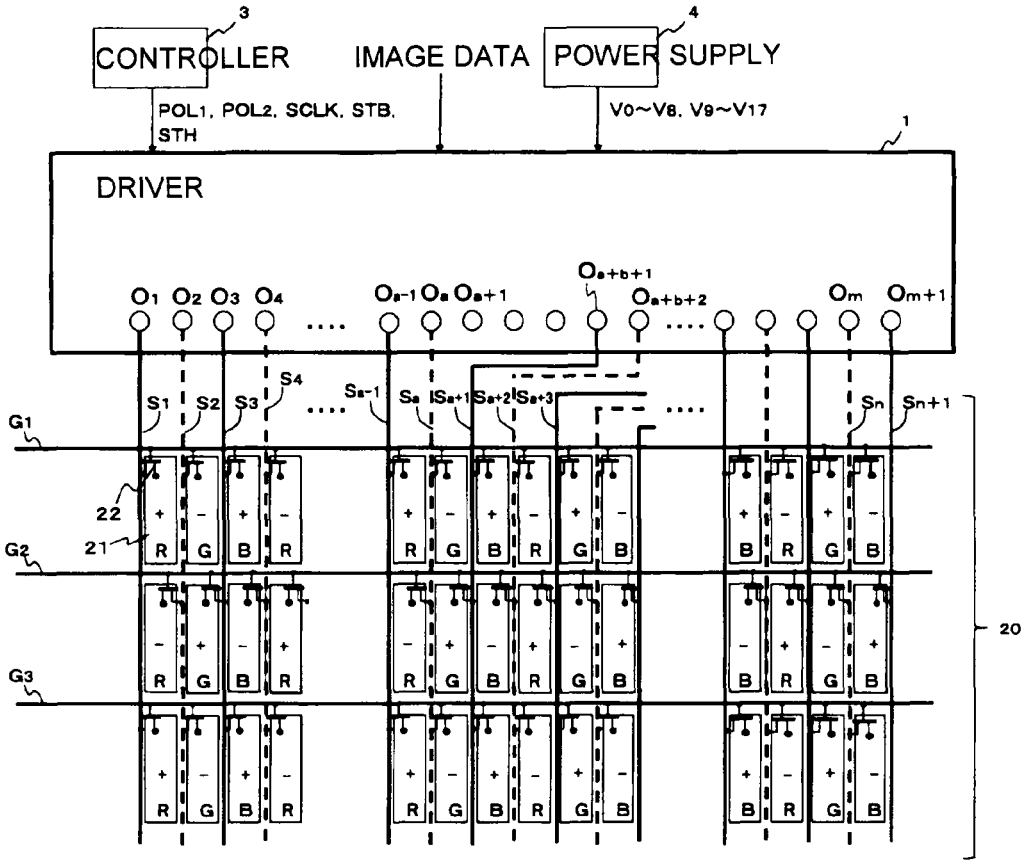
FIG. 1 is an explanatory drawing showing an example of the driving device for the LCD panel according to the present invention.

FIG. 1 is an explanatory drawing showing an example of the LCD (Liquid Crystal Display) panel driving device according to the present invention. The driving device of the present invention corresponds to a source driver for driving an LCD panel 20. This is also the case in each of the other embodiments.

A power supply 4 supplies voltages $V_0$-$V_8$, $V_9$-$V_{17}$ to the driving device 1. $V_0$-$V_8$ are voltages higher than a potential $V_{COM}$ of a common electrode (which is not shown in FIG. 1) and $V_9$-$V_{17}$ voltages lower than $V_{COM}$. It is assumed herein that $V_{17}<V_{16}<\ldots<V_9 V_{COM}<V_8<V_7<\ldots<V_0$. The present embodiment will be described using an example in which the power supply 4 supplies $V_0$-$V_8$ as voltages for display in positive polarity. The driving circuit 1 divides the voltages to implement, for example, display of 64 gray levels in positive polarity. Similarly, the present embodiment will be described using an example in which the power supply 4 supplies $V_9$-$V_{17}$ as voltages for display in negative polarity. The driving circuit 1 divides them to implement, for example, display of 64 gray levels in negative polarity. It is, however, noted that each set of voltages to be supplied for the display in positive polarity or in negative polarity by the power supply 4 do not have to be limited to the nine levels and the number of gray levels does not have to be limited to 64, either.

The driving device 1 captures image data in accordance with control of a control unit 3 and controls potentials of source lines $S_1$ to $S_{n+1}$ provided in the LCD panel 20.

In the present embodiment, the number of pixels (or the number of pixel electrodes 21) in each row in the LCD panel 20 driven by the driving device is assumed to be n. The LCD panel 20 has the source lines $S_1$ to $S_{n+1}$ the number of which is by one larger than the number of pixels in each row.

The driving device 1 is provided with (m+1) potential output terminals $O_1$ to $O_{m+1}$. When the LCD panel is viewed from the image observation side (viewer side), potential output terminals $O_1$ to $O_a$ from the first to the a-th from the left the number of which is a are connected in order to the leftmost source line $S_1$ to the a-th source line $S_a$, respectively. When viewed from the viewer side, potential output terminals $O_{a+1}$ to $O_{a+b}$ from the (a+1)th to the (a+b)th from the left the number of which is b are not connected to any source line. Furthermore, when viewed from the viewer side, (m+1−a−b) potential output terminals $O_{a+b+1}$ to $O_{m+1}$ from the (a+b+1)th to the (m+1)th are connected in order to the (a+1)th source line $S_{a+1}$ to the (n+1)th source line $S_{n+1}$ from the left. The number of source lines $S_{a+1}$ to $S_{n+1}$ is (n+1−a).

Therefore, the potential output terminals $O_1$ to $O_a$ and potential output terminals $O_{a+b+1}$ to $O_{m+1}$ arranged in succession on both sides in the driving device 1 are connected to the source lines, whereas the potential output terminals $O_{a+1}$ to $O_{a+b}$ arranged in succession in the central region in the driving device 1 are not connected to any source line.

The value of m−a−b herein is assumed to be c. Accordingly, the number of potential output terminals $O_{a+b+1}$ to $O_{m+1}$ is c+1. Since this number of potential output terminals is equal to the number of source lines $S_{a+1}$ to $S_{n+1}$, n+1−a, the relation of c+1=n+1−a holds. Namely, a+c=n.

Furthermore, the total number of potential output terminals $O_1$ to $O_a$ and $O_{a+b+1}$ to $O_{m+1}$ connected to the source lines is a+(c+1)=n+1.

The aforementioned values of a, b, and c are determined so as to satisfy the condition of being even numbers. Particularly, in the case where pixels of three kinds, R (red), G (green), and B (blue), are repetitively arranged in each row of the LCD panel 20, as shown in FIG. 1, the values of a, b, and c are determined so as to also satisfy the condition of being multiples of 3. Namely, the values of a, b, and c in this case are determined to be multiples of 6. They may be determined, for example, as follows: a=318, b=162, and c=324. In this case, m=804, and the number of potential output terminals of the driving device 1 is m+1=805.

Figure 2:
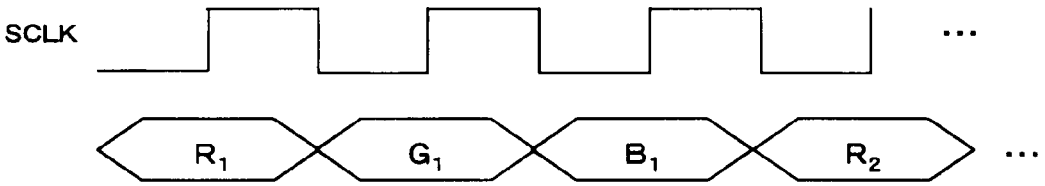
FIG. 2 is a timing chart showing an example of sequential capture timing of data in one row by driving device 1.

Image data corresponding to pixels in one row are input in order from data (pixel value) according to a pixel at one end among the pixels in one row to the driving device 1. The below will describe an example in which the image data are input in order from the pixel value of the left pixel when viewed from the viewer side. FIG. 2 is a timing chart showing an example of sequential data capture timing of one-row data by the driving device 1. The driving device 1 sequentially captures the one-row data of an image from the data of the left pixel in accordance with a control signal SCLK input from the control unit 3. SCLK is a control signal to indicate image capture. The driving device 1 captures image data of one pixel at a rising edge of SCLK. Specifically, as shown in FIG. 2, the driving device 1 captures the leftmost pixel value $R_1$ in the one-row image data at the first rising edge of SCLK and thereafter sequentially captures pixel values $G_1$, $B_1$, $R_2$, . . . at respective rising edges of SCLK. The number of pixels in one row is n which is one smaller than the number of source lines.

Figure 3:
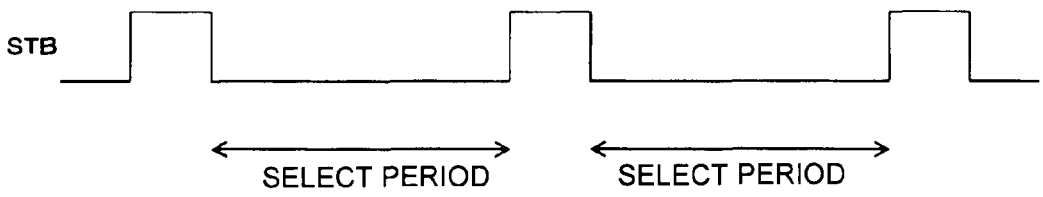
FIG. 3 is an explanatory drawing showing a change of STB.

The driving device 1 performs this capture operation of one-row data in a one-row select period in accordance with control of the control unit 3. Then the driving device 1 outputs potentials according to respective data of the one row from n potential output terminals out of the (n+1) potential output terminals connected to the source lines, in the next select period. Specifically, the driving device 1 outputs the potentials according to the one-row data from the n potential output terminals except for $O_{m+1}$ or from the n potential output terminals except for $O_1$, out of the potential output terminals $O_1$ to $O_a$ and the potential output terminals $O_{a+b+1}$ to $O_{m+1}$. The driving device 1 outputs the potentials in accordance with a control signal STB input from the control unit 3. STB is a control signal to indicate a select period of each row. FIG. 3 is an explanatory diagram showing a change of STB. A duration from a falling edge to a rising edge of STB is a select period of one row in the LCD panel 20 (cf. FIG. 1). The control unit 3 outputs SCLK (cf. FIG. 2) to indicate capture of one-row data of an image, during this select period and the driving device 1 captures and stores the data of one row. The driving device 1 outputs potentials according to pixel values of respective pixels in one row thus stored, from the n potential output terminals except for $O_{m+1}$ or from the n potential output terminals except for $O_1$, out of the potential output terminals $O_1$ to $O_a$ and $O_{a+b+1}$ to $O_{m+1}$, at a falling edge of STB.

The driving device 1 keeps outputs of the potential output terminals $O_{a+1}$ to $O_{a+b}$ not connected to any source line, in a high impedance state. Furthermore, the driving device 1 keeps outputs of a D-A converter (not shown in FIG. 1) in the driving device 1 in a high impedance state, during each duration in which STB is at a high level. Elements such as the D-A converter in the driving device 1 will be described later.

The driving device 1 switches the potentials output from the potential output terminals $O_1$ to $O_a$, $O_{a+b+1}$ to $O_{m+1}$ either to potentials higher than $V_{COM}$ or to potentials lower than $V_{COM}$ in accordance with control signals $POL_1$ and $POL_2$ input from the control unit 3. The potentials higher than $V_{COM}$ are, specifically, $V_0$ to $V_8$, or potentials obtained by voltage division based on $V_0$ to $V_8$, and will be referred to hereinafter as positive potentials. The potentials lower than $V_{COM}$ are, specifically, $V_9$ to $V_{17}$, or potentials obtained by voltage division based on $V_9$ to $V_{17}$, and will be referred to hereinafter as negative potentials.

In the first embodiment, the control unit 3 alternately switches the level of $POL_1$ between a high level and a low level at every cycle of STB (or at every row select period).

Under control of the control unit 3, the driving device 1 switches a potential output mode on a frame-by-frame basis between a potential output mode in which output potentials of the odd-numbered potential output terminals from the left as viewed from the viewer side are positive potentials and output potentials of the even-numbered potential output terminals from the left as viewed from the viewer side are negative potentials and a potential output mode in which output potentials of the odd-numbered potential output terminals from the left as viewed from the viewer side are negative potentials and output potentials of the even-numbered potential output terminals from the left as viewed from the viewer side are positive potentials. Therefore, in one frame, outputs from each individual potential output terminal are kept as positive potentials or as negative potentials, without being varied across the common electrode potential $V_{COM}$. Which level of potential should be output as a positive potential is determined depending upon a pixel value. Similarly, which level of potential should be output as a negative potential is also determined depending upon a pixel value. However, the outputs of the potential output terminals $O_{a+1}$ to $O_{a+b}$ not connected to any source line are kept in the high impedance state, irrespective of frames. One frame is a duration necessary for line-sequential selection (line-sequential scan) from the first row to the last row.

The driving device 1 outputs respective potentials according to n pixel values in one row from the n potential output terminals except for $O_{m+1}$ or from the n potential output terminals except for $O_1$, out of the potential output terminals $O_1$ to $O_a$ and $O_{a+b+1}$ to $O_{m+1}$, according to the control signal $POL_2$ input from the control unit 3. $POL_2$ is a control signal that indicates whether the potentials corresponding to the respective pixels (n pixels) in one row should be output from the n potential output terminals except for $O_{m+1}$ or from the n potential output terminals except for $O_1$, out of the potential output terminals $O_1$ to $O_a$ and $O_{a+b+1}$ to $O_{m+1}$. The control unit 3 turns $POL_2$ to a high level at a start of a frame. Then the control unit 3 alternately switches the level of $POL_2$ between the high level and a low level at every cycle of STB (or at every row select period) in that frame. Specifically, at every cycle of STB (cf. FIG. 3), the level of $POL_2$ is switched from high to low or from low to high in a duration in which STB is at the high level.

With $POL_2$ at the high level, the driving device 1 outputs the potentials corresponding to the n pixels for one row from the n potential output terminals except for $O_{m+1}$, out of the potential output terminals $O_1$ to $O_a$ and $O_{a+b+1}$ to $O_{m+1}$. With $POL_2$ at the low level, the driving device 1 outputs the potentials corresponding to the n pixels for one row from the n potential output terminals except for $O_1$, out of the potential output terminals $O_1$ to $O_a$ and $O_{a+b+1}$ to $O_{m+1}$. It is also possible to adopt an inverse configuration wherein with $POL_2$ at the high level the potentials are output from the n potential output terminals except for $O_1$ and with $POL_2$ at the low level the potentials are output from the n potential output terminals except for $O_{m+1}$.

The LCD panel 20 shown in FIG. 1 has a liquid crystal (not shown) interposed between a plurality of pixel electrodes 21 arranged in a matrix pattern, and a common electrode (not shown in FIG. 1) and is configured to display an image by changing the liquid crystal into states according to potential differences between the pixel electrodes 21 and the common electrode. The LCD panel 20 is provided with a pair of substrates (not shown) and has the plurality of pixel electrodes 21 arranged in the matrix pattern on one substrate and the common electrode on the other substrate. The two substrates are arranged with the group of pixel electrodes 21 and the common electrode being opposed to each other, and the liquid crystal is poured into between the substrates. The LCD panel 20 may be an in-plane switching (IPS) type LCD panel in which the pixel electrodes and common electrode are arranged on one substrate.

In the example shown in FIG. 1, the pixels are repeatedly arranged in the order of R, G, and B in each row of the LCD panel 20. In FIG. 1, the pixels for red display are denoted by "R," the pixels for green display by "G," and the pixels for blue display by "B".

Since the number of pixels in one row (or the number of pixel electrodes 21 in one row) is n, the number of columns of pixel electrodes is n. The LCD panel 20 is provided with the (n+1) source lines $S_1$ to $S_{n+1}$ and the pixel electrodes in each column are disposed between adjacent source lines. In other words, the LCD panel 20 is provided with the source lines to the left of the respective columns of pixel electrodes and also with the source line to the right of the rightmost pixel column. Therefore, the number n of columns of pixel electrodes in the pixel electrode group arranged in the matrix pattern is one smaller than the number of source lines.

Each pixel electrode 21 is provided with an active device 22 (cf. FIG. 1). In the description below, a configuration wherein the active device is a TFT (Thin Film Transistor) will be described as an example, but it should be noted that each pixel electrode 21 may be provided with any active device other than the TFT.

The present embodiment will be described using an example in which in each pixel electrode 21 in the odd-numbered rows, TFT 22 is provided on the left of the pixel electrode 21 as viewed from the viewer side, to connect the pixel electrode 21 to the source line on the left thereof. The present embodiment will be described using the example in which in each pixel electrode 21 in the even-numbered rows, TFT 22 is provided on the right of the pixel electrode 21 as viewed from the viewer side, to connect the pixel electrode 21 to the source line on the right thereof (cf. FIG. 1). For convenience, the example described herein is the one in which the TFTs in the odd-numbered rows are provided on the left of the pixel electrodes and the TFTs in the even-numbered rows on the right of the pixel electrodes, and it should be noted, however, that the locations of the TFTs per se may be optional as long as the pixel electrodes in the odd-numbered rows are connected to the left source lines and the pixel electrodes in the even-numbered rows to the right source lines.

In each TFT 22, for example, its source is connected to the source line and its drain to the pixel electrode 21.

The LCD panel 20 is also provided with gate lines $G_1$, $G_2$, $G_3$, . . . for the respective rows of pixel electrodes arranged in the matrix pattern. In FIG. 1, illustration of the gate lines in the fourth and subsequent rows is omitted. A gate line is connected to gates of TFTs 22 provided for the respective pixel electrodes 21 in a corresponding row. For example, the gate line $G_1$ shown in FIG. 1 is connected to the gates of TFTs 22 of the respective pixel electrodes in the first row.

Figure 4:
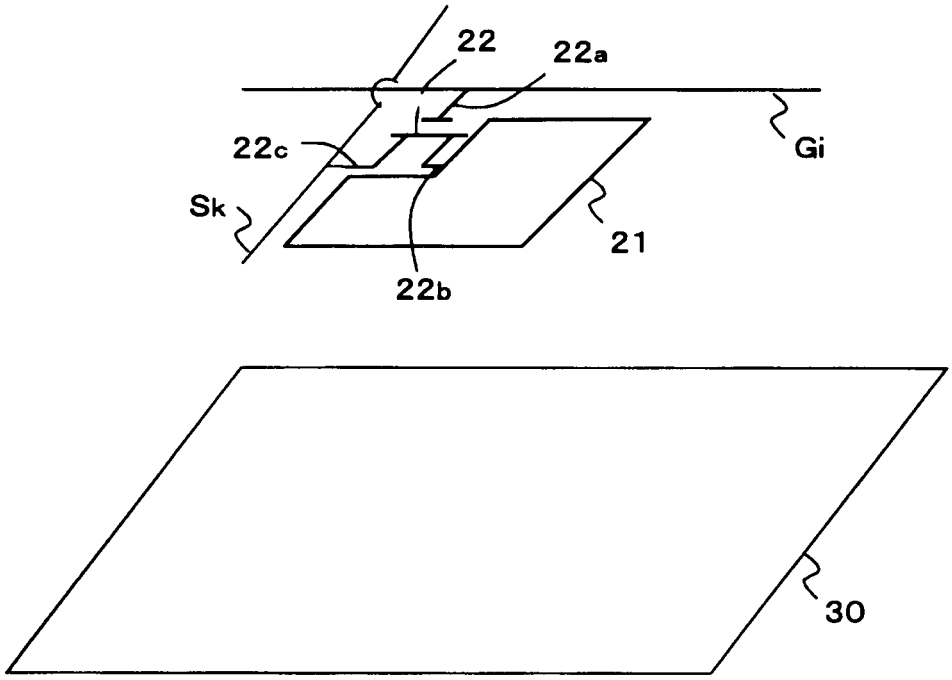
FIG. 4 is an explanatory drawing showing a connection example among a pixel electrode, a source line, and a gate line.

FIG. 4 is an explanatory drawing showing a connection example among a pixel electrode, a source line, and a gate line. FIG. 4 illustrates an example in which a pixel electrode 21 is connected to a gate line Gi of the i-th row and to a source line Sk located to the left of the pixel electrode 21. The gate $\mathbf{22}_a$ of TFT 22 is connected to the gate line Gi. In TFT 22, the source $\mathbf{22}_c$ is connected to the source line Sk and the drain $\mathbf{22}_b$ is connected to the pixel electrode 21. FIG. 4 illustrates the example in which the pixel electrode 21 is connected to the left source line, but if the pixel electrode 21 is connected to a right source line, the TFT 22 may be located, for example, on the right of the pixel electrode 21 so as to be connected in the same manner as in the case shown in FIG. 4.

In addition to the driving device 1 corresponding to the source driver, the display device is provided with a gate driver (not shown) for setting potentials of the respective gate lines. The gate driver line-sequentially selects the gate lines one by one, sets a selected gate line at a selected-period potential, and sets the nonselected gate lines at a nonselected-period potential. Therefore, the rows are selected one by one. The driving device 1 may be configured to include the function as gate driver.

Figure 5:
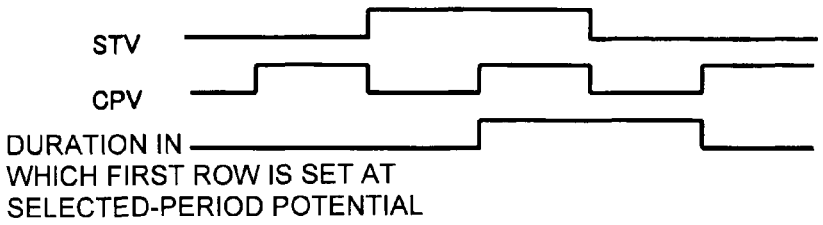
FIG. 5 is an explanatory drawing showing an example of STV and CPV.

The control unit 3 supplies a control signal to indicate a start of one frame (hereinafter referred to as STV) and a control signal to indicate a changeover of selected row (gate clock which will be referred to hereinafter as CPV), to the gate driver. FIG. 5 is an explanatory diagram showing an example of STV and CPV. A duration from a rising edge of CPV to a next rising edge of CPV is a period of CPV and duration for setting a gate line at the selected-period potential. The control unit 3 turns STV to a high level at a start of one frame, and keeps STV at a low level during other durations. Namely, the control unit 3 gives notice of a start of a frame by turning STV to the high level. When the gate driver detects a rising edge of CPV with STV at the high level, it sets the gate line of the first row at the selected-period potential and the gate lines of the other rows at the nonselected-period potential. Thereafter, the gate driver sequentially switches the row to be set at the selected-period potential, to another at every detection of a rising edge of CPV.

In each TFT 22, when the potential of the gate is set at the selected-period potential, the drain and source become conductive; when the potential of the gate is set at the nonselected-period potential, the drain and source become nonconductive. Therefore, each pixel electrode in a selected row becomes equipotential to the source line connected through the TFT. Each pixel electrode in nonselected rows becomes nonconductive to the source line.

In the example shown in FIG. 4, when the gate line Gi is selected to set the gate $\mathbf{22}_a$ at the selected-period potential, the drain $\mathbf{22}_b$ and the source $\mathbf{22}_c$ become conductive to make the pixel electrode 21 equipotential to the source line Sk. Then a state of the liquid crystal between the pixel electrode 21 and the common electrode 30 is defined according to a potential difference between the potential $V_{COM}$ of the common electrode 30 and the potential of the pixel electrode 21, so as to determine a display state in this pixel.

The control unit 3 supplies the foregoing signals $POL_1$, $POL_2$, SCLK, STB, etc. to the driving device 1 to control the driving device 1. The control unit 3 defines select periods by STB. Furthermore, the control unit 3 also supplies a below-described control signal STH to the driving device. The control signals supplied by the control unit 3 do not have to be limited to $POL_1$, $POL_2$, SCLK, STB, and STH, but other control signals may be used.

Figure 6:
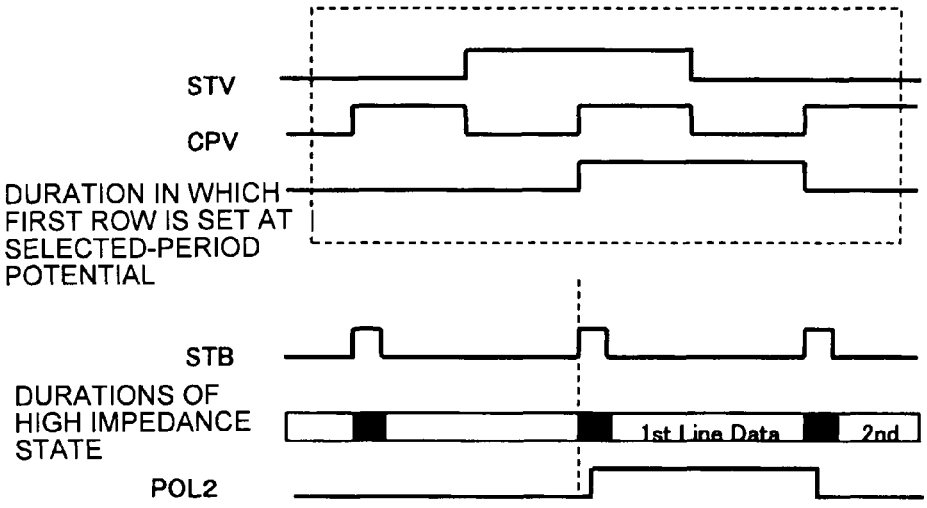
FIG. 6 is an explanatory drawing showing setting of timing of a rising edge of $POL_2$ at a start of a frame.

Since the first row being the odd-numbered row is selected at a start of a frame, the control unit 3 turns $POL_2$ to the high level at the start of the frame. The control unit 3 can turn the level of $POL_2$ to the high level, based on a rising edge of STB and a falling edge of STB in a duration in which STV (cf. FIG. 5) is set at the high level. FIG. 6 is an explanatory diagram showing timing setting of a rising edge of $POL_2$ at a start of a frame. In FIG. 6, the part indicated by dashed line is the same as FIG. 5. The driving device 1 keeps the outputs of the D-A converter (not shown in FIG. 1) in the high impedance state during the durations in which STB is at the high level. In FIG. 6 these durations are indicated in black. The control unit 3 can switch the level of $POL_2$ from the low level to the high level in a duration in which STV is at the high level (cf. FIG. 6). Thereafter, the control unit 3 may alternately switch the level of $POL_2$ every switching of STB to the high level.

In this manner, $POL_2$ turns to the high level at a start of a frame and then is switched at every cycle of STB.

The control unit 3 also alternately switches the level of $POL_1$ between the high level and the low level at every cycle of STB. The control unit 3 switches the levels of $POL_1$ and $POL_2$ between a mode in which $POL_1$ is also turned to the high level upon a changeover of $POL_2$ to the high level and $POL_1$ is also turned to the low level upon a changeover of $POL_2$ to the low level and a mode in which $POL_1$ is turned to the low level upon a changeover of $POL_2$ to the high level and $POL_1$ is turned to the high level upon a changeover of $POL_2$ to the low level, frame by frame.

Under this control, the driving device 1 in the first embodiment switches the potential output mode on a frame-by-frame basis, as described above, between the potential output mode in which the output potentials of the odd-numbered potential output terminals from the left are positive potentials and the output potentials of the even-numbered potential output terminals from the left are negative potentials and the potential output mode in which the output potentials of the odd-numbered potential output terminals from the left are negative potentials and the output potentials of the even-numbered potential output terminals from the left are positive potentials.

Figure 7:
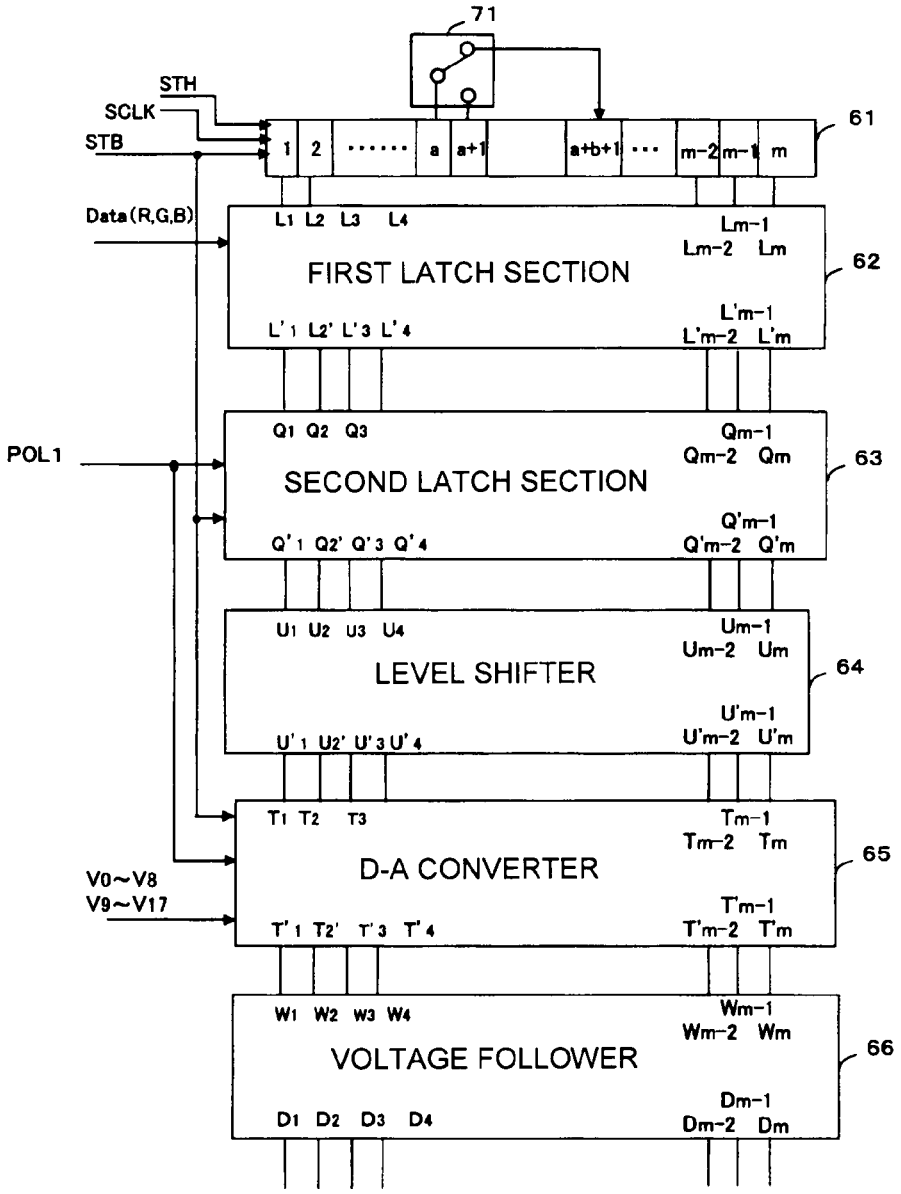
FIG. 7 is an explanatory drawing showing a configuration example of the driving device 1.
Figure 8:
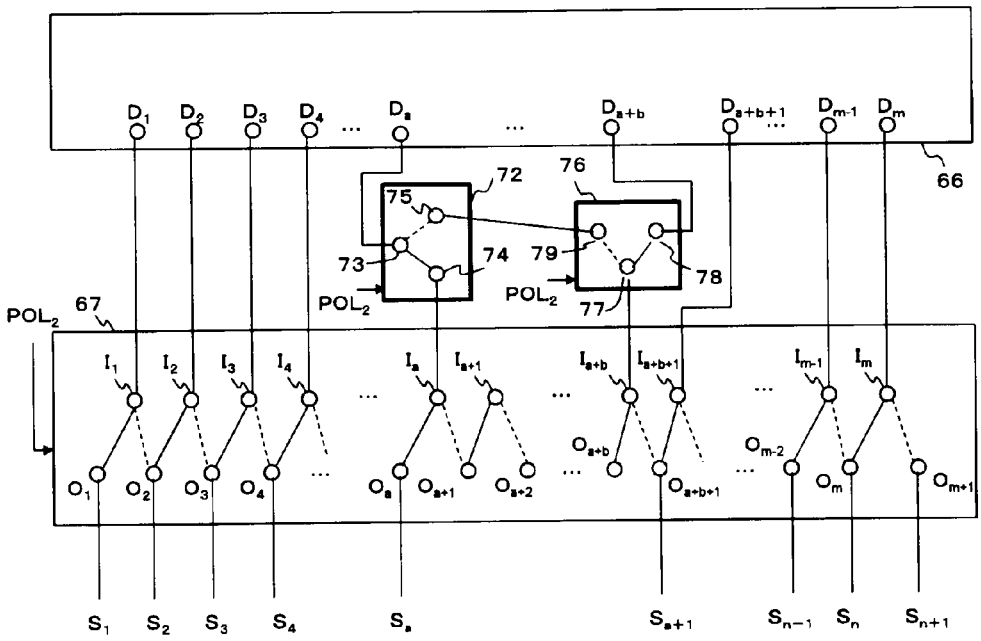
FIG. 8 is an explanatory drawing showing a configuration example of the driving device 1.

FIGS. 7 and 8 are explanatory drawings showing a configuration example of the driving device 1. As shown in FIG. 7, the driving device 1 is provided with a shift register 61, a shift register switch 71, a first latch section 62, a second latch section 63, a level shifter 64, a D-A converter 65, and a voltage follower 66. Furthermore, the driving device 1 is provided with an output switching section 67, a first changeover switch 72, and a second changeover switch 76 in the subsequent stage to the voltage follower 66, as shown in FIG. 8.

The control unit 3 (cf. FIG. 1) supplies SCLK, STH, and STB to the shift register 61. The shift register 61 is provided with m signal output portions. The individual signal output portions are provided with their respective signal output terminals and they output respective data read indication signals from the signal output terminals. A data read indication signal is a signal to indicate read of one-pixel image data (pixel value) for the first latch section. When each signal output portion outputs a data read indication signal, it sends a notification to indicate a turn of output of a data read indication signal (hereinafter referred to as carry signal), to the signal output portion located next thereto on the right. When the signal output portion receiving the carry signal detects a rising edge of SCLK, it outputs a data read indication signal to a corresponding signal input terminal of the first latch section 62 from its signal output terminal. The control signal STH is a signal to indicate a start of capture of one-row data. For example, when the control unit 3 (cf. FIG. 1) gives instructions to start output of the data read indication signals from the leftmost signal output portion, it turns STH to a high level and then it keeps STH at a low level in the other durations. When the shift register 61 detects a rising edge of SCLK with STH at the high level, the leftmost signal output portion outputs the data read indication signal from its signal output terminal and sends the carry signal to the second signal output portion from the left. Then the second signal output portion from the left outputs the data read indication signal at the next rising edge of SCLK.

In this manner, the signal output portions successively outputs the data read indication signals. However, the a-th signal output portion from the left is provided with the shift register switch 71. The shift register switch 71 is a changeover switch to switch a receiver of the carry signal from the a-th signal output portion from the left between the (a+b+1)th signal output portion from the left and the (a+1)th signal output portion from the left. Namely, the shift register switch 71 is a switch that selects either of two ways of drives, normal drive or drive without use of the signal output portions in the central region (skip drive). In the present embodiment, according to a skip control signal from the control unit 3, the shift register switch 71 is set to send the carry signal from the a-th signal output portion to the (a+b+1)th signal output portion. Therefore, after the a-th signal output portion from the left outputs the data read indication signal, the (a+b+1)th signal output portion from the left outputs the data read indication signal.

In this configuration, the shift register 61 has the m signal output terminals, among which, while skipping the (a+1)th to the (a+b)th signal output terminals from the left, the other signal output terminals sequentially output the data read indication signals.

The first latch section 62 is provided with m signal input terminals $L_1$ to $L_m$ corresponding to the m signal output terminals of the shift register 61 and with m data output terminals $L'_1$ to $L'_m$. When k represents each value from 1 to m, the k-th signal output terminal from the left in the shift register 61 is connected to the corresponding signal input terminal $L_k$ and the data read indication signal is input to the signal input terminal $L_k$.

When the data read indication signal is input to the signal input terminal $L_k$, the first latch section 62 captures and stores a pixel value of the k-th pixel from the left in image data of one row. Since the shift register 61 outputs the data read indication signals from the respective signal output terminals from the first to the a-th and from the (a+b+1)th to the m-th from the left, the data read indication signals are input to the signal input terminals $L_1$ to $L_a$ and $L_{a+b+1}$ to $L_m$ in the first latch section 62. Then the data (pixel values) of the individual pixels in the one-row image data are taken into the second latch section through the data output terminals $L'_1$ to $L'_a$ and $L'_{a+b+1}$ to $L'_m$ corresponding to the signal input terminals $L_1$ to $L_a$ and $L_{a+b+1}$ to $L_m$.

The second latch section 63 is provided with m data input terminals $Q_1$ to $Q_m$ corresponding to the data output terminals $L'_1$ to $L'_m$ of the first latch section and with m data output terminals $Q'_1$ to $Q'_m$. The second latch section 63 captures the data from the corresponding data output terminals of the first latch section 62 through the first to the a-th data input terminals $Q_1$ to $Q_a$ and the (a+b+1)th to the m-th data input terminals $Q_{a+b+1}$ to $Q_m$ from the left. For example, the second latch section 63 captures the data of the leftmost pixel in one row through the data input terminal $Q_1$ and the data output terminal $L'_1$ of the first latch section. The data is also captured in the same manner through the other data input terminals. As a consequence, the second latch section 63 captures the data of one row (data of n pixels) together from the first latch section 62. The second latch section 63 outputs the captured data from the respective data output terminals $Q'_1$ to $Q'_a$ and $Q'_{a+b+1}$ to $Q'_m$ corresponding to the data input terminals used in the data capture.

The timing for the second latch section 63 to capture the one-row data from the first latch section 62 and output the data is defined by STB. For example, the second latch section 63 reads one-row data and outputs the data from the data output terminals $Q'_1$ to $Q'_a$ and $Q'_{a+b+1}$ to $Q'_m$, at every predetermining timing in a period of STB (e.g., at every falling edge of STB).

The level shifter 64 is provided with m data input terminals $U_1$ to $U_m$ corresponding to the data output terminals $Q'_1$ to $Q'_m$ of the second latch section 63 and with m data output terminals $U'_1$ to $U'_m$. Then the level shifter 64 receives the data output from the second latch section 63 through the first to a-th data input terminals $U_1$ to $U_a$ and the (a+b+1)th to m-th data input terminals $U_{a+b+1}$ to $U_m$ from the left. The level shifter 64 performs a level shift of those data and outputs the data after the level shift from the data output terminals $U'_1$ to $U'_a$ and $U'_{a+b+1}$ to $U'_m$ corresponding to the data input terminals having received the data. For example, when the output data from the second latch section 63 are of a low voltage type (e.g., 3V type), the level shifter 64 level-shifts those data to a high voltage type (for example, 15V type) and then outputs the data after the level shift through the data output terminals.

The D-A converter 65 is provided with m data input terminals $T_1$ to $T_m$ corresponding to the data output terminals $U'_1$ to $U'_m$ of the level shifter and with m potential output terminals $T'_1$ to $T'_m$. Then the D-A converter 65 receives the data output from the level shifter 64, through the first to a-th data input terminals $T_1$ to $T_a$ and the (a+b+1)th to m-th data input terminals $T_{a+b+1}$ to $T_m$ from the left.

The D-A converter 65 converts the data input through the data input terminals to analog voltages and outputs the analog voltages from the potential output terminals $T'_1$ to $T'_a$ and $T'_{a+b+1}$ to $T'_m$ corresponding to the data input terminals having received the data. Therefore, the m data output terminals in the D-A converter 65 are grouped into consecutive potential output terminals from the first to the a-th from the left as viewed from the viewer side (which will be referred to hereinafter as a first output terminal group), consecutive potential output terminals from the (a+1)th to the (a+b)th from the left (which will be referred to hereinafter as a second output terminal group), and consecutive potential output terminals from the (a+b+1)th to the m-th from the left (which will be referred to hereinafter as a third output terminal group). The number of potential output terminals in the first output terminal group is a and the number of potential output terminals in the third output terminal group is c (=m−a−b). As described previously, a+c=n. The D-A converter outputs potentials according to respective pixel values of n pixels in one row from the respective potential output terminals belonging to the first output terminal group and the third output terminal group (i.e., n output terminals). The b potential output terminals belonging to the second output terminal group are not connected to any source line, and the D-A converter 65 keeps each of the outputs of the second output terminal group in the high impedance state. Therefore, the second output terminal group does not contribute to the potential setting of the source lines.

The above described the potential output terminals of the D-A converter 65, but it is also the case as to the data input terminals of the D-A converter 65 and the various input terminals and output terminals of the shift register 61, the first latch section 62, the second latch section 63, and the level shifter 64 that the input/output of the data read indication signals or the data about pixels is implemented through the first to a-th and the (a+b+1)th to m-th input terminals or output terminals from the left. Furthermore, the a-th to (a+b) th terminals from the left do not contribute to the potential setting for the source lines.

The D-A converter 65 receives the respective voltages of $V_0$ to $V_8$ and $V_9$ to $V_{17}$ from the power supply unit 4 (cf. FIG. 1) and generates potentials according to 64 gray levels by voltage division. Then it outputs potentials corresponding to the data after this voltage division, as potentials after analog conversion. Namely, the D-A converter 65 converts each piece of the data output from the second latch section 63 and then level-shifted, to a potential of any one of 64 gray levels and outputs the potential. The example described herein is the case where the gray levels of the image are 64 gray levels, but it should be noted that the levels of voltages input into the D-A converter 65 do not have to be limited to $V_0$ to $V_{17}$ and the gray levels of the image do not have to be limited to 64 gray levels, either. The same also applies to the other embodiments described below.

The D-A converter 65 receives $POL_1$ from the control unit 3 (cf. FIG. 1). The D-A converter 65 switches the output potential of each potential output terminal between a positive potential and a negative potential, depending upon whether $POL_1$ is at the high level or at the low level. Specifically, with $POL_1$ at the high level, the D-A converter 65 makes the output potentials from the odd-numbered potential output terminals $T'_1$, $T'_3$, . . . from the left positive and makes the output potentials from the even-numbered potential output terminals $T'_2$, $T'_4$, . . . from the left negative. Conversely, with $POL_1$ at the low level, the D-A converter 65 makes the output potentials from the odd-numbered potential output terminals $T'_1$, $T'_3$, . . . from the left negative and makes the output potentials from the even-numbered potential output terminals $T'_2$, $T'_4$, . . . from the left positive. However, the D-A converter 65 keeps the second output terminal group $T'_{a+1}$ to $T'_{a+b}$ in the high impedance state, irrespective of the odd-numbered and the even-numbered terminals from the left.

The D-A converter 65 also receives STB and with STB at the high level, the D-A converter 65 keeps the outputs of the respective potential output terminals $T'_1$ to $T'_m$ in the high impedance state. Then, with STB at the low level, the D-A converter 65 outputs the potentials according to the data after the level shift from the first output terminal group and the third output terminal group.

$POL_1$ may be input to the second latch section 63, but the operation of the second latch section 63 is not affected by $POL_1$.

The voltage follower 66 is provided with m potential input terminals $W_1$ to $W_m$ corresponding to the potential output terminals $T'_1$ to $T'_m$ of the D-A converter 65 and with m potential output terminals $D_1$ to $D_m$. The voltage follower 66 outputs potentials equal to the potentials input through the potential input terminals, from the potential output terminals corresponding to the potential input terminals. In the present embodiment, therefore, the potentials from the D-A converter 65 are input to the first to a-th potential input terminals $W_1$ to $W_a$ and the (a+b+1)th to m-th potential input terminals $W_{a+b+1}$ to $W_m$ W from the left in the voltage follower 66 and potentials equal to the input potentials are output from the potential output terminals $D_1$ to $D_a$ and $D_{a+b+1}$ to $D_m$.

The output switching section 67 is provided with m input terminals $I_1$ to $I_m$ corresponding to the potential output terminals $D_1$ to $D_m$ of the voltage follower 66. The first to (a−1)th input terminals $I_1$ to $I_{a-1}$ from the left as viewed from the viewer side are connected in order to the corresponding potential output terminals $D_1$ to $D_{a-1}$ of the voltage follower 66. Similarly, the (a+b+1)th to m-th input terminals $I_{a+b+1}$ to $I_m$ from the left are also connected in order to the corresponding potential output terminals $D_{a+b+1}$ to $D_m$ of the voltage follower 66.

The first changeover switch 72 and the second changeover switch 76 are provided between the voltage follower 66 and the output switching section 67.

The first changeover switch 72 is provided with a first terminal 73, a second terminal 74, and a third terminal 75. The first changeover switch 72 receives $POL_2$, the first terminal 73 and the second terminal 74 are connected with $POL_2$ at the high level, and the first terminal 73 and the third terminal 75 are connected with $POL_2$ at the low level.

The operation of the second changeover switch 76 is the same as that of the first changeover switch 72. Namely, the second changeover switch 76 is provided with a first terminal 77, a second terminal 78, and a third terminal 79. The second changeover switch 76 also receives $POL_2$, the first terminal 77 and the second terminal 78 are connected with $POL_2$ at the high level, and the first terminal 77 and the third terminal 79 are connected with $POL_2$ at the low level.

The first terminal 73 of the first switch 72 is connected to the a-th potential output terminal $D_a$ from the left in the voltage follower and the second terminal 74 of the first switch 72 is connected to the a-th input terminal $I_a$ from the left in the output switching section 67. Furthermore, the first terminal 77 of the second switch 76 is connected to the (a+b)th input terminal $I_{a+b}$ from the left in the output switching section 67 and the second terminal 78 of the second switch 76 is connected to the (a+b)th potential output terminal $D_{a+b}$ from the left in the voltage follower. Furthermore, the third terminal 75 of the first switch 72 is connected to the third terminal 79 of the second switch 76. The number of data output from the output terminals of the output means 66 is n, which is the sum of a and c, and the number of data input to the input terminals of the output switching section 67 is also n.

It is also possible to adopt a configuration without the first switch 72 wherein the data output from the a-th potential output terminal $D_a$ from the left in the voltage follower is supplied to the a-th input terminal $I_a$ from the left in the output switching section 67 and also supplied to the third terminal 79 of the second switch 76. In this configuration, the data supplied to the input terminal $I_a$ is output to the output terminal $O_a$ with $POL_2$ at the high level, whereas with $POL_2$ at the low level, the first terminal 77 and the third terminal 79 of the second switch are connected to output the data from the a-th potential output terminal $D_a$ from the left in the voltage follower to the (a+b)th input terminal $I_{a+b}$ from the left in the output switching section 67. At this time, the number of data output from the output terminals of the output means 66 is n, which is the sum of a and c, and the number of data input through the input terminals of the output switching section 67 is also n.

Furthermore, it is also possible to adopt a configuration with neither of the first switch 72 and the second switch 76. In the case of the configuration with neither of the first switch 72 and the second switch 76, the data output from the a-th potential output terminal $D_a$ from the left in the voltage follower is supplied to the a-th input terminal $I_a$ from the left in the output switching section 67 and also supplied to the (a+b)th input terminal $I_{a+b}$. In this configuration, with $POL_2$ at the high level, the data supplied to the input terminal $I_a$ (data supplied from the potential output terminal $D_a$) is output to the output terminal $O_{a+b+1}$. In this case, the number of data output from the output terminals of the output means 66 is n, which is the sum of a and c. Furthermore, the number of data input through the input terminals of the output switching section 67 is n+1 because the same data is supplied to the input terminals $I_a$ and $I_{a+b}$.

In the configuration of the first embodiment, the first to (a−1)th input terminals $I_1$ to $I_{a-1}$ from the left in the output switching section 67 can be said to be connected through the voltage follower to the first to (a−1)th potential output terminals $T'_1$ to $T'_{a-1}$ from the left in the D-A converter 65. Similarly, the (a+b+1)th to m-th input terminals $I_{a+b+1}$ to $I_m$ from the left in the output switching section 67 can be said to be connected through the voltage follower to the (a+b+1)th to m-th potential output terminals $T'_{a+b+1}$ to $T'_{a-1}$ from the left in the D-A converter 65. Furthermore, the first terminal 73 of the first switch 72 can be said to be connected through the voltage follower to the a-th potential output terminal $T'_a$ from the left in the D-A converter 65.

The output switching section 67 is provided with (m+1) output terminals $O_1$ to $O_{m+1}$ the number of which is by one larger than the number of input terminals $I_1$ to $I_m$. The output terminals of this output switching section 67 correspond to the potential output terminals $O_1$ to $O_{m+1}$ of the driving device 1. The connection between the potential output terminals $O_1$ to $O_{m+1}$ and the source lines was described previously and thus the description thereof is omitted herein. The above described the configuration without the first switch 72 and the second switch 76, in addition to the configuration with the first switch 72 and the second switch 76, but in the case of the driving device enabling switching between normal drive and skip drive, it is preferable to provide the first switch 72 and the second switch 76 because the switching can be readily performed by the switches.

The k-th input terminal $I_k$ from the left in the output switching section 67 is connected to the k-th output terminal $O_k$ from the left or to the (k+1)th output terminal $O_{k+1}$ from the left, out of the output terminals in the output switching section 67. It is noted herein that k is each value from 1 to m. Specifically, $POL_2$ is input to the output switching section 67 and the output switching section 67 connects the input terminal $I_k$ to the output terminal $O_k$ with $POL_2$ at the high level. Furthermore, with $POL_2$ at the low level, the output switching section 67 connects the input terminal $I_k$ to the output terminal $O_{k+1}$.

Figure 9:
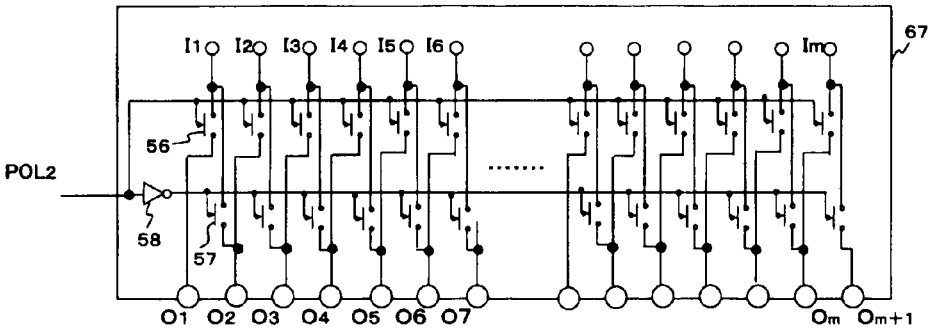
FIG. 9 is an explanatory drawing showing a configuration example of output switching section 67.

FIG. 9 is an explanatory drawing showing a configuration example of the output switching section 67. The output switching section 67 is provided, for example, with a first transistor 56 and a second transistor 57 for each of the individual input terminals $I_k$. The input terminal $I_k$ is connected to a first terminal of the first transistor 56 and a second terminal of the first transistor 56 is connected to the output terminal $O_k$. Similarly, the input terminal $I_k$ is connected to a first terminal of the second transistor 57 and a second terminal of the second transistor 57 is connected to the output terminal $O_{k+1}$. Each of the first transistor 56 and the second transistor 57 is provided with a third terminal, in addition to the first terminal and the second terminal, the first terminal and the second terminal become conductive with input of a high-level signal (voltage) to the third terminal, and the first terminal and the second terminal become nonconductive with input of a low-level signal (voltage) to the third terminal.

$POL_2$ from the control unit 3 (cf. FIG. 1) is input to the third terminal of each first transistor 56. Furthermore, the output switching section 67 is provided with a signal inverting section 58. $POL_2$ from the control unit 3 is input to the signal inverting section 58. The signal inverting section 58 inverts the input $POL_2$ of the high level to the low level and inverts the input $POL_2$ of the low level to the high level. Then the signal inverting section 58 inputs the $POL_2$ after the inversion to the third terminal of each second transistor 57.

Therefore, with $POL_2$ at the high level, $POL_2$ of the high level is input to the third terminal of each first transistor 56 and the low level signal resulting from the inversion of $POL_2$ is input to the third terminal of each second transistor 57. As a result, each input terminal $I_k$ becomes conductive to the output terminal $O_k$ but nonconductive to the output terminal $O_{k+1}$. Therefore, the potential input to the input terminal $I_k$ is output from the output terminal $O_k$.

On the other hand, with $POL_2$ at the low level, $POL_2$ of the low level is input to the third terminal of each first transistor 56 and the high level signal resulting from the inversion of $POL_2$ is input to the third terminal of each second transistor 57. As a result, each input terminal $I_k$ becomes nonconductive to the output terminal $O_k$ but conductive to the output terminal $O_{k+1}$. Therefore, the potential input to the input terminal $I_k$ is output from the output terminal $O_{k+1}$.

Namely, $POL_2$ can also be said to be a control signal that controls to which of the output terminals $O_k$, $O_{k+1}$ the input terminal $I_k$ is to be connected.

As the driving device 1 in the configuration exemplified in FIGS. 7 and 8 is controlled by $POL_1$ and $POL_2$, the driving device 1 can implement the frame-by-frame switching of the potential output mode between the potential output mode in which the output potentials of the odd-numbered potential output terminals from the left are positive potentials and the output potentials of the even-numbered potential output terminals from the left are negative potentials, and the potential output mode in which the output potentials of the odd-numbered potential output terminals from the left are negative potentials and the output potentials of the even-numbered potential output terminals from the left are positive potentials.

The below will describe states of the control signals $POL_1$, $POL_2$ and set potentials for the source lines. FIG. 10 shows an example of changes of STB, $POL_1$, and $POL_2$ output from the control unit 3 to the driving device 1. FIG. 10 shows the control signals in a frame in which $POL_1$ is also high at a change of $POL_2$ to the high level and in which $POL_1$ is also low at a change of $POL_2$ to the low level. This frame will be sometimes referred to hereinafter as frame A1 for convenience' sake.

The control unit 3 makes the first rise of STB in the frame. The control unit 3 also raises $POL_1$ and $POL_2$ in connection with the rise of STB, as control in a select period of the first row (odd row). FIG. 10 shows an example in which $POL_1$ is changed immediately before the rising edge of STB and in which $POL_2$ is changed between the rising edge and falling edge of STB. $POL_2$ is switched in durations in which STB is at the high level, as illustrated in FIG. 10.

In the previous select period, the first latch section 62 successively receives the data read indication signals from the shift register 61 through the signal input terminals $L_1$ to $L_a$ and $L_{a+b+1}$ to $L_m$ to capture and store data of n pixels in one row.

After a change of STB to the high level, the D-A converter 65 (cf. FIG. 7) keeps the outputs of the respective potential output terminals $T'_1$ to $T'_m$ in the high impedance state during a duration of STB at the high level.

With a next change of STB to the low level, the second latch section 63 captures the data of n pixels in one row from the first latch section 62 through the data output terminals $L'_1$ to $L'_a$ and $L'_{a+b+1}$ to $L'_m$ of the first latch section 62 and through the data input terminals $Q_1$ to $Q_a$ and $Q_{a+b+1}$ to $Q_m$ of the second latch section 63. Then it outputs the captured data from the data output terminals $Q'_1$ to $Q'_a$ and $Q'_{a+b+1}$ to $Q'_m$ corresponding to the respective data input terminals.

The data of n pixels in one row output from the second latch section 63 are input to the data input terminals $U_1$ to $U_a$ and $U_{a+b+1}$ to $U_m$ of the level shifter 64. The level shifter 64 performs the level shift of the data and outputs the data after the level shift from the data output terminals $U'_1$ to $U'_a$ and $U'_{a+b+1}$ to $U'_m$ corresponding to the respective data input terminals.

The data of n pixels in one row output from the level shifter 64 are input to the data input terminals $T_1$ to $T_a$ and $T_{a+b+1}$ to $T_m$, of the D-A converter 65. The D-A converter 65 outputs potentials according to the data from the potential output terminals $T'_1$ to $T'_a$ and $T'_{a+b+1}$ to $T'_m$ corresponding to the respective data input terminals. The outputs of the potential output terminals $T'_{a+1}$ to $T'_{a+b}$ of the second output terminal group are kept in the high impedance state.

At this time, $POL_1$ is at the high level. Therefore, the D-A converter 65 outputs positive potentials according to the data from the odd-numbered potential output terminals $T'_1$, $T'_3, \ldots, T'_{a-1}, T'_{a+b+1}, \ldots T'_{m-1}$ from the left. Furthermore, it outputs negative potentials according to the data from the even-numbered potential output terminals $T'_2, T'_4, \ldots, T'_a$, $T'_{a+b+2}, \ldots T'_m$ from the left.

The potential input terminals $W_1$ to $W_a$ and the data input terminals $W_{a+b+1}$ to $W_m$ of the voltage follower 66 receive the respective potentials output from the D-A converter 65. The voltage follower 66 then outputs potentials equal to the input potentials from the potential output terminals $D_1$ to $D_a$ and $D_{a+b+1}$ to $D_m$.

At this time $POL_2$ is at the high level. Therefore, each input terminal $I_k$ of the output switching section 67 is connected to the output terminal $O_k$. The first terminal 73 of the first switch 72 is connected to the second terminal 74 and the first terminal 77 of the second switch 76 is connected to the second terminal 78.

As a result, the respective potentials output from the potential output terminals $T'_1$ to $T'_a$ of the D-A converter 65 are output from the corresponding potential output terminals $D_1$ to $D_a$ of the voltage follower 66 and further output from the respective output terminals $O_1$ to $O_a$ of the output switching section 67. The potentials of the source lines $S_1$ to $S_a$ are thus set. The path from the potential output terminal $D_a$ of the voltage follower 66 to the output terminal $O_a$ of the output switching section 67 is $D_a$→first terminal 73→second terminal 74→$I_a$→$O_a$.

The respective potentials output from the potential output terminals $T'_{a+b+1}$ to $T'_m$ of the D-A converter 65 are output from the corresponding potential output terminals $D_{a+b+1}$ to $D_m$ of the voltage follower 66 and further output from the respective output terminals $O_{a+b+1}$ to $O_m$ of the output switching section 67. As a result, the potentials of the source lines $S_{a+1}$ to $S_n$ are set.

Accordingly, the potentials of the n source lines $S_1$ to $S_n$ are set and the potentials of the n pixel electrodes in the first row become equal to the potentials of the left source lines as viewed from the viewer side.

No potential is output from the output terminal $O_{m+1}$ of the output switching section 67, with the result that no potential is set for the source line $S_{n+1}$ which is not used for setting of the potentials of the pixel electrodes in selection of the odd rows.

The path from the potential output terminal $D_{a+b}$ of the voltage follower 66 to the output terminal $O_{a+b}$ of the output switching section 67 is $D_{a+b}$→second terminal 78→first terminal 77→$I_{a+b}$→$O_{a+b}$, and the output terminal $O_{a+b}$ is kept in the high impedance state. However, the output terminal $O_{a+b}$ is not connected to any source line, so that the output of the output terminal $O_{a+b}$ does not affect the display of the LCD panel.

Since the D-A converter 65 outputs positive potentials from the odd-numbered potential output terminals from the left and outputs negative potentials from the even-numbered potential output terminals from the left, the polarities of the n pixels in the first row are positive, negative, positive, negative, . . . from the left.

During the select period of the first row, the first latch section 62 reads data of one row in accordance with instructions from the shift register 61.

Subsequently, the control unit 3 changes $POL_1$ to the low level, raises STB, and changes $POL_2$ to the low level in a duration in which STB is at the high level (cf. FIG. 10).

The operation up to the input of data into the D-A converter 65 with a change of STB to the low level is the same as that in the select period of the first row. The D-A converter 65 outputs potentials according to the data input through the data input terminals $T_1$ to $T_a$ and $T_{a+b+1}$ to $T_m$, from the potential output terminals $T'_1$ to $T'_a$ and $T'_{a+b+1}$ to $T'_m$. As described previously, the outputs of the second output terminal group are kept in the high impedance state.

However, $POL_1$ is at the low level herein. Therefore, the D-A converter 65 outputs negative potentials according to the data from the odd-numbered potential output terminals $T'_1$, $T'_3, \ldots, T'_{a-1}, T'_{a+b+1}, \ldots T'_{m-1}$ from the left. Furthermore, it outputs positive potentials according to the data from the even-numbered potential output terminals $T'_2, T'_4, \ldots, T'_a$, $T'_{a+b+2}, \ldots T'_m$ from the left.

The operation of the voltage follower 66 is the same as in the selection of the first row.

At this time, $POL_2$ is at the low level. Therefore, each input terminal $I_k$ of the output switching section 67 is connected to the output terminal $O_{k+1}$. The first terminal 73 of the first switch 72 is connected to the third terminal 75 and the first terminal 77 of the second switch 76 is connected to the third terminal 79. Accordingly, the output potential from the potential output terminal $D_a$ of the voltage follower 66 is input to the input terminal $I_{a+b}$ of the output switching section 67 through the first terminal 73 and the third output terminal 75 of the first switch 72 and through the third output terminal 79 and the first output terminal 77 of the second switch 76. Furthermore, the potential is output from the output terminal $O_{a+b+1}$ connected to $I_{a+b}$.

As a result, the respective potentials output from the potential output terminals $T'_1$ to $T'_a$ of the D-A converter 65 are output from the corresponding potential output terminals $D_1$ to $D_a$ of the voltage follower 66 and further from the respective output terminals $O_2$ to $O_a$ and $O_{a+b+1}$ of the output switching section 67. The potentials of the source lines $S_2$ to $S_{a+1}$ are thus set.

The respective potentials output from the potential output terminals $T'_{a+b+1}$ to $T'_m$ of the D-A converter 65 are output from the corresponding potential output terminals $D_{a+b+1}$ to $D_m$ of the voltage follower 66 and further from the respective output terminals $O_{a+b+2}$ to $O_{m+1}$ of the output switching section 67. As a result, the potentials of the source lines $S_{a+2}$ to $S_{n+1}$ are set.

Accordingly, the potentials of the n source lines $S_2$ to $S_{n+1}$ are set, so that the potentials of the n pixel electrodes in the second row become equal to the potentials of the right source lines as viewed from the viewer side.

No potential is output from the output terminal $O_1$ of the output switching section 67, with the result that no potential is set for the source line $S_1$ which is not used for setting of the potentials of the pixel electrodes in selection of the even rows.

Since the D-A converter 65 outputs positive potentials from the even-numbered potential output terminals from the left and negative potentials from the odd-numbered potential output terminals from the left, the polarities of the n pixels in the second row are negative, positive, negative, positive, . . . from the left.

Thereafter, the operations in the select periods of the first row and the second row described above are repeatedly carried out in this frame A1. Therefore, the polarities of the respective pixels in this frame A1 become as shown in FIG. 11. In FIG. 11, below-described FIG. 13, and others, "+" represents the positive polarity and "−" the negative polarity.

FIG. 12 shows an example of changes of STB, $POL_1$, and $POL_2$. FIG. 12 shows the control signals in a frame in which $POL_1$ is at the low level with a change of $POL_2$ to the high level and in which $POL_1$ is at the high level with a change of $POL_2$ to the low level. This frame will be sometimes referred to hereinafter as frame B1 for convenience' sake.

The control unit 3 makes the first rise of STB in the frame. In this frame, the control unit 3 makes a fall of $POL_1$ to the low level and a rise of $POL_2$ to the high level in connection with the rise of STB, as control in the select period of the first row (odd row). As FIG. 10 shows, FIG. 12 shows an example in which $POL_1$ is changed immediately before a rising edge of STB and in which $POL_2$ is changed between the rising edge and falling edge of STB.

The operation up to the input of data into the D-A converter 65 with a change of STB to the low level is the same as the operation in the frame A1. The D-A converter 65 outputs potentials according to the data input to the data input terminals $T_1$ to $T_a$ and $T_{a+b+1}$ to $T_m$, from the potential output terminals $T'_1$ to $T'_a$ and $T'_{a+b+1}$ to $T'_m$. As described previously, the outputs of the second output terminal group are kept in the high impedance state.

$POL_1$ is at the low level herein. Therefore, the D-A converter 65 outputs negative potentials according to the data from the odd-numbered potential output terminals $T'_1$, $T'_3, \ldots, T'_{a-1}, T'_{a+b+1}, \ldots T'_{m-1}$ from the left. Furthermore, it outputs positive potentials according to the data from the even-numbered potential output terminals $T'_2, T'_4, \ldots, T'_a$, $T'_{a+b+2}, \ldots T'_m$ from the left.

The operation of the voltage follower 66 is the same as the operation in the frame A1.

At this time $POL_2$ is at the high level. Therefore, each input terminal $I_k$ of the output switching section 67 is connected to the output terminal $O_k$. The first terminal 73 of the first switch 72 is connected to the second terminal 74 and the first terminal 77 of the second switch 76 is connected to the second terminal 78.

This state of the output switching section 67, the first switch 72, and the second switch 76 is the same as that in selection of the odd rows in the frame A1.

Therefore, the respective potentials output from the potential output terminals $T'_1$ to $T'_a$ of the D-A converter 65 are output from the corresponding potential output terminals $D_1$ to $D_a$ of the voltage follower 66 and further from the respective output terminals $O_1$ to $O_a$ of the output switching section 67. The potentials of the source lines $S_1$ to $S_a$ are thus set.

The respective potentials output from the potential output terminals $T'_{a+b+1}$ to $T'_m$ of the D-A converter 65 are output from the corresponding potential output terminals $D_{a+b+1}$ to $D_m$ of the voltage follower 66 and further from the respective output terminals $O_{a+b+1}$ to $O_m$ of the output switching section 67. As a result, the potentials of the source lines $S_{a+1}$ to $S_n$ are set.

Accordingly, the potentials of the n source lines $S_1$ to $S_n$ are set, so that the potentials of the n pixel electrodes in the first row become equal to the potentials of the left source lines as viewed from the viewer side.

However, since the D-A converter 65 outputs the negative potentials from the odd-numbered potential output terminals from the left and the positive potentials from the even-numbered potential output terminals from the left, the polarities of the n pixels in the first row are negative, positive, negative, positive, . . . from the left. During the select period of the first row, the first latch section 62 reads data of one row in accordance with instructions from the shift register 61.

Subsequently, the control unit 3 changes $POL_1$ to the high level, raises STB, and then changes $POL_2$ to the low level in a duration in which STB is at the high level (cf. FIG. 12).

The operation up to the input of data into the D-A converter 65 with a change of STB to the low level is the same as that in the select period of the first row. The D-A converter 65 outputs potentials according to the data input to the data input terminals $T_1$ to $T_a$ and $T_{a+b+1}$ to $T_m$, from the potential output terminals $T'_1$ to $T'_a$ and $T'_{a+b+1}$ to $T'_m$. The outputs of the second output terminal group are kept in the high impedance state.

However, $POL_1$ is at the high level herein. Therefore, the D-A converter 65 outputs positive potentials according to the data from the odd-numbered potential output terminals $T'_1$, $T'_3, \ldots, T'_{a-1}, T'_{a+b+1}, \ldots T'_{m-1}$ from the left. Furthermore, it outputs negative potentials according to the data from the even-numbered potential output terminals $T'_2, T'_4, \ldots, T'_a$, $T'_{a+b+2}, \ldots T'_m$ from the left.

The operation of the voltage follower 66 is the same as in the selection of the first row.

At this time, $POL_2$ is at the low level. Therefore, each input terminal $I_k$ of the output switching section 67 is connected to the output terminal $O_{k+1}$. The first terminal 73 of the first switch 72 is connected to the third terminal 75 and the first terminal 77 of the second switch 76 is connected to the third terminal 79. Therefore, the output potential from the potential output terminal $D_a$ of the voltage follower 66 is input to the input terminal $I_{a+b}$ of the output switching section 67 through the first terminal 73 and the third output terminal 75 of the first switch 72 and through the third output terminal 79 and the first output terminal 77 of the second switch 76. Furthermore, it is output from the output terminal $O_{a+b+1}$ connected to $I_{a+b}$.

This state of the output switching section 67, the first switch 72, and the second switch 76 is the same as the state in selection of the even rows in the frame A1.

Therefore, the respective potentials output from the potential output terminals $T'_1$ to $T'_a$ of the D-A converter 65 are output from the corresponding potential output terminals $D_1$ to $D_a$ of the voltage follower 66 and further from the respective output terminals $O_2$ to $O_a$ and $O_{a+b+1}$ of the output switching section 67. The potentials of the source lines $S_2$ to $S_{a+1}$ are thus set.

The respective potentials output from the potential output terminals $T'_{a+b+1}$ to $T'_m$ of the D-A converter 65 are output from the corresponding potential output terminals $D_{a+b+1}$ to $D_m$ of the voltage follower 66 and further from the respective output terminals $O_{a+b+2}$ to $O_{m+1}$ of the output switching section 67. As a result, the potentials of the source lines $S_{a+2}$ to $S_{n+1}$ are set.

Therefore, the potentials of the n source lines $S_2$ to $S_{n+1}$ are set, so that the potentials of the n pixel electrodes in the second row become equal to the potentials of the right source lines as viewed from the viewer side.

However, since the D-A converter 65 outputs negative potentials from the even-numbered potential output terminals from the left and outputs positive potentials from the odd-numbered potential output terminals from the left, the polarities of the n pixels in the second row are positive, negative, positive, negative, . . . from the left.

Thereafter, the operations in the select periods of the first row and the second row described above are repeatedly carried out in this frame B1. Therefore, the polarities of the respective pixels in this frame B1 become as shown in FIG. 13.

Figures 13, 14:
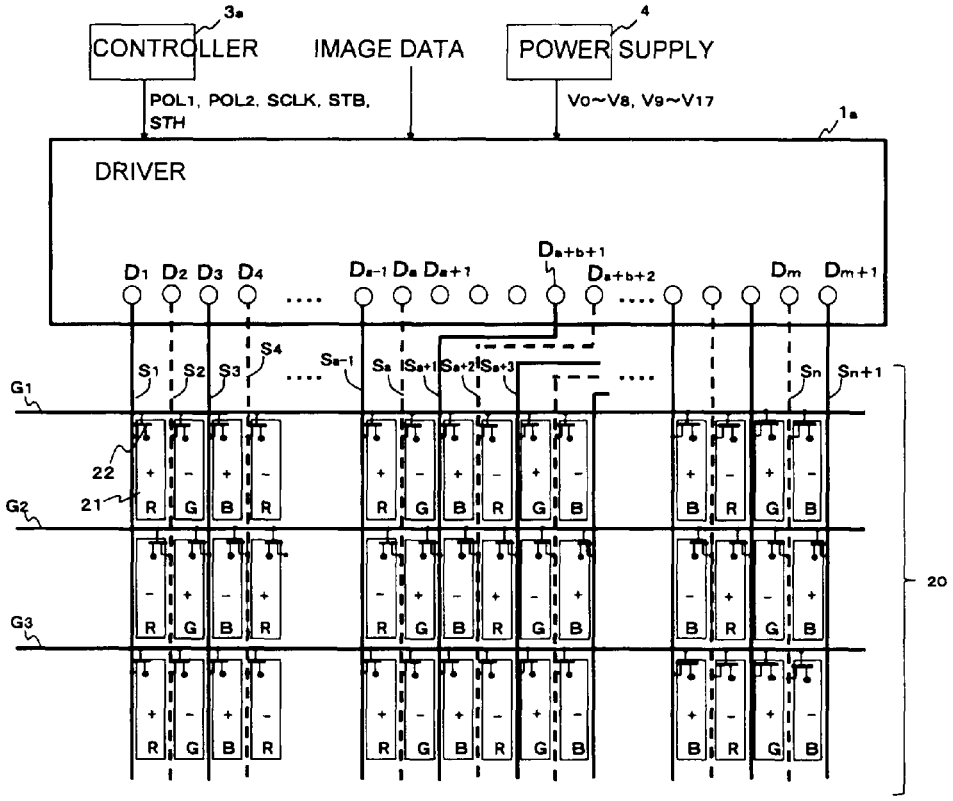
FIG. 13 is an explanatory drawing showing an example of polarities of respective pixels.
FIG. 14 is an explanatory drawing showing an example of the driving device in the second embodiment.

As shown in FIGS. 11 and 13, the polarities of adjacent pixels in each frame are opposite to each other. The control unit 3 and driving device 1 alternately perform the operation in the frame A1 and the operation in the frame B1 on a frame-by-frame basis. Therefore, the polarities vary frame by frame even in each identical pixel (cf. FIGS. 11 and 13). Accordingly, it is feasible to prevent occurrence of crosstalk.

In each frame the potentials of each source line are not varied across $V_{COM}$. Therefore, power consumption is reduced.

In the operation of driving the LCD panel 20 wherein the number of source lines is by one larger than the number of columns of the pixel electrodes, wherein the columns of pixel electrodes are arranged between the source lines, wherein the potentials of the pixel electrodes are set by the source lines on the predetermined side (the left side in the above example) of the columns of pixel electrodes in selection of the odd rows, and wherein the potentials of the pixel electrodes are set by the source lines on the opposite side to the predetermined side of the columns of pixel electrodes in selection of the even rows, according to the present invention, the LCD panel 20 can be driven without connecting the potential output terminals (second output terminal group) in the central region out of the plurality of potential output terminals of the driving device, to any source line.

The first embodiment showed the configuration wherein the output switching section 67, the first switch 72, and the second switch 76 were arranged in the subsequent stage to the voltage follower 66. The output switching section 67, first switch 72, and second switch 76 may be arranged between the D-A converter 65 and the voltage follower 66. A connection configuration for directly connecting the output switching section 67, first switch 72, and second switch 76 to the D-A converter 65 is the same as in the case where they are connected to the voltage follower 66 (cf. FIG. 8). In this case, the voltage follower may be equipped with (m+1) potential input terminals and potential output terminals. The potential input terminals of the voltage follower may be connected to the output terminals $O_1$ to $O_{m+1}$ of the output switching section 67. A connection configuration for connecting the potential output terminals of the voltage follower to the respective source lines is the same as in the case where the output terminals of the output switching section 67 are connected directly to the source lines.

In a case where the LCD panel 20 is driven by a plurality of driving devices, the closest potential output terminals in adjacent driving devices may be connected to an identical source line. Specifically, when two driving devices are juxtaposed, the potential output terminal $O_{m+1}$ in the left driving device and the potential output terminal $O_1$ in the right driving device may be connected to a common source line.

The above showed the example in which the driving device 1 (specifically, the first latch section 62) serially captured the pixel values, but the driving device may be configured to capture pixel values of R, G, and B in parallel at each rising edge of SCLK.

The LCD panel 20 may be one for monochrome display. This also applies to each of the other embodiments.

[Embodiment 2]

FIG. 14 is an explanatory drawing showing an example of the driving device in the second embodiment of the present invention. The same elements as in the first embodiment will be denoted by the same reference signs as in FIG. 1, without detailed description thereof. The power supply unit 4 and the LCD panel 20 are the same as in the first embodiment.

The control unit $\mathbf{3}_a$ outputs various control signals $POL_1$, $POL_2$, SCLK, STB, and STH, which are similar to those from the control unit 3 (cf. FIG. 1) in the first embodiment, to the driving device $\mathbf{1}_a$. However, an output mode of $POL_1$ is different from that in the first embodiment. In the first embodiment the level of $POL_1$ was switched at every period of STB, whereas in the second embodiment the control unit $\mathbf{3}_a$ alternately changes the level of $POL_1$ between the high level and the low level on a frame-by-frame basis. The output modes of the control signals ($POL_2$, STB, SCLK, STH, etc.) other than $POL_1$ are the same as those in the first embodiment.

In the present embodiment the potential output terminals of the driving device $\mathbf{1}_a$ are the potential output terminals of the voltage follower (not shown in FIG. 14; cf. FIG. 15), and thus are denoted by $D_1$ to $D_{m+1}$. The connection between the potential output terminals $D_1$ to $D_{m+1}$ of the driving device $\mathbf{1}_a$ and the respective source lines $S_1$ to $S_{n+1}$ is the same as the connection between the potential output terminals of the driving device 1 and the source lines in the first embodiment. Namely, the first to a-th potential output terminals $D_1$ to $D_a$ from the left the number of which is a are connected in order to the source lines $S_1$ to $S_a$, respectively. The (c+1) potential output terminals $D_{a+b+1}$ to $D_{m+1}$ from the (a+b+1)th to the (m+1) th from the left are connected in order to the source lines $S_{a+1}$ to $S_{n+1}$, respectively. The potential output terminals $D_{a+1}$ to $D_{a+b}$ are not connected to any source line.

With $POL_2$ at the high level, the driving device $\mathbf{1}_a$ outputs potentials according to pixel values from the n potential output terminals except for $D_{m+1}$, out of the potential output terminals $D_1$ to $D_a$ and $D_{a+b+1}$ to $D_{m+1}$, and keeps the output state of $D_{m+1}$ in a high impedance state. With $POL_2$ at the low level, the driving device $\mathbf{1}_a$ outputs potentials according to pixel values from the n potential output terminals except for $D_1$, out of the potential output terminals $D_1$ to $D_a$ and $D_{a+b+1}$ to $D_{m+1}$, and keeps the output state of $D_1$ in a high impedance state.

With $POL_1$ at the high level, the driving device $\mathbf{1}_a$ outputs positive potentials according to pixel values from the odd-numbered potential output terminals and outputs negative potentials according to pixel values from the even-numbered potential output terminals. With $POL_1$ at the low level, the driving device $\mathbf{1}_a$ outputs negative potentials according to pixel values from the odd-numbered potential output terminals and outputs positive potentials according to pixel values from the even-numbered potential output terminals. However, concerning the potential output terminals $D_1$, $D_{m+1}$, as described above, either of them is kept in the high impedance state according to the level of $POL_2$. The potential output terminals $D_{a+1}$ to $D_{a+b}$ are always maintained in a high impedance state.

Figure 15:
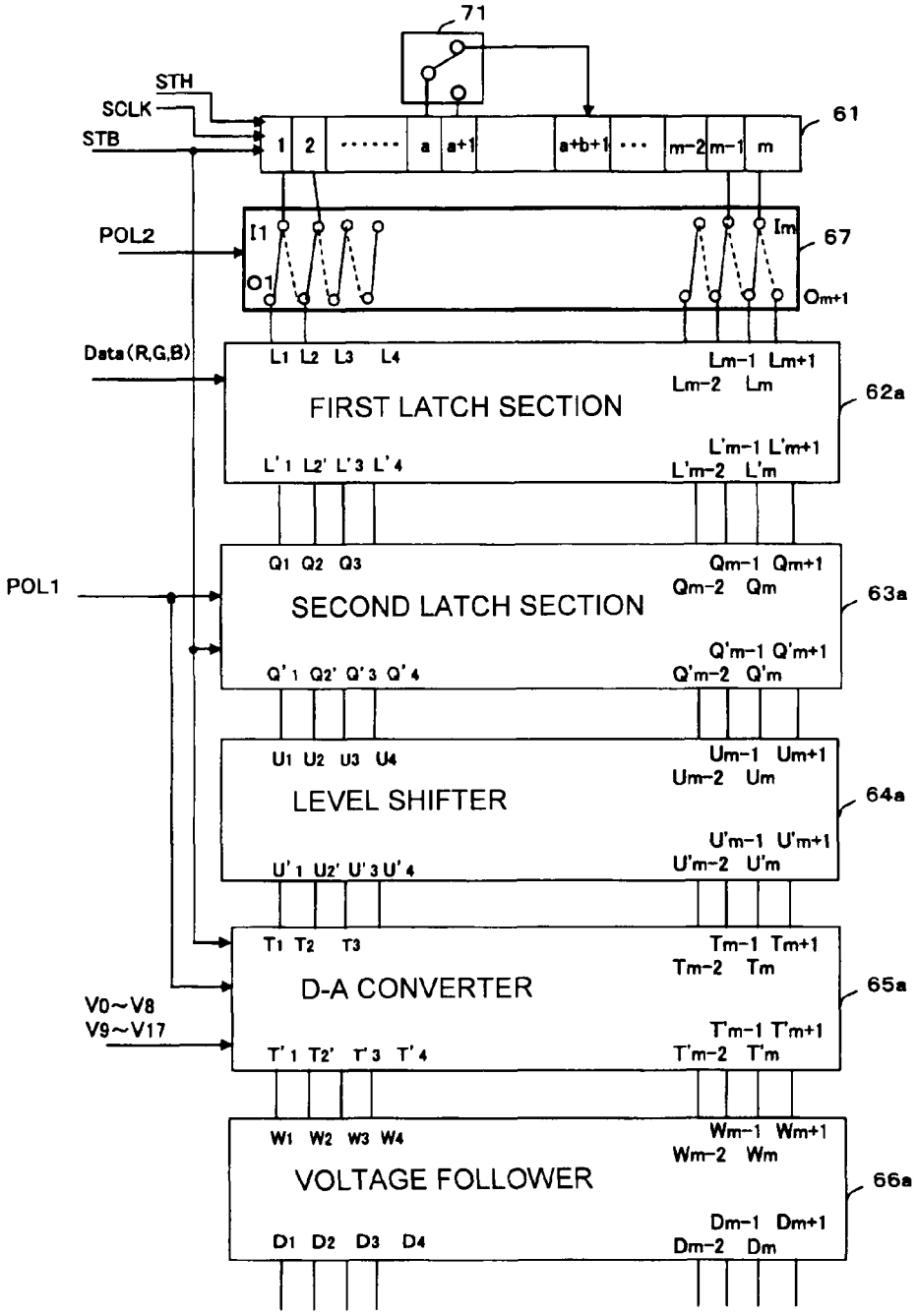
FIG. 15 is an explanatory drawing showing a configuration example of the driving device $\mathbf{1}_a$ in the second embodiment.
Figure 16:
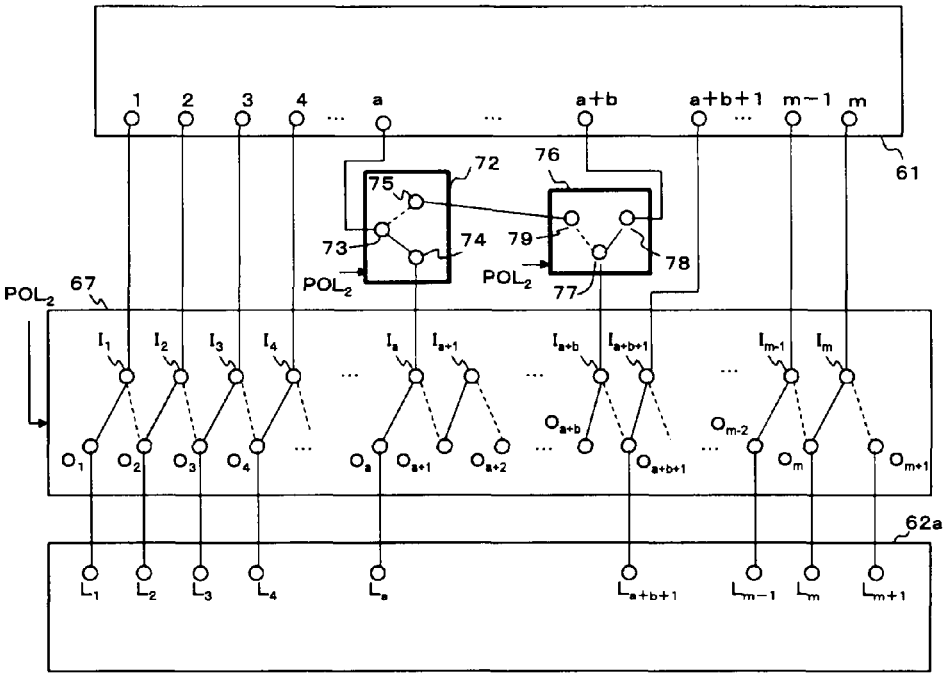
FIG. 16 is an explanatory drawing showing a configuration example of the driving device $\mathbf{1}_a$ in the second embodiment.

FIGS. 15 and 16 are explanatory drawings showing a configuration example of the driving device $\mathbf{1}_a$ in the second embodiment. The same constituent elements as in the first embodiment will be denoted by the same reference signs as in FIGS. 7 and 8, without detailed description thereof. The driving device $\mathbf{1}_a$ is provided with a shift register 61, an output switching section 67, a first changeover switch 72 and a second changeover switch 76 (which are not shown in FIG. 15; cf. FIG. 16), a first latch section $\mathbf{62}_a$, a second latch section $\mathbf{63}_a$, a level shifter $\mathbf{64}_a$, a D-A converter $\mathbf{65}_a$, and a voltage follower $\mathbf{66}_a$. The shift register 61 is provided with a shift register switch 71.

The shift register 61 and the shift register switch 71 are the same as those in the first embodiment. The shift register switch 71 is set so as to send the carry signal of the a-th signal output portion from the left to the (a+b+1)th signal output portion from the left. Namely, the shift register switch 71 is a switch that selects either of the two ways of drives, the normal drive and the skip drive without use of the central region. In the present embodiment, according to a skip control signal from the control unit 3, each signal output portion from the leftmost signal output portion to the a-th signal output portion outputs the data read indication signal in order in the shift register 61 and, after output of the data read indication signal from the a-th signal output portion from the left, each signal output portion from the (a+b+1)th to the (m+1)th from the left outputs the data read indication signal in order.

In the present embodiment, the respective signal output terminals of the consecutive signal output portions from the first to the a-th from the left will be referred to as a first output terminal group. Furthermore, the respective signal output terminals of the consecutive signal output portions from the (a+1)th to the (a+b)th from the left will be referred to as a second output terminal group. The respective signal output terminals of the consecutive signal output portions from the (a+b+1)th to the m-th from the left will be referred to as a third output terminal group. Since the second output terminal group outputs no data read indication signal, it does not contribute to the potential setting of the source lines. The number of signal output terminals belonging to the first output terminal group is a, the number of signal output terminals belonging to the second output terminal group is b, and the number of signal output terminals belonging to the third output terminal group is c. When the number of pixels in one row (or the number of pixel electrodes 21 in one row) in the LCD panel 20 is assumed to be n, n=a+c.

In the present embodiment, as shown in FIG. 16, the output switching section 67, the first switch 72, and the second switch 76 are disposed in the subsequent stage to the shift register 61. The connection configuration of the output switching section 67, the first switch 72 and the second switch 76 to the shift register 61 is the same as the connection configuration of the output switching section 67, the first switch 72 and the second switch 76 to the voltage follower 66 in the first embodiment.

Namely, the first to (a−1)th input terminals $I_1$ to $I_{a-1}$ from the left in the output switching section 67 are connected in order to the respective signal output terminals from the first to the (a−1)th from the left in the shift register 61. The (a+b+1)th to m-th input terminals $I_{a+b+1}$ to $I_m$ from the left are also connected in order to the respective signal output terminals from the (a+b+1)th to the m-th from the left in the shift register 61.

The first terminal 73 of the first switch 72 is connected to the a-th signal output terminal from the left in the shift register 61, and the second terminal 74 of the first switch 72 is connected to the a-th input terminal $I_a$ from the left in the output switching section 67. The first terminal 77 of the second switch 76 is connected to the (a+b)th input terminal $I_{a+b}$ from the left in the output switching section 67, and the second terminal 78 of the second switch 76 is connected to the (a+b) th signal output terminal from the left in the shift register 61. The third terminal 75 of the first switch 72 is connected to the third terminal 79 of the second switch 76.

The operations of the output switching section 67, the first switch 72, and the second switch 76 according to the levels of $POL_2$ are the same as in the first embodiment.

The first latch section $\mathbf{62}_a$ is provided with (m+1) signal input terminals $L_1$ to $L_{m+1}$ corresponding to the (m+1) output terminals of the output switching section 67 and with (m+1) data output terminals $L'_1$ to $L'_{m+1}$. When k is defined as each value from 1 to m+1, the k-th output terminal from the left in the output switching section 67 is connected to the corresponding signal input terminal $L_k$.

The first latch section $\mathbf{62}_a$, when receiving the data read indication signal through the signal input terminal $L_k$, captures and stores a pixel value of the k-th pixel from the left in image data of one row.

With $POL_2$ at the high level, the data read indication signals are input through the signal input terminals $L_1$ to $L_a$ and $L_{a+b+1}$ to $L_m$. As a result, the data (pixel values) of the respective pixels in one row stored by the first latch section $\mathbf{62}_a$ are taken into the second latch section through the data output terminals $L'_1$ to $L'_a$ and $L'_{a+b+1}$ to $L'_m$ corresponding to those signal input terminals. On the other hand, with $POL_2$ at the low level, the data read indication signals are input through the signal input terminals $L_2$ to $L_a$ and $L_{a+b+1}$ to $L_{m+1}$. As a result, the data of the respective pixels in one row stored by the first latch section $\mathbf{62}_a$ are taken into the second latch section $\mathbf{63}_a$ through the data output terminals $L'_2$ to $L'_a$ and $L'_{a+b+1}$ to $L'_{m+1}$ corresponding to those signal input terminals.

The second latch section $\mathbf{63}_a$ is provided with (m+1) data input terminals $Q_1$ to $Q_{m+1}$ corresponding to the data output terminals $L'_1$ to $L'_{m+1}$ in the first latch section and with (m+1) data output terminals $Q'_1$ to $Q'_{m+1}$. Then the second latch section $\mathbf{63}_a$ captures the data output from the corresponding data output terminals of the first latch section $\mathbf{62}_a$, through the first to a-th data input terminals $Q_1$ to $Q_a$ and the (a+b+1)th to (m+1)th data input terminals $Q_{a+b+1}$ to $Q_{m+1}$ from the left. As a result, the second latch section $\mathbf{63}_a$ captures the data of one row (data of n pixels) together from the first latch section $\mathbf{62}_a$. The second latch section $\mathbf{63}_a$ outputs the captured data from the respective output terminals $Q'_1$ to $Q'_a$ and $Q'_{a+b+1}$ to $Q'_{m+1}$ corresponding to the data input terminals used in the data capture.

However, since there is no data captured through the data input terminal $Q_{m+1}$ with $POL_2$ at the high level, the data of one row are output from the data output terminals $Q'_1$ to $Q'_a$ and $Q'_{a+b+1}$ to $Q'_m$. Since there is no data captured through the data input terminal $Q_1$ with $POL_2$ at the low level, the data of one row are output from the data output terminals $Q'_2$ to $Q'_a$ and $Q'_{a+b+1}$ to $Q'_{m+1}$.

The timing of capturing the one-row data from the first latch section $\mathbf{62}_a$ and outputting the data by the second latch section $\mathbf{63}_a$ is the same as in the first embodiment.

The level shifter $\mathbf{64}_a$ is provided with (m+1) data input terminals $U_1$ to $U_{m+1}$ corresponding to the data output terminals $Q'_1$ to $Q'_{m+1}$ of the second latch section $\mathbf{63}_a$ and with (m+1) data output terminals $U'_1$ to $U'_{m+1}$. When the level shifter $\mathbf{64}_a$ receives the data of pixels of one row through the data input terminals, it performs the level shift of the data and outputs the level-shifted data from the data output terminals corresponding to the data input terminals. For example, with $POL_2$ at the high level, the data of one row are input to the data input terminals $U_1$ to $U_a$ and $U_{a+b+1}$ to $U_m$ and the data after the level shift are output from the data output terminals $U'_1$ to $U'_a$ and $U'_{a+b+1}$ to $U'_m$. With $POL_2$ at the low level, the data of one row are input to the data input terminals $U_2$ to $U_a$ and $U_{a+b+1}$ to $U_{m+1}$ and the data after the level shift are output from the data output terminals $U'_2$ to $U'_a$ and $U'_{a+b+1}$ to $U'_{m+1}$.

The D-A converter $\mathbf{65}_a$ is provided with (m+1) data input terminals $T_1$ to $T_{m+1}$ corresponding to the data output terminals $U'_1$ to $U'_{1+}1$ of the level shifter and with (m+1) potential output terminals $T'_1$ to $T'_{m+1}$. When the D-A converter $\mathbf{65}_a$ receives the data of pixels in one row (the data after the level shift) through the data input terminals, it converts the data to analog voltages according to the data and outputs the analog voltages from the potential output terminals corresponding to the data input terminals. For example, with $POL_2$ at the high level, the D-A converter $\mathbf{65}_a$ receives the data of one row through the data input terminals $T_1$ to $T_a$ and $T_{a+b+1}$ to $T_m$ and outputs potentials according to the data of pixels in one row from the potential output terminals $T'_1$ to $T'_a$ and $T'_{a+b+1}$ to $T'_m$. With $POL_2$ at the low level, the D-A converter $\mathbf{65}_a$ receives the data of one row through the data input terminals $T_2$ to $T_a$ and $T_{a+b+1}$ to $T_{m+1}$ and outputs potentials according to the data of pixels in one row from the potential output terminals $U'_2$ to $U'_a$ and $U'_{a+b+1}$ to $U'_{m+1}$.

The D-A converter $\mathbf{65}_a$ performs the voltage division of the voltages input from the power supply unit 4 as the D-A converter 65 in the first embodiment does. Then the D-A converter $\mathbf{65}_a$ outputs potentials corresponding to the data after this voltage division, as potentials after analog conversion.

The D-A converter $\mathbf{65}_a$ switches an output potential of each potential output terminal between a positive potential and a negative potential, depending upon whether $POL_1$ is either at the high level or at the low level. With $POL_1$ at the high level, the D-A converter $\mathbf{65}_a$ outputs positive potentials as output potentials from the odd-numbered potential output terminals $T'_1$, $T'_3$, . . . from the left and negative potentials as output potentials from the even-numbered potential output terminals $T'_2$, $T'_4$, . . . from the left. Conversely, with $POL_1$ at the low level, the D-A converter $\mathbf{65}_a$ outputs negative potentials as output potentials from the odd-numbered potential output terminals $T'_1$, $T'_3$, . . . from the left and positive potentials as output potentials from the even-numbered potential output terminals $T'_2$, $T'_4$, . . . from the left. However, the potential output terminals corresponding to the data input terminals without input of data are kept in a high impedance state. For example, with $POL_2$ at the high level, the potential output terminal $T'_{m+1}$ is kept in the high impedance state and with $POL_2$ at the low level, the potential output terminal $T'_1$ is kept in the high impedance state. Since no data is input to the data input terminals $T'_{a+1}$ to $T'_{a+b}$, the potential output terminals $T'_{a+1}$ to $T'_{a+1}$, are kept in the high impedance state.

The D-A converter $\mathbf{65}_a$ also receives STB and with STB at the high level, the D-A converter $\mathbf{65}_a$ keeps the outputs of the respective potential output terminals $T'_1$ to $T'_{m+1}$ in a high impedance state. After STB is changed to the low level and data is input, the D-A converter outputs potentials according to the data.

The voltage follower $\mathbf{66}_a$ is provided with (m+1) potential input terminals $W_1$ to $W_{m+1}$ corresponding to the potential output terminals $T'_1$ to $T'_{m+1}$ of the D-A converter $\mathbf{65}_a$ and with (m+1) potential output terminals $D_1$ to $D_{m+1}$. The voltage follower $\mathbf{66}_a$ outputs potentials equal to the potentials input through the respective potential input terminals, from the potential output terminals corresponding to the potential input terminals. The potential output terminals $D_1$ to $D_{m+1}$ of the voltage follower $\mathbf{66}_a$ correspond to the potential output terminals $D_1$ to $D_{m+1}$ of the driving device $\mathbf{1}_a$ (cf. FIG. 14).

Figure 17:
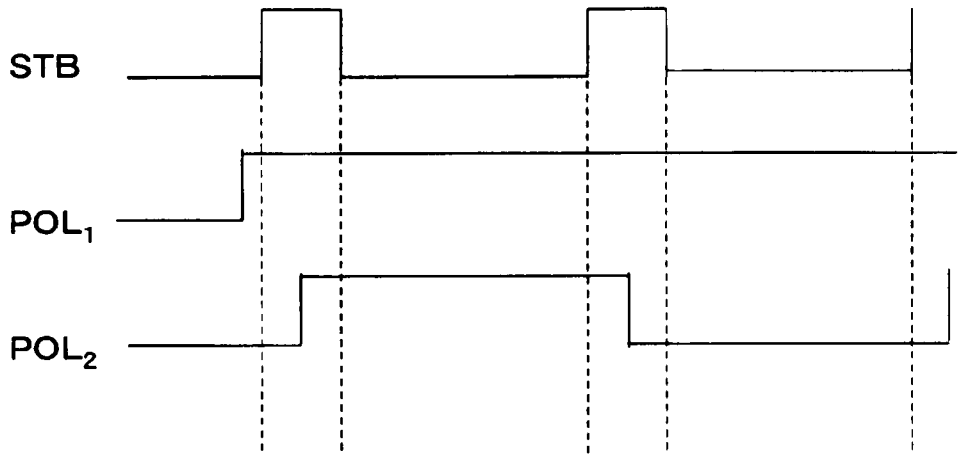
FIG. 17 is an explanatory drawing showing an example of changes of STB, $POL_1$, and $POL_2$.

The below will describe states of the control signals $POL_1$, $POL_2$ and set potentials for the source lines. FIG. 17 shows an example of changes of STB, $POL_1$ and $POL_2$ output from the control unit $\mathbf{3}_a$ to the driving device $\mathbf{1}_a$. FIG. 17 shows the control signals in a frame in which $POL_1$ is at the high level. This frame will be sometimes referred to hereinafter as frame A2 for convenience' sake.

The control unit $\mathbf{3}_a$ makes the first rise of STB in the frame. The control unit $\mathbf{3}_a$ also raises $POL_1$ and $POL_2$ to the high level in connection with the rise of STB, as control in the select period of the first row. FIG. 17 shows the example in which $POL_1$ is changed immediately before the rising edge of STB and in which $POL_2$ is changed between the rising edge and falling edge of STB. In the frame A2, thereafter, $POL_1$ is maintained at the high level. $POL_2$ is alternately changed between the low level and the high level at every period of STB.

During a duration in which $POL_2$ is at the high level, each input terminal $I_k$ of the output switching section 67 is connected to the output terminal $O_k$. The first terminal 73 of the first switch 72 is connected to the second terminal 74 and the first terminal 77 of the second switch 76 is connected to the second terminal 78. Therefore, the data read indication signals sequentially output from the first to a-th signal output terminals from the left and from the (a+b+1)th to m-th signal output terminals from the left in the shift register 61 are input to the signal input terminals $L_1$ to $L_a$ and $L_{a+b+1}$ to $L_m$ of the first latch section $\mathbf{62}_a$. The first latch section $\mathbf{62}_a$ reads data of one pixel at every input of the data read indication signal and stores data of respective pixels in one row.

The second latch section $\mathbf{63}_a$ reads the data of pixels in one row stored in the first latch section $\mathbf{62}_a$ in the next select period and then the second latch section $\mathbf{63}_a$ outputs the data. Specifically, STB turns to the high level upon a changeover of select period and, with a further changeover thereof to the low level, the second latch section $\mathbf{63}_a$ reads the data of one row. At this time, the second latch section $\mathbf{63}_a$ captures n pieces of data of one row from the first latch section $\mathbf{62}_a$, through the data output terminals $L'_1$ to $L'_a$ and $L'_{a+b+1}$ to $L'_m$ corresponding to the signal input terminals of the first latch section $\mathbf{62}_a$ having received the data read indication signals and through the data input terminals $Q_1$ to $Q_a$ and $Q_{a+b+1}$ to $Q_m$ of the second latch section $\mathbf{63}_a$. Then the second latch section $\mathbf{63}_a$ outputs the captured data from the data output terminals $Q'_1$ to $Q'_a$ and $Q'_{a+b+1}$ to $Q'_m$ corresponding to the respective data input terminals.

Then the data of n pixels in one row output from the second latch section $\mathbf{63}_a$ are input to the data input terminals $U_1$ to $U_a$ and $U_{a+b+1}$ to $U_m$ of the level shifter $\mathbf{64}_a$. The level shifter $\mathbf{64}_a$ performs the level shift of the data and outputs the data after the level shift from the data output terminals $U'_1$ to $U'_a$ and $U'_{a+b+1}$ to $U'_m$ corresponding to the respective data input terminals.

Then the data of n pixels in one row output from the level shifter $\mathbf{64}_a$ are input to the data input terminals $T_1$ to $T_a$ and $T_{a+b+1}$ to $T_m$ of the D-A converter $\mathbf{65}_a$. The D-A converter $\mathbf{65}_a$ outputs potentials according to the data from the potential output terminals $T'_1$ to $T'_a$ and $T'_{a+b+1}$ to $T'_m$ corresponding to the respective data input terminals.

At this time, $POL_1$ is at the high level. Therefore, the D-A converter $\mathbf{65}_a$ outputs positive potentials according to the data from the odd-numbered potential output terminals $T'_1$, $T'_3$, . . . , $T'_{a-1}$, $T'_{a+b+1}$, . . . $T'_{m-1}$ from the left. Furthermore, it outputs negative potentials according to the data from the even-numbered potential output terminals $T'_2$, $T'_4$, . . . , $T'_{a+b+2}$, . . . $T'_m$ from the left.

The potentials output from the D-A converter $\mathbf{65}_a$ are input to the potential input terminals $W_1$ to $W_a$ and data input terminals $W_{a+b+1}$ to $W_m$ of the voltage follower $\mathbf{66}_a$. Then the voltage follower $\mathbf{66}_a$ outputs potentials equal to the input potentials from the potential output terminals $D_1$ to $D_a$ and $D_{a+b+1}$ to $D_m$.

As a result, the potentials of the n source lines $S_1$ to $S_n$ are set, so that the potentials of the n pixel electrodes in the selected row become equal to the potentials of the left source lines as viewed from the viewer side. At this time, the odd-numbered source lines from the left have positive potentials and the even-numbered source lines from the left negative potentials. Therefore, the polarities of the pixels in the selected row are positive, negative, positive, negative, . . . from the left. At this time, the source line $S_{n+1}$ connected to the potential output terminal $D_{m+1}$ in the high impedance state is not used for the potential setting of the pixel electrodes.

The above description showed the case where the potentials were set for the respective source lines, based on the data captured by the first latch section with $POL_2$ at the high level. The below shows the case where potentials are set for the respective source lines, based on data captured by the first latch section with $POL_2$ at the low level.

During a duration in which $POL_2$ is at the low level, each input terminal $I_k$ of the output switching section 67 is connected to the output terminal $O_{k+1}$. The first terminal 73 of the first switch 72 is connected to the third terminal 75 and the first terminal 77 of the second switch 76 is connected to the third terminal 79. Therefore, the data read indication signals sequentially output from the first to a-th signal output terminals from the left and from the (a+b+1)th to m-th signal output terminals from the left in the shift register 61 are input to the signal input terminals $L_2$ to $L_a$ and $L_{a+b+1}$ to $L_{m+1}$ of the first latch section $\mathbf{62}_a$. The first latch section $\mathbf{62}_a$ reads data of one pixel at every input of the data read indication signal and stores data of respective pixels in one row.

The second latch section $\mathbf{63}_a$ reads the data of respective pixels in one row stored in the first latch section $\mathbf{62}_a$ in the next select period and the second latch section $\mathbf{63}_a$ outputs the data. Specifically, after STB turns to the high level and further to the low level upon a changeover of select period, the second latch section $\mathbf{63}_a$ reads the data of one row. At this time, the second latch section $\mathbf{63}_a$ captures n pieces of data of one row from the first latch section $\mathbf{62}_a$ through the data output terminals $L'_2$ to $L'_a$ and $L'_{a+b+1}$ to $L'_{m+1}$ corresponding to the signal input terminals of the first latch section $\mathbf{62}_a$ having received the data read indication signals and through the data input terminals $Q_2$ to $Q_a$ and $Q_{a+b+1}$ to $Q_{m+1}$ of the second latch section $\mathbf{63}_a$. Then it outputs the captured data from the data output terminals $Q'_2$ to $Q'_a$ and $Q'_{a+b+1}$ to $Q'_{m+1}$ corresponding to the respective data input terminals.

Then the data of n pixels in one row output from the second latch section $\mathbf{63}_a$ are input to the data input terminals $U_2$ to $U_a$ and $U_{a+b+1}$ to $U_{m+1}$ of the level shifter $\mathbf{64}_a$. The level shifter $\mathbf{64}_a$ performs the level shift of the data and outputs the data after the level shift from the data output terminals $U'_2$ to $U'_{a+1}$ and $U'_{a+b+1}$ to $U'_{m+1}$ corresponding to the respective data input terminals.

Then the data of n pixels in one row output from the level shifter $\mathbf{64}_a$ are input to the data input terminals $T_2$ to $T_a$ and $T_{a+b+1}$ to $T_{m+1}$ of the D-A converter $\mathbf{65}_a$. The D-A converter $\mathbf{65}_a$ outputs potentials according to the data from the potential output terminals $T'_2$ to $T'_a$ and $T_{a+b+1}$ to $T'_{m+1}$ corresponding to the respective data input terminals.

At this time, $POL_1$ is at the high level. Therefore, the D-A converter $\mathbf{65}_a$ outputs negative potentials according to the data from the even-numbered potential output terminals $T'_2$, $T'_4$, . . . , $T'_a$, $T'_{a+b+2}$, . . . $T'_m$ from the left. Furthermore, it outputs positive potentials according to the data from the odd-numbered potential output terminals $T'_3$, $T'_5$, . . . , $T'_{a-1}$, $T'_{a+b+1}$, . . . $T'_{m+1}$ from the left.

The respective potentials output from the D-A converter $\mathbf{65}_a$ are input to the potential input terminals $W_2$ to $W_a$ and the data input terminals $W_{a+b+1}$ to $W_{m+1}$ of the voltage follower $\mathbf{66}_a$. Then the voltage follower $\mathbf{66}_a$ outputs the potentials equal to the input potentials from the potential output terminals $D_2$ to $D_a$ and $D_{a+b+1}$ to $D_{m+1}$.

As a consequence, the potentials of the n source lines $S_2$ to $S_{n+1}$ are set, so that the potentials of the n pixel electrodes in the selected row become equal to the potentials of the right source lines as viewed from the viewer side. At this time, the even-numbered source lines from the left have negative potentials and the odd-numbered source lines from the left positive potentials. As a result, the polarities of the pixels in the selected row are negative, positive, negative, positive, . . . from the left. At this time, the source line $S_1$ connected to the potential output terminal $D_1$ in the high impedance state is not used for the potential setting of the pixel electrodes.

In the frame A2, $POL_2$ is switched at every period of STB and therefore the polarities of adjacent pixels become opposite to each other.

Figure 18:
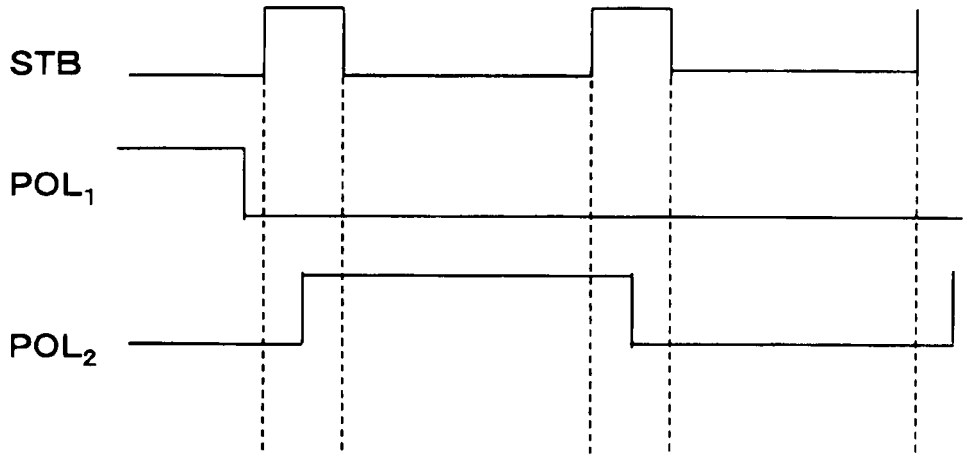
FIG. 18 is an explanatory drawing showing an example of changes of STB, $POL_1$, and $POL_2$.

FIG. 18 shows an example of changes of STB, $POL_1$, and $POL_2$ output from the control unit $\mathbf{3}_a$ to the driving device $\mathbf{1}_a$. FIG. 18 shows the control signals in a frame in which $POL_1$ is at the low level. This frame will be sometimes referred to hereinafter as frame B2 for convenience' sake.

In the frame B2, when the control unit $\mathbf{3}_a$ makes the first rise of STB, $POL_1$ is changed to the low level in conjunction with the rise of STB. Furthermore, $POL_2$ is changed to the high level. In the frame B2, thereafter, $POL_1$ is maintained at the low level. $POL_2$ is alternately changed between the low level and the high level at every period of STB.

The operation of transferring the data captured by the first latch section $\mathbf{62}_a$, to the D-A converter $\mathbf{65}_a$ during a high-level duration of $POL_2$ is the same as in the case of the frame A2. The data of n pixels in one row output from the level shifter $\mathbf{64}_a$ are input to the data input terminals $T_1$ to $T_a$ and $T_{a+b+1}$ to $T_m$ of the D-A converter $\mathbf{65}_a$. The D-A converter $\mathbf{65}_a$ outputs potentials according to the data from the potential output terminals $T'_1$ to $T'_a$ and $T'_{a+b+1}$ to $T'_m$ corresponding to the respective data input terminals.

At this time, however, $POL_1$ is at the low level. Therefore, the D-A converter $\mathbf{65}_a$ outputs negative potentials according to the data from the odd-numbered potential output terminals $T'_1$, $T'_3$, . . . , $T'_{a-1}$, $T'_{a+b+1}$, . . . $T'_{m-1}$ from the left. Furthermore, it outputs positive potentials according to the data from the even-numbered potential output terminals $T'_2$, $T'_4$, . . . , $T'_a$, $T'_{a+b+2}$, . . . $T'_m$ from the left.

As a consequence, the potentials of the n source lines $S_1$ to $S_n$ are set through the voltage follower $\mathbf{66}_a$ and the potentials of the n pixel electrodes in the selected row become equal to the potentials of the left source lines as viewed from the viewer side. At this time, the odd-numbered source lines from the left have negative potentials and the even-numbered source lines from the left positive potentials. Therefore, the polarities of the pixels in the selected row are negative, positive, negative, positive, . . . from the left. At this time, the source line $S_{n+1}$ connected to the potential output terminal $D_{m+1}$ in the high impedance state is not used for the potential setting of the pixel electrodes.

The operation of transferring the data captured by the first latch section $\mathbf{62}_a$, to the D-A converter $\mathbf{65}_a$ during a low-level duration of $POL_2$ is the same as in the case of the frame A2. The data of n pixels in one row output from the level shifter $\mathbf{64}_a$ are input to the data input terminals $T_2$ to $T_a$ and $T_{a+b+1}$ to $T_{m+1}$ of the D-A converter $\mathbf{65}_a$. The D-A converter $\mathbf{65}_a$ outputs potentials according to the data from the potential output terminals $T'_2$ to $T'_a$ and $T'_{a+b+1}$ to $T'_{m+1}$ corresponding to the respective data input terminals.

However, $POL_1$ is at the low level. Therefore, the D-A converter $\mathbf{65}_a$ outputs positive potentials according to the data from the even-numbered potential output terminals $T'_2$, $T'_4$, . . . , $T'_a$, $T'_{a+b+2}$, . . . $T'_m$ from the left. Furthermore, it outputs negative potentials according to the data from the odd-numbered potential output terminals $T'_3$, $T'_5$, . . . , $T'_{a-1}$, $T'_{a+b+1}$, . . . $T'_{m+1}$ from the left.

As a consequence, the potentials of the n source lines $S_2$ to $S_{n+1}$ are set through the voltage follower $\mathbf{66}_a$ and the potentials of the n pixel electrodes in the selected row become equal to the potentials of the right source lines as viewed from the viewer side. At this time, the even-numbered source lines from the left have positive potentials and the odd-numbered source lines from the left negative potentials. As a result, the polarities of the pixels in the selected row are positive, negative, positive, negative, . . . from the left. At this time, the source line $S_1$ connected to the potential output terminal $D_1$ in the high impedance state is not used for the potential setting of the pixel electrodes.

Since $POL_2$ is also switched at every period of STB in the frame B2, the polarities of adjacent pixels become opposite to each other. Since the driving device $\mathbf{1}_a$ alternately performs the operation in the frame A2 and the operation in the frame B2, the polarity of the same pixel is inverted frame by frame. Therefore, it is feasible to prevent occurrence of crosstalk.

In either of the frames A2, B2, the potentials of each source line are not varied across $V_{COM}$ by the operation as described above. Therefore, power consumption is reduced.

In the second embodiment, the LCD panel 20 can be driven without connecting the potential output terminals in the central region ($D_{a+1}$ to $D_{a+b}$ in the above example) out of the plurality of potential output terminals of the driving device to any source line.

As described in the first embodiment, when the LCD panel 20 is driven by a plurality of driving devices, the closest potential output terminals in adjacent driving devices may be connected to an identical source line. Namely, when two driving devices are juxtaposed, the potential output terminal $D_{m+1}$ in the left driving device and the potential output terminal $D_1$ in the right driving device may be connected to a common source line. This also applies to each of the other embodiments.

[Embodiment 3]

The third embodiment of the present invention can be illustrated as in FIG. 14. Namely, the driving device $\mathbf{1}_a$ receives supply of voltages from the power supply unit 4 and drives the LCD panel 20 under control of the control unit $\mathbf{3}_a$. The power supply unit 4 and the LCD panel 20 are the same as those in the first and second embodiments.

The control unit $\mathbf{3}_a$ is the same as that in the second embodiment. Namely, the control unit $\mathbf{3}_a$ alternately changes the level of $POL_1$ between the high level and the low level on a frame-by-frame basis. The output modes of the control signals ($POL_2$, STB, SCLK, STH, etc.) except for $POL_1$ are the same as in the first and second embodiments.

The connection configuration between the driving device $\mathbf{1}_a$ and the source lines $S_1$ to $S_{n+1}$ is the same as in the second embodiment. Namely, the first to a-th potential output terminals $D_1$ to $D_a$ from the left the number of which is a are connected in order to the source lines $S_1$ to $S_a$, respectively. The (c+1) potential output terminals $D_{a+b+1}$ to $D_{m+1}$ from the (a+b+1)th to (m+1)th from the left are connected in order to the source lines $S_{a+1}$ to $S_{n+1}$, respectively. The potential output terminals $D_{a+1}$ to $D_{a+b}$ are not connected to any source line.

The operation of the driving device $\mathbf{1}_a$ is the same as in the second embodiment. Namely, with $POL_2$ at the high level, potentials according to pixel values are output from the n potential output terminals except for $D_{m+1}$, out of the potential output terminals $D_1$ to $D_a$ and $D_{a+b++1}$ to $D_{m+1}$, and the output state of $D_{m+1}$ is kept in the high impedance state. With $POL_2$ at the low level, potentials according to pixel values are output from the n potential output terminals except for $D_1$, out of the potential output terminals $D_1$ to $D_a$ and $D_{a+b+1}$ to $D_{m+1}$, and the output state of $D_1$ is kept in the high impedance state.

With $POL_1$ at the high level, the driving device $\mathbf{1}_a$ outputs positive potentials according to pixel values from the odd-numbered potential output terminals and outputs negative potentials according to pixel values from the even-numbered potential output terminals. With $POL_1$ at the low level, the driving device $\mathbf{1}_a$ outputs negative potentials according to pixel values from the odd-numbered potential output terminals and outputs positive potentials according to pixel values from the even-numbered potential output terminals. However, either of the potential output terminals $D_1$, $D_{m+1}$ is brought into the high impedance state, depending upon the level of $POL_2$ as described above. The potential output terminals $D_{a+1}$ to $D_{a+b}$ are always maintained in the high impedance state.

Figure 19:
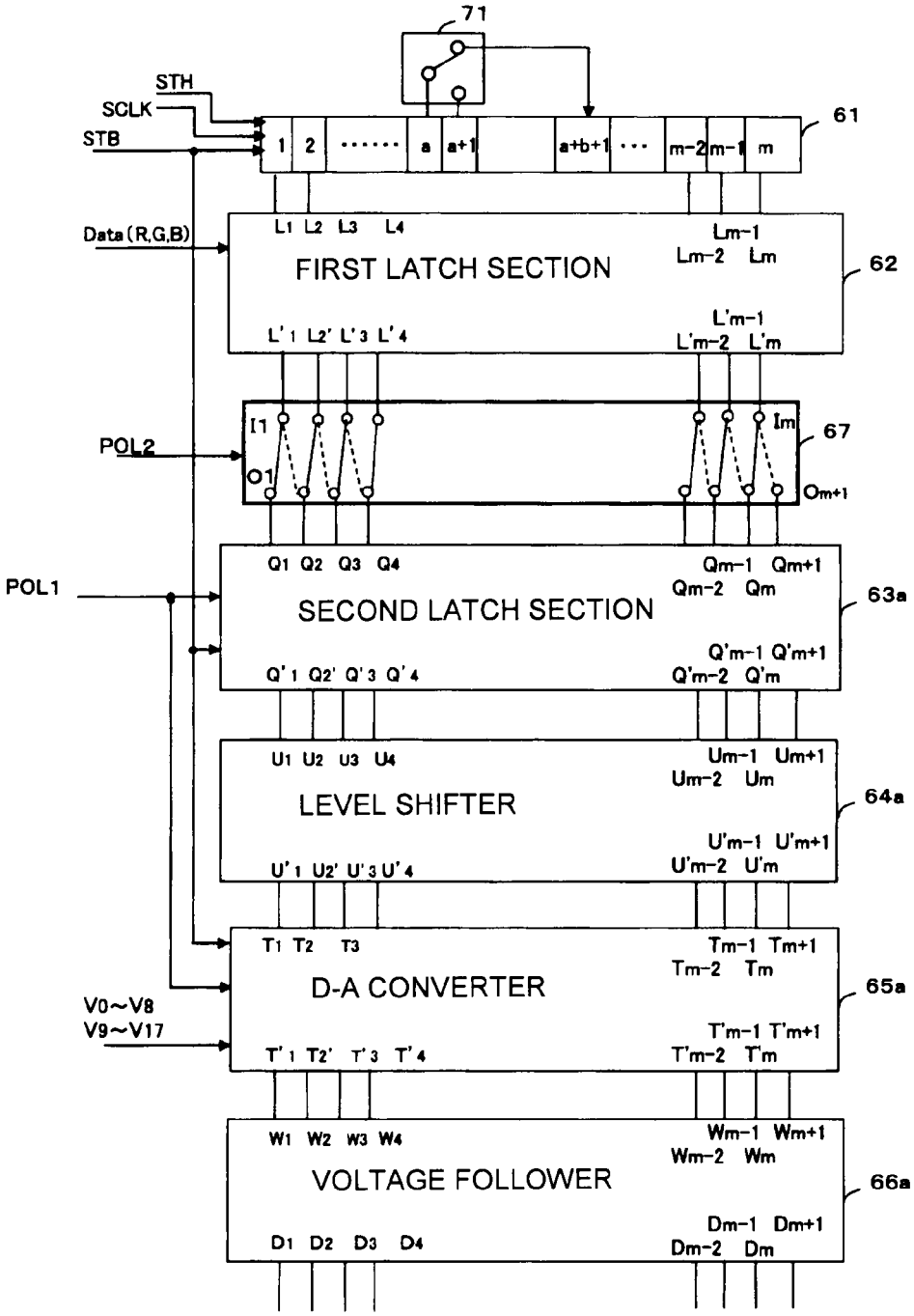
FIG. 19 is an explanatory drawing showing a configuration example of the driving device $\mathbf{1}_a$ in the third embodiment.
Figure 20:
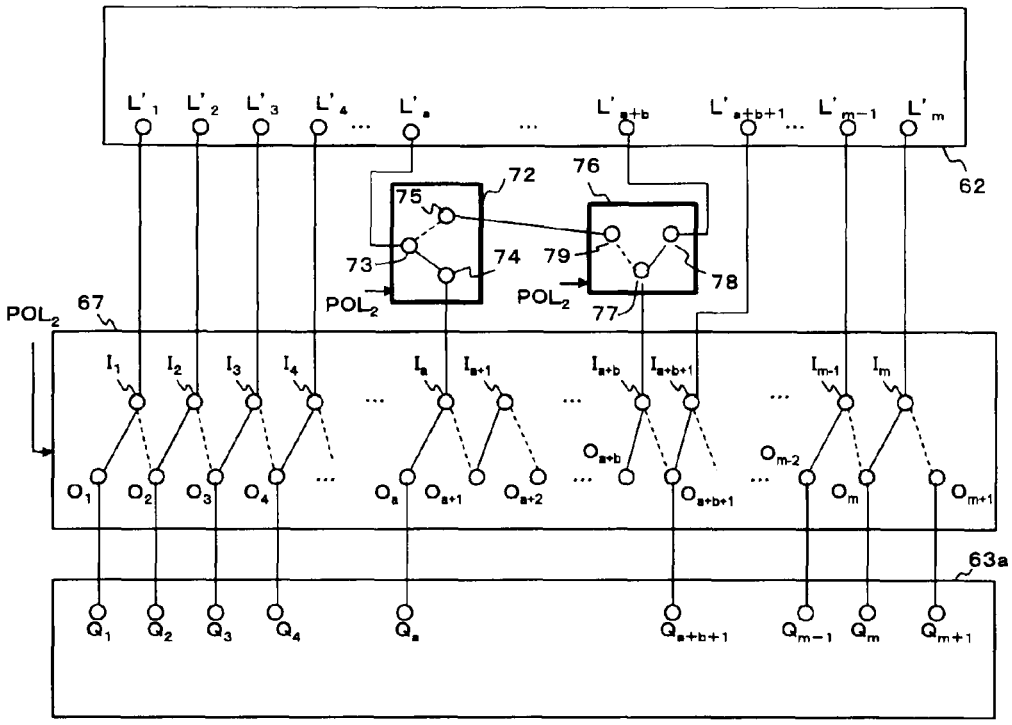
FIG. 20 is an explanatory drawing showing a configuration example of the driving device $\mathbf{1}_a$ in the third embodiment.

However, the configuration of the driving device $\mathbf{1}_a$ is different from that in the second embodiment. FIGS. 19 and 20 are explanatory drawings showing a configuration example of the driving device $\mathbf{1}_a$ in the third embodiment. The same constituent elements as in the first embodiment will be denoted by the same reference signs as those in FIGS. 7 and 8. Furthermore, the same constituent elements as in the second embodiment will be denoted by the same reference signs as those in FIGS. 15 and 16.

The driving device $\mathbf{1}_a$ in the third embodiment is provided with a shift register 61, a first latch section 62, an output switching section 67, a first changeover switch 72 and a second changeover switch 76 (which are not shown in FIG. 19; cf. FIG. 20), a second latch section $\mathbf{63}_a$, a level shifter $\mathbf{64}_a$, a D-A converter $\mathbf{65}_a$, and a voltage follower $\mathbf{66}_a$. The shift register 61 is provided with a shift register switch 71.

The shift register 61 and the shift register switch 71 are the same as those in the first and second embodiments and thus the description thereof is omitted herein. The shift register switch 71 is set so as to send the carry signal of the a-th signal output portion from the left to the (a+b+1)th signal output portion from the left.

The first latch section 62 is also the same as that in the first embodiment and thus the detailed description thereof is omitted herein. In the third embodiment, the consecutive data output terminals $L'_1$ to $L'_a$ from the first to the a-th from the left in the first latch section 62 will be referred to as a first output terminal group. Furthermore, the consecutive data output terminals $L'_{a+1}$ to $L'_{a+b}$ from the (a+1)th to the (a+b)th from the left will be referred to as a second output terminal group. The consecutive data output terminals $L'_{a+b+1}$ to $L'_m$ from the (a+b+1)th to the m-th from the left will be referred to as a third output terminal group. Since no data read indication signal is input to the signal input terminals $L_{a+1}$ to $L_{a+b}$ of the first latch section 62, the second output terminal group outputs no data and thus does not contribute to the potential setting for the source lines. The number of data output terminals belonging to the first output terminal group is a, the number of data output terminals belonging to the second output terminal group is b, and the number of data output terminals belonging to the third output terminal group is c. When the number of pixels in one row (or the number of pixel electrodes 21 in one row) in the LCD panel 20 is assumed to be n, n=a+c.

In the present embodiment, as shown in FIG. 20, the output switching section 67, the first switch 72, and the second switch 76 are provided in the subsequent stage to the first latch section 62. The connection configuration of the output switching section 67, the first switch 72, and the second switch 76 to the first latch section 62 is the same as that of the output switching section 67, the first switch 72, and the second switch 76 to the voltage follower 66 in the first embodiment.

Namely, the first to (a−1)th input terminals $I_1$ to $I_{a-1}$ from the left in the output switching section 67 are connected in order to the first to (a−1)th data output terminals $L'_1$ to $L'_{a-1}$ from the left in the first latch section 62. Furthermore, the (a+b+1)th to m-th input terminals $I_{a+b+1}$ to $I_m$ from the left are also connected in order to the (a+b+1)th to m-th data output terminals $L'_{a+b+1}$ to $L'_m$ from the left in the first latch section 62.

The first terminal 73 of the first switch 72 is connected to the a-th data output terminal $L'_a$ from the left in the first latch section 62 and the second terminal 74 of the first switch 72 is connected to the a-th input terminal $I_a$ from the left in the output switching section 67. The first terminal 77 of the second switch 76 is connected to the (a+b)th input terminal $I_{a+b}$ from the left in the output switching section 67 and the second terminal 78 of the second switch 76 is connected to the (a+b)th data output terminal $L'_{a+b}$ from the left in the first latch section 62. The third terminal 75 of the first switch 72 is connected to the third terminal 79 of the second switch 76.

The operations of the output switching section 67, the first switch 72, and the second switch 76 according to the levels of $POL_2$ are the same as in the first embodiment.

The second latch section $\mathbf{63}_a$ is the same as in the second embodiment. The second latch section $\mathbf{63}_a$ is provided with (m+1) data input terminals $Q_1$ to $Q_{m+1}$ corresponding to the output terminals $O_1$ to $O_{m+1}$ of the output switching section 67 and with (m+1) data output terminals $Q'_1$ to $Q'_{m+1}$. The second latch section $\mathbf{63}_a$ captures data through n data input terminals corresponding to n output terminals of the output switching section 67 becoming connected to the n data output terminals $L'_1$ to $L'_a$ and $L'_{a+b+1}$ to $L'_m$ of the first latch section 62, out of the first to a-th data input terminals $Q_1$ to $Q_a$ and the (a+b+1)th to (m+1)th data input terminals $Q_{a+b+1}$ to $Q_{m+1}$ from the left. As a result, the second latch section $\mathbf{63}_a$ captures data of one row (data of n pixels) together from the first latch section 62. The second latch section $\mathbf{63}_a$ outputs the captured data from the respective data output terminals corresponding to the data input terminals used in the data capture.

With $POL_2$ at the high level, the input terminal $I_k$ of the output switching section 67 is connected to the output terminal $O_k$. Furthermore, the first terminal 73 of the first switch 72 is connected to the second terminal 74. Therefore, the data output terminals $L'_1$ to $L'_a$ of the first latch section 62 become connected to the output terminals $O_1$ to $O_a$ of the output switching section 67. Similarly, the data output terminals $L'_{a+b+1}$ to $L'_m$ of the first latch section 62 become connected to the output terminals $O_{a+b+1}$ to $O_m$ of the output switching section 67. Therefore, the second latch section $\mathbf{63}_a$ captures data of one pixel, for example, through the data output terminal $L'_1$ of the first latch section 62, the input terminal $I_1$, the output terminal $O_1$, and the data input terminal $Q_1$ of the second latch section $\mathbf{63}_a$. It also captures data in the same manner at the other data input terminals $Q_2$ to $Q_a$ and $Q_{a+b+1}$ to $Q_m$. However, at the a-th data input terminal $Q_a$ from the left, data is taken in through the data output terminal $L'_a$ of the first latch section 62, the first terminal 73 and the second terminal 74 of the first switch 72, the input terminal $I_a$, the output terminal $O_a$, and the data input terminal $Q_a$ of the second latch section $\mathbf{63}_a$.

At this time, the second latch section $\mathbf{63}_a$ outputs the captured data from the data output terminals $Q'_1$ to $Q'_a$ and $Q'_{a+b+1}$ to $Q'_m$.

With $POL_2$ at the low level, the input terminal $I_k$ of the output switching section 67 is connected to the output terminal $O_{k+1}$. Then the first terminal 73 of the first switch 72 is connected to the third terminal 75 and the first terminal 77 of the second switch 76 is connected to the third terminal 79. Therefore, the data output terminals $L'_1$ to $L'_{a-1}$ of the first latch section 62 become connected to the output terminals $O_2$ to $O_a$ of the output switching section 67. The data output terminal $L_a$ becomes connected to the output terminal $O_{a+b+1}$ through the first terminal 73 and the third terminal 75 of the first switch 72, the third terminal 79 and the first terminal 77 of the second switch 76, and the input terminal $I_{a+b}$ of the output switching section 67. The data output terminals $L'_{a+b+1}$ to $L'_m$ of the first latch section 62 become connected to the output terminals $O_{a+b+2}$ to $O_{m+1}$ of the output switching section 67. As a result, the second latch section $\mathbf{63}_a$ captures data of one pixel, for example, through the data output terminal $L'_1$ of the first latch section 62, the input terminal $I_1$, the output terminal $O_2$, and the data input terminal $Q_2$ of the second latch section $\mathbf{63}_a$. Data is taken in the same manner at the other data input terminals $Q_3$ to $Q_a$ and $Q_{a+b+1}$ to $Q_{m+1}$. At the data input terminal $Q_{a+b+1}$, however, data is taken in through the data output terminal $L'_a$, the first terminal 73 and the third terminal 75 of the first switch 72, the third terminal 79 and the first terminal 77 of the second switch 76, the input terminal $I_{a+b}$ of the output switching section 67, and the output terminal $O_{a+b+1}$, as described above.

At this time, the second latch section $\mathbf{63}_a$ outputs the captured data from the data output terminals $Q'_2$ to $Q'_a$ and $Q'_{a+b+1}$ to $Q'_{m+1}$.

Therefore, the data output from the second latch section $\mathbf{63}_a$ with $POL_2$ at the high level and the data output from the second latch section $\mathbf{63}_a$ with $POL_2$ at the low level both are the same as in the second embodiment.

Furthermore, the level shifter $\mathbf{64}_a$, the D-A converter $\mathbf{65}_a$, and the voltage follower $\mathbf{66}_a$ are the same as those in the second embodiment and the description thereof is omitted herein.

The below will describe states of the control signals $POL_1$, $POL_2$ and set potentials for the source lines. The output modes of $POL_1$, $POL_2$, and STB in the present embodiment are the same as in the second embodiment (cf. FIGS. 17 and 18).

The frame A2 in which $POL_1$ is at the high level will be described with reference to FIG. 17. The control unit $\mathbf{3}_a$ makes the first rise of STB in the frame. The control unit $\mathbf{3}_a$ also raises $POL_1$ and $POL_2$ to the high level in conjunction with the rise of STB, as control in the select period of the first row (odd row). Thereafter, $POL_1$ is maintained at the high level in the frame A2. Furthermore, $POL_2$ alternates between the low level and the high level at every period of STB. In the same manner as in each of the other embodiments, the switching of the level of $POL_2$ is performed during the high-level duration of STB.

In the previous select period the first latch section 62 sequentially receives the data read indication signals from the shift register 61 to the signal input terminals $L_1$ to $L_a$ and $L_{a+b+1}$ to $L_m$ and reads and stores data of n pixels in one row.

With a change of STB to the high level, the D-A converter $\mathbf{65}_a$ keeps the outputs of the respective potential output terminals $T'_1$ to $T'_{m+1}$ in the high impedance state during a high-level duration of STB.

With the next change of STB to the low level, the second latch section $\mathbf{63}_a$ captures the data of n pixels in one row from the first latch section 62. Since $POL_2$ is at the high level herein, the second latch section $\mathbf{63}_a$ captures the data from the first latch section 62, using the data input terminals $Q_1$ to $Q_a$ and $Q_{a+b+1}$ to $Q_m$. Then it outputs the data from the data output terminals $Q'_1$ to $Q'_a$ $Q'_{a+b+1}$ to $Q'_m$.

The data of n pixels in one row output from the second latch section $\mathbf{63}_a$ are input to the data input terminals $U_1$ to $U_a$ and $U_{a+b+1}$ to $U_m$ of the level shifter $\mathbf{64}_a$. The level shifter $\mathbf{64}_a$ performs the level shift of the data and outputs the data after the level shift from the data output terminals $U'_1$ to $U'_a$ and $U'_{a+b+1}$ to $U'_m$ corresponding to the respective data input terminals.

Then the data of n pixels in one row output from the level shifter $\mathbf{64}_a$ are input to the data input terminals $T_1$ to $T_a$ and $T_{a+b+1}$ to $T_m$ of the D-A converter $\mathbf{65}_a$. The D-A converter $\mathbf{65}_a$ outputs potentials according to the data from the potential output terminals $T'_1$ to $T'_a$ and $T'_{a+b+1}$ to $T'_m$ corresponding to the respective data input terminals. At this time, $POL_1$ is at the high level. Therefore, the D-A converter $\mathbf{65}_a$ outputs positive potentials according to the data from the odd-numbered potential output terminals $T'_1, T'_3, \ldots, T'_{a-1}, T'_{a+b+1} \ldots T'_{m-1}$ from the left. Furthermore, it outputs negative potentials according to the data from the even-numbered potential output terminals $T'_2, T'_4, \ldots, T'_a, T'_{a+b+2}, \ldots T'_m$ from the left.

The respective potentials output from the D-A converter $\mathbf{65}_a$ are input to the potential input terminals $W_1$ to $W_a$ and the data input terminals $W_{a+b+1}$ to $W_m$ of the voltage follower $\mathbf{66}_a$. Then the voltage follower $\mathbf{66}_a$ outputs potentials equal to the input potentials from the potential output terminals $D_1$ to $D_a$ and $D_{a+b+1}$ to $D_m$.

As a consequence, the potentials of the n source lines $S_1$ to $S_n$ are set and the potentials of the n pixel electrodes in the selected row become equal to the potentials of the left source lines as viewed from the viewer side. At this time, the odd-numbered source lines from the left have positive potentials and the even-numbered source lines from the left negative potentials. Therefore, the polarities of the pixels in the selected row are positive, negative, positive, negative, . . . from the left. At this time, the source line $S_{n+1}$ connected to the potential output terminal $D_{m+1}$ in the high impedance state is not used for the potential setting of the pixel electrodes.

In the select period of the first row the first latch section 62 reads data of one row in accordance with instructions from the shift register 61.

Subsequently, the control unit $\mathbf{3}_a$ makes a rise of STB and changes $POL_2$ to the low level in a duration in which STB is at the high level (cf. FIG. 17).

With a change of STB to the low level, the second latch section $\mathbf{63}_a$ captures the data of n pixels in one row from the first latch section 62. Since $POL_2$ is at the low level herein, the second latch section $\mathbf{63}_a$ captures the data from the first latch section 62, using the data input terminals $Q_2$ to $Q_a$ and $Q_{a+b+1}$ to $Q_{m+1}$. Then it outputs the data from the data output terminals $Q'_2$ to $Q'_a$ and $Q'_{a+b+1}$ to $Q'_{m+1}$.

The data of the n pixels in one row output from the second latch section $\mathbf{63}_a$ are input to the data input terminals $U_2$ to $U_a$ and $U_{a+b+1}$ to $U_{m+1}$ of the level shifter $\mathbf{64}_a$. The level shifter $\mathbf{64}_a$ performs the level shift of the data and outputs the data after the level shift from the data output terminals $U'_2$ to $U'_a$ and $U'_{a+b+1}$ to $U'_{m+1}$ corresponding to the respective data input terminals.

Then the data of n pixels in one row output from the level shifter $\mathbf{64}_a$ are input to the data input terminals $T_2$ to $T_a$ and $T_{a+b+1}$ to $T_{m+1}$ of the D-A converter $\mathbf{65}_a$. The D-A converter $\mathbf{65}_a$ outputs potentials according to the data from the potential output terminals $T'_2$ to $T'_a$ and $T'_{a+b+1}$ to $T'_{m+1}$ corresponding to the respective data input terminals. At this time, $POL_1$ is at the high level. Therefore, the D-A converter $\mathbf{65}_a$ outputs negative potentials according to the data from the even-numbered potential output terminals $T'_2, T'_4, \ldots, T'_a, T'_{a+b+2}, \ldots T'_m$ from the left. Furthermore, it outputs positive potentials according to the data from the odd-numbered potential output terminals $T'_3, T'_5, \ldots, T'_{a-1}, \ldots T''_{a+b+1}, \ldots T'_{m+1}$ from the left.

The respective potentials output from the D-A converter $\mathbf{65}_a$ are input to the potential input terminals $W_2$ to $W_a$ and data input terminals $W_{a+b+1}$ to $W_{m+1}$ of the voltage follower $\mathbf{66}_a$. Then the voltage follower $\mathbf{66}_a$ outputs potentials equal to the input potentials from the potential output terminals $D_2$ to $D_a$ and $D_{a+b+1}$ to $D_{m+1}$.

As a consequence, the potentials of the n source lines $S_2$ to $S_{n+1}$ are set, so that the potentials of the n pixel electrodes in the selected row become equal to the potentials of the right source lines as viewed from the viewer side. At this time, the odd-numbered source lines from the left have positive potentials and the even-numbered source lines from the left negative potentials. Therefore, the polarities of the pixels in the selected row are negative, positive, negative, positive, . . . from the left. At this time, the source line $S_1$ connected to the potential output terminal $D_1$ in the high impedance state is not used for the potential setting of the pixel electrodes.

Thereafter, the operations in the select periods of the two rows as described above are repeatedly carried out in this frame A2. Accordingly, the polarities of the respective pixels in this frame A2 are as shown in FIG. 11.

Next, the frame B2 in which $POL_1$ is at the low level will be described with reference to FIG. 18. The control unit $\mathbf{3}_a$ makes the first rise of STB in the frame. The control unit $\mathbf{3}_a$ changes $POL_1$ to the low level and raises $POL_2$ to the high level in conjunction with the rise of STB, as control in the select period of the first row (odd row). Thereafter, $POL_1$ is maintained at the low level in the frame B2. Furthermore, $POL_2$ alternates between the low level and the high level at every period of STB.

In the previous select period the first latch section 62 reads and stores data of n pixels in one row.

With a change of STB to the high level, the D-A converter $\mathbf{65}_a$ keeps the outputs of the respective potential output terminals $T'_1$ to $T'_{m+1}$ in the high impedance state during a high-level duration of STB.

With the next change of STB to the low level, the second latch section $\mathbf{63}_a$ captures the data of n pixels in one row from the first latch section 62. Since $POL_2$ is at the high level herein, the second latch section $\mathbf{63}_a$ captures the data from the first latch section 62, using the data input terminals $Q_1$ to $Q_a$ and $Q_{a+b+1}$ to $Q_m$. Then it outputs the data from the data output terminals $Q'_1$ to $Q'_a$ and $Q'_{a+b+1}$ to $Q'_m$.

The data of n pixels in one row output from the second latch section $\mathbf{63}_a$ are input to the data input terminals $U_1$ to $U_a$ and $U_{a+b+1}$ to $U_m$ of the level shifter $\mathbf{64}_a$. The level shifter $\mathbf{64}_a$ performs the level shift of the data and outputs the data after the level shift from the data output terminals $U'_1$ to $U'_a$ and $U'_{a+b+1}$ to $U'_m$ corresponding to the respective data input terminals.

Then the data of n pixels in one row output from the level shifter $\mathbf{64}_a$ are input to the data input terminals $T_1$ to $T_a$ and $T_{a+b+1}$ to $T_m$ of the D-A converter $\mathbf{65}_a$. The D-A converter $\mathbf{65}_a$ outputs potentials according to the data from the potential output terminals $T'_1$ to $T'_a$ and $T'_{a+b+1}$ to $T'_m$ corresponding to the respective data input terminals. At this time, $POL_1$ is at the low level. Therefore, the D-A converter $\mathbf{65}_a$ outputs negative potentials according to the data from the odd-numbered potential output terminals $T'_1, T'_3, \ldots, T'_{a-1}, T'_{a+b+1}, \ldots T_{m-1}$ from the left. Furthermore, it outputs positive potentials according to the data from the even-numbered potential output terminals $T'_2, T'_4, \ldots, T'_a, T'_{a+b+2}, \ldots T'_{m-1}$ from the left.

The respective potentials output from the D-A converter $\mathbf{65}_a$ are input to the potential input terminals $W_1$ to $W_a$ and data input terminals $W_{a+b+1}$ to $W_m$ of the voltage follower $\mathbf{66}_a$. Then the voltage follower $\mathbf{66}_a$ outputs potentials equal to the input potentials from the potential output terminals $D_1$ to $D_a$ and $D_{a+b+1}$ to $D_m$.

As a consequence, the potentials of the n source lines $S_1$ to $S_n$ are set, so that the potentials of the n pixel electrodes in the selected row become equal to the potentials of the left source lines as viewed from the viewer side. At this time, the odd-numbered source lines from the left have negative potentials and the even-numbered source lines from the left positive potentials. Therefore, the polarities of the pixels in the selected row are negative, positive, negative, positive, . . .

from the left. At this time, the source line $S_{n+1}$ connected to the potential output terminal $D_{m+1}$ in the high impedance state is not used for the potential setting of the pixel electrodes.

In the select period of the first row the first latch section 62 reads data of one row in accordance with instructions from the shift register 61.

Subsequently, the control unit $\mathbf{3}_a$ makes a rise of STB and changes $POL_2$ to the low level in a high-level duration of STB (cf. FIG. 18).

With a change of STB to the low level, the second latch section $\mathbf{63}_a$ captures the data of n pixels in one row from the first latch section 62. Since $POL_2$ is at the low level herein, the second latch section $\mathbf{63}_a$ captures the data from the first latch section 62, using the data input terminals $Q_2$ to $Q_a$ and $Q_{a+b+1}$ to $Q_{m+1}$. Then it outputs the data from the data output terminals $Q'_2$ to $Q'_a$ and $Q'_{a+b+1}$ to $Q'_{m+1}$.

The data of n pixels in one row output from the second latch section $\mathbf{63}_a$ are input to the data input terminals $U_2$ to $U_a$ and $U_{a+b+1}$ to $U_{m+1}$ of the level shifter $\mathbf{64}_a$. The level shifter $\mathbf{64}_a$ performs the level shift of the data and outputs the data after the level shift from the data output terminals $U'_2$ to $U'_a$ and $U'_{a+b+1}$ to $U'_{m+1}$ corresponding to the respective data input terminals.

Then the data of n pixels in one row output from the level shifter $\mathbf{64}_a$ are input to the data input terminals $T_2$ to $T_a$ and $T_{a+b+1}$ to $T_{m+1}$ of the D-A converter $\mathbf{65}_a$. The D-A converter $\mathbf{65}_a$ outputs potentials according to the data from the potential output terminals $T'_2$ to $T'_a$ and $T'_{a+b+1}$ to $T'_{m+1}$ corresponding to the respective data input terminals. At this time, $POL_1$ is at the low level. Therefore, the D-A converter $\mathbf{65}_a$ outputs positive potentials according to the data from the even-numbered potential output terminals $T'_2, T'_4, \ldots, T'_a, T'_{a+b+2}, \ldots T'_m$ from the left. Furthermore, it outputs negative potentials according to the data from the odd-numbered potential output terminals $T'_3, T'_5, \ldots, T'_{a-1}, T'_{a+b+1}, \ldots T_{m+1}$ from the left.

The respective potentials output from the D-A converter $\mathbf{65}_a$ are input to the potential input terminals $W_2$ to $W_a$ and data input terminals $W_{a+b+1}$ to $W_{m+1}$ the voltage follower $\mathbf{66}_a$. Then the voltage follower $\mathbf{66}_a$ outputs potentials equal to the input potentials from the potential output terminals $D_2$ to $D_a$ and $D_{a+b+1}$ to $D_{m+1}$.

As a consequence, the potentials of the n source lines $S_2$ to $S_{n+1}$ are set, so that the potentials of the n pixel electrodes in the selected row become equal to the potentials of the right source lines as viewed from the viewer side. At this time, the even-numbered source lines from the left have positive potentials and the odd-numbered source lines from the left negative potentials. Therefore, the polarities of the pixels in the selected row are positive, negative, positive, negative, . . . from the left. At this time, the source line $S_1$ connected to the potential output terminal $D_1$ in the high impedance state is not used for the potential setting of the pixel electrodes.

Thereafter, the operations in the select periods of the two rows described above are repeatedly carried out in this frame B2. Therefore, the polarities of the respective pixels in this frame B2 are as shown in FIG. 13.

The driving device 1, alternately performs the operation in the frame A2 and the operation in the frame B2 described above, on a frame-by-frame basis. Accordingly, the polarities of adjacent pixels become opposite to each other in each frame. Furthermore, the polarity varies frame by frame even in an identical pixel (cf. FIGS. 11 and 13).

In each frame the potentials of each source line are not varied across $V_{COM}$. Therefore, power consumption is reduced.

In the third embodiment, the LCD panel 20 can also be driven without connecting the potential output terminals in the central region ($D_{a+1}$ to $D_{a+b}$ in the above example) out of the plurality of potential output terminals of the driving device to any source line.

The above described the example in which the driving device 1 (specifically, the first latch section 62) serially captured the pixel values, but the driving device may be configured to capture the pixel values of R, G, and B in parallel at every rising edge of SCLK.

[Embodiment 4]

The fourth embodiment of the present invention can be illustrated as in FIG. 14. Namely, the driving device 1, receives supply of voltages from the power supply unit 4 and drives the LCD panel 20 under control of the control unit $\mathbf{3}_a$. The power supply unit 4 and the LCD panel 20 are the same as those in the first and second embodiments.

The control unit $\mathbf{3}_a$ is the same as that in the second embodiment and the third embodiment. Namely, the control unit $\mathbf{3}_a$ alternately changes the level of $POL_1$ between the high level and the low level on a frame-by-frame basis. The output modes of the control signals ($POL_2$, STB, SCLK, STH, etc.) except for $POL_1$ are the same as in the first and second embodiments.

The connection configuration between the driving device $\mathbf{1}_a$ and the source lines $S_1$ to $S_{n+1}$ is also the same as in the second embodiment and the third embodiment and thus the description thereof is omitted herein.

The operation of the driving device $\mathbf{1}_a$ is the same as in the second embodiment and the third embodiment. Namely, with $POL_2$ at the high level, potentials according to pixel values are output from the n potential output terminals except for $D_{m+1}$, out of the potential output terminals $D_1$ to $D_a$ and $D_{a+b+1}$ to $D_{m+1}$, and the output state of $D_{m+1}$ is kept in the high impedance state. With $POL_2$ at the low level, potentials according to pixel values are output from the n potential output terminals except for $D_1$, out of the potential output terminals $D_1$ to $D_a$ and $D_{a+b+1}$ to $D_{m+1}$, and the output state of $D_1$ is kept in the high impedance state.

With $POL_1$ at the high level, the driving device $\mathbf{1}_a$ outputs positive potentials according to pixel values from the odd-numbered potential output terminals from the left and outputs negative potentials according to pixel values from the even-numbered potential output terminals from the left. With $POL_1$ at the low level, the driving device $\mathbf{1}_a$ outputs negative potentials according to pixel values from the odd-numbered potential output terminals from the left and outputs positive potentials according to pixel values from the even-numbered potential output terminals from the left. However, either of the potential output terminals $D_1$, $D_{m+1}$ is brought into the high impedance state, depending upon the level of $POL_2$ as described above. The potential output terminals $D_{a+1}$ to $D_{a+b}$ are always maintained in the high impedance state.

Figure 21:
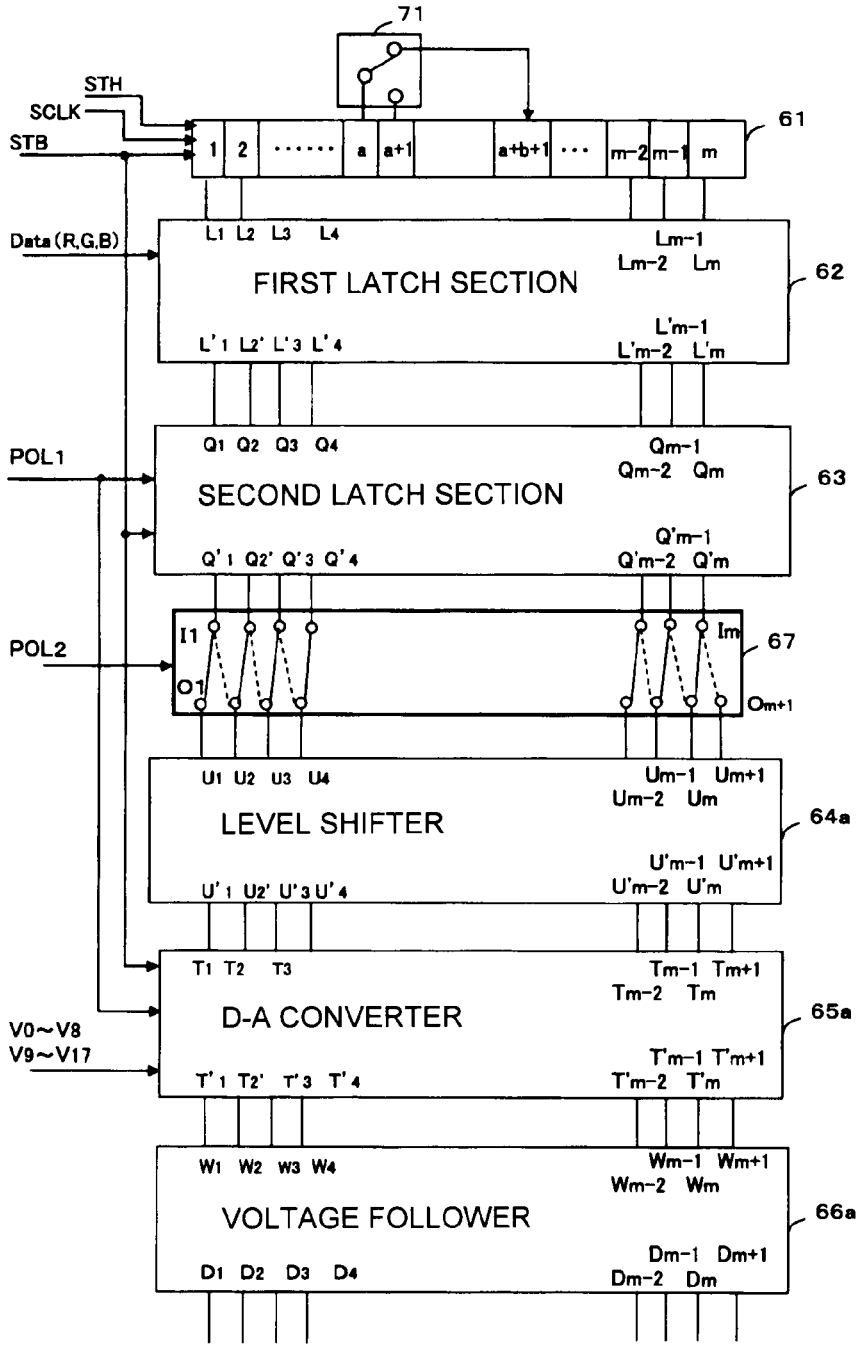
FIG. 21 is an explanatory drawing showing a configuration example of the driving device $\mathbf{1}_a$ in the fourth embodiment.
Figure 22:
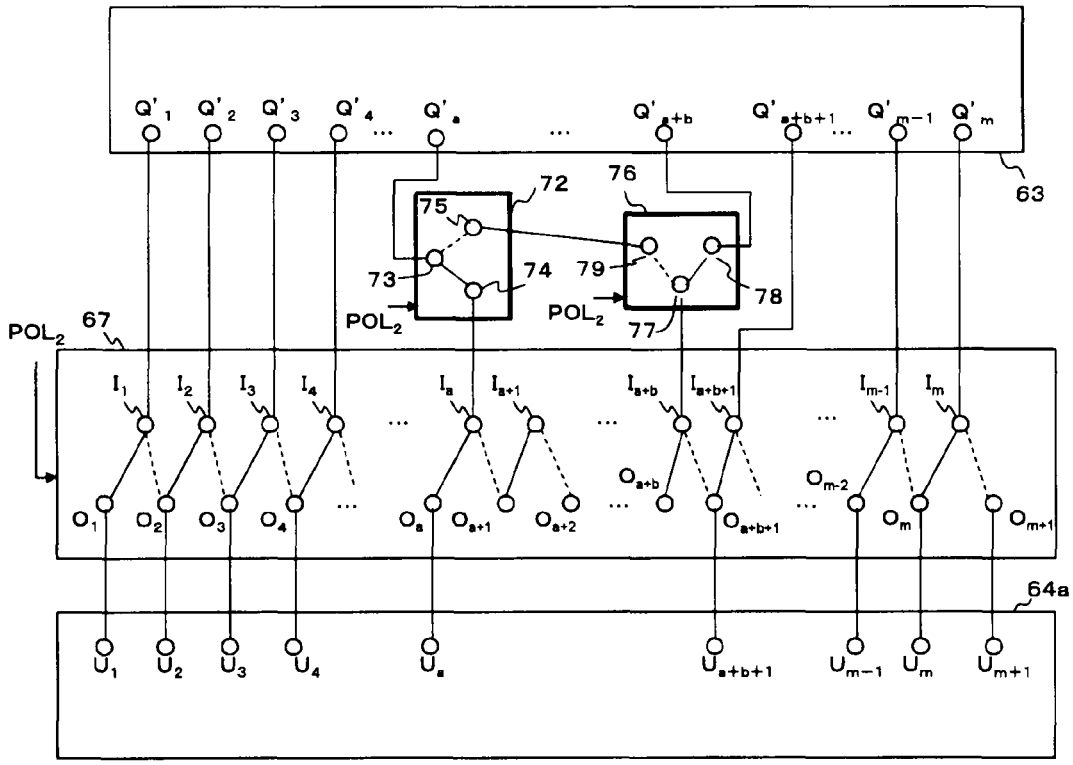
FIG. 22 is an explanatory drawing showing a configuration example of the driving device $\mathbf{1}_a$ in the fourth embodiment.

However, the configuration of the driving device $\mathbf{1}_a$ is different from those in the second embodiment and the third embodiment. FIGS. 21 and 22 are explanatory drawings showing a configuration example of the driving device $\mathbf{1}_a$ in the fourth embodiment. The same constituent elements as in the first embodiment will be denoted by the same reference signs as those in FIGS. 7 and 8. Furthermore, the same constituent elements as in the second embodiment will be denoted by the same reference signs as those in FIGS. 15 and 16.

The driving device $\mathbf{1}_a$ in the fourth embodiment is provided with a shift register 61, a first latch section 62, a second latch section 63, an output switching section 67, a first changeover switch 72 and a second changeover switch 76 (which are not shown in FIG. 21; cf. FIG. 22), a level shifter $\mathbf{64}_a$, a D-A converter $65_a$, and a voltage follower $66_a$. The shift register 61 is provided with a shift register switch 71.

The shift register 61 and the shift register switch 71 are the same as those in each of the first to third embodiments and thus the description thereof is omitted herein.

The first latch section 62 is also the same as that in the first embodiment and the detailed description thereof is omitted herein.

The second latch section 63 is also the same as that in the first embodiment and the detailed description thereof is omitted herein. In the fourth embodiment, the consecutive data output terminals $Q'_1$ to $Q'_a$ from the first to the a-th from the left in the second latch section 63 will be referred to hereinafter as a first output terminal group. The consecutive data output terminals $Q'_{a+1}$ to $Q'_{a+b}$ from the (a+1)th to the (a+b)th from the left will be referred to as a second output terminal group. The consecutive data output terminals $Q'_{a+b+1}$ to $Q'_m$ from the (a+b+1)th to the m-th from the left will be referred to as a third output terminal group. Since no data is taken in from the data input terminals $Q_{a+1}$ to $Q_{a+b}$ of the second latch section 63, the second output terminal group outputs no data and thus does not contribute to the potential setting for the source lines. The number of data output terminals belonging to the first output terminal group is a, the number of data output terminals belonging to the second output terminal group is b, and the number of data output terminals belonging to the third output terminal group is c. When the number of pixels in one row in the LCD panel 20 is assumed to be n, n=a+c.

In the present embodiment, as shown in FIG. 22, the output switching section 67, the first switch 72, and the second switch 76 are provided in the subsequent stage to the second latch section 63. The connection configuration of the output switching section 67, the first switch 72, and the second switch 76 to the second latch section 63 is the same as that of the output switching section 67, the first switch 72, and the second switch 76 to the voltage follower 66 in the first embodiment.

Namely, the first to (a−1)th input terminals $I_1$ to $I_{a-1}$ from the left in the output switching section 67 are connected in order to the respective data output terminals $Q'_1$ to $Q'_{a-1}$ from the first to the (a−1)th from the left in the second latch section 63. Furthermore, the (a+b+1)th to m-th input terminals $I_{a+b+1}$ to $I_m$ from the left are also connected in order to the respective data output terminals $Q'_{a+b+1}$ to $Q'_m$ from the section to the m-th from the left in the second latch section 63.

The first terminal 73 of the first switch 72 is connected to the a-th data output terminal $Q'_a$ from the left in the second latch section 63 and the second terminal 74 of the first switch 72 is connected to the a-th input terminal $I_a$ from the left in the output switching section 67. The first terminal 77 of the second switch 76 is connected to the (a+b)th input terminal $I_{a+b}$ from the left in the output switching section 67 and the second terminal 78 of the second switch 76 is connected to the (a+b)th data output terminal $Q'_{a+b}$ from the left in the second latch section 63. The third terminal 75 of the first switch 72 is connected to the third terminal 79 of the second switch 76.

The operations of the output switching section 67, the first switch 72, and the second switch 76 according to the levels of $POL_2$ are the same as those in the first embodiment.

The level shifter $64_a$ is the same as that in the second embodiment. The level shifter $64_a$ is provided with (m+1) data input terminals $U_1$ to $U_{m+1}$ corresponding to the output terminals $O_1$ to $O_{m+1}$ of the output switching section 67 and with (m+1) data output terminals $U'_1$ to $U'_{m+1}$. The data of one row (n pixel values) are input to n data input terminals corresponding to n output terminals of the output switching section 67 becoming connected to the n data output terminals $Q'_1$ to $Q'_a$ and $Q'_{a+b+1}$ to $Q'_m$ of the second latch section 63, out of the first to a-th data input terminals $U_1$ to $U_a$ and the (a+b+1)th to (m+1)th data input terminals $U_{a+b+1}$ to $U_{m+1}$ from the left in the level shifter $64_a$. Then the level shifter $64_a$ performs the level shift of the input data and outputs the data after the level shift from the respective data output terminals corresponding to the data input terminals having received the data.

With $POL_2$ at the high level, the input terminal $I_k$ of the output switching section 67 is connected to the output terminal $O_k$. Furthermore, the first terminal 73 of the first switch 72 is connected to the second terminal 74. Therefore, the data output terminals $Q'_1$ to $Q'_a$ of the second latch section 63 become connected to the output terminals $O_1$ to $O_a$ of the output switching section 67. Similarly, the data output terminals $Q'_{a+b+1}$ to $Q'_m$ of the second latch section 63 become connected to the output terminals $O_{a+b+1}$ to $O_m$ of the output switching section 67. Therefore, the data output from the data output terminals $Q'_1$ to $Q'_a$ and $Q_{a+b+1}$ to $Q'_m$ of the second latch section 63 are input to the data input terminals $U_1$ to $U_a$ and $U_{a+b+1}$ to $U_m$ of the level shifter $64_a$. The data output from the data output terminal $Q'_a$ is input to the data input terminal $U_a$ via the first terminal 73 and the second terminal 74 of the first switch 72, the input terminal $I_a$, and the output terminal $O_a$.

At this time, the level shifter $64_a$ outputs the data after the level shift from the data output terminals $U'_1$ to $U'_a$ and $U'_{a+b+1}$ to $U'_m$.

With $POL_2$ at the low level, the input terminal $I_k$ of the output switching section 67 is connected to the output terminal $O_{k+1}$. Then the first terminal 73 of the first switch 72 is connected to the third terminal 75 and the first terminal 77 of the second switch 76 is connected to the third terminal 79. Therefore, the data output terminals $Q'_1$ to $Q'_{a-1}$ of the second latch section 63 become connected to the output terminals $O_2$ to $O_a$ of the output switching section 67. The data output terminal $Q'_a$ becomes connected to the output terminal $O_{a+b+1}$ through the first terminal 73 and the third terminal 75 of the first switch 72, the third terminal 79 and the first terminal 77 of the second switch 76, and the input terminal $I_{a+b}$ of the output switching section 67. The data output terminals $Q'_{a+b+1}$ to $Q'_m$ of the second latch section 63 become connected to the output terminals $O_{a+b+2}$ to $O_{m+1}$ of the output switching section 67. As a consequence, the data output from the data output terminals $Q'_1$ to $Q'_a$ and $Q'_{a+b+1}$ to $Q'_m$ of the second latch section 63 are input to the data input terminals $U_2$ to $U_a$ and $U_{a+b+1}$ to $U_{m+1}$ of the level shifter $64_a$. The data output from the data output terminal $Q'_a$ is input to the data input terminal $U_{a+b+1}$ via the first terminal 73 and the third terminal 75 of the first switch 72, the third terminal 79 and the first terminal 77 of the second switch 76, and the input terminal $I_{a+b}$ and the output terminal $O_{a+b+1}$ of the output switching section 67.

At this time, the level shifter $64_a$ outputs the data after the level shift from the data output terminals $U'_2$ to $U'_a$ and $U'_{a+b+1}$ to $U'_{m+1}$.

Therefore, the data output from the level shifter $64_a$ with $POL_2$ at the high level and the data output from the level shifter $64_a$ with $POL_2$ at the low level both are the same as in the second embodiment.

Furthermore, the D-A converter $65_a$ and the voltage follower $66_a$ are the same as those in the second embodiment and thus the description thereof is omitted herein.

The below will describe states of the control signals $POL_1$, $POL_2$ and set potentials for the source lines. The output modes of $POL_1$, $POL_2$, and STB in the present embodiment are the same as those in the second embodiment (cf. FIGS. 17 and 18).

The frame A2 in which $POL_1$ is at the high level will be described with reference to FIG. 17. The control unit $\mathbf{3}_a$ makes the first rise of STB in the frame. The control unit $\mathbf{3}_a$ also raises $POL_1$ and $POL_2$ to the high level in conjunction with the rise of STB, as control in the select period of the first row (odd row). Thereafter, $POL_1$ is maintained at the high level in the frame A2. Furthermore, $POL_2$ alternates between the low level and the high level at every period of STB.

In the previous select period the first latch section 62 sequentially receives the data read indication signals from the shift register 61 to the signal input terminals $L_1$ to $L_a$ and $L_{a+b+1}$ to $L_m$ and reads and stores data of n pixels in one row.

With a change of STB to the high level, the D-A converter $\mathbf{65}_a$ keeps the outputs of the respective potential output terminals $T'_1$ to $T'_{m+1}$ in the high impedance state during a high-level duration of STB.

With the next change of STB to the low level, the second latch section 63 captures the data from the first latch section 62, using the data input terminals $Q_1$ to $Q_a$ and $Q_{a+b+1}$ to $Q_m$, and outputs the data from the data output terminals $Q'_1$ to $Q'_a$ and $Q'_{a+b+1}$ to $Q'_m$.

Since $POL_2$ is at the high level at this time, the data output from the second latch section 63 are input to the data input terminals $U_1$ to $U_a$ and $U_{a+b+1}$ to $U_m$ of the level shifter $\mathbf{64}_a$. The level shifter $\mathbf{64}_a$ performs the level shift of each data and outputs the data after the level shift from the data output terminals $U'_1$ to $U'_a$ and $U'_{a+b+1}$ to $U'_m$.

Then the data of n pixels in one row output from the level shifter $\mathbf{64}_a$ are input to the data input terminals $T_1$ to $T_a$ and $T_{a+b+1}$ to $T_m$ of the D-A converter $\mathbf{65}_a$. The D-A converter $\mathbf{65}_a$ outputs potentials according to the data from the potential output terminals $T'_1$ to $T'_a$ and $T_{a+b+1}$ to $T_m$ corresponding to the respective data input terminals. At this time, $POL_1$ is at the high level. Therefore, the D-A converter $\mathbf{65}_a$ outputs positive potentials according to the data from the odd-numbered potential output terminals $T'_1, T'_3, \ldots, T'_{a-1}, T'_{a+b+1}, \ldots T'_{m-1}$ from the left. Furthermore, it outputs negative potentials according to the data from the even-numbered potential output terminals $T'_2, T'_4, \ldots, T'_a, T'_{a+b+2}, \ldots T'_m$ from the left.

The respective potentials output from the D-A converter $\mathbf{65}_a$ are input to the potential input terminals $W_1$ to $W_a$ and the data input terminals $W_{a+b+1}$ to $W_m$ of the voltage follower $\mathbf{66}_a$. Then the voltage follower $\mathbf{66}_a$ outputs potentials equal to the input potentials from the potential output terminals $D_1$ to $D_a$ and $D_{a+b+1}$ to $D_m$.

As a consequence, the potentials of the n source lines $S_1$ to $S_n$ are set, so that the potentials of the n pixel electrodes in the selected row become equal to the potentials of the left source lines as viewed from the viewer side. At this time, the odd-numbered source lines from the left have positive potentials and the even-numbered source lines from the left negative potentials. Therefore, the polarities of the pixels in the selected row are positive, negative, positive, negative, . . . from the left. At this time, the source line $S_{n+1}$ connected to the potential output terminal $D_{m+1}$ in the high impedance state is not used for the potential setting of the pixel electrodes.

In the select period of the first row the first latch section 62 reads data of one row in accordance with instructions from the shift register 61.

Subsequently, the control unit $\mathbf{3}_a$ makes a rise of STB and changes $POL_2$ to the low level in a duration in which STB is at the high level (cf. FIG. 17).

With a change of STB to the low level, the second latch section 63 captures the data from the first latch section 62, using the data input terminals $Q_1$ to $Q_a$ and $Q_{a+b+1}$ to $Q_m$, and outputs the data from the data output terminals $Q'_1$ to $Q'_a$ and $Q'_{a+b+1}$ to $Q'_m$.

Since $POL_2$ is at the low level at this time, the data output from the second latch section 63 are input to the data input terminals $U_2$ to $U_a$ and $U_{a+b+1}$ to $U_{m+1}$ of the level shifter $\mathbf{64}_a$. The level shifter $\mathbf{64}_a$ performs the level shift of each data and outputs the data after the level shift from the data output terminals $U'_2$ to $U'_a$ and $U'_{a+b+1}$ to $U_{m+1}$.

Then the data of n pixels in one row output from the level shifter $\mathbf{64}_a$ are input to the data input terminals $T_2$ to $T_a$ and $T_{a+b+1}$ to $T_{m+1}$ of the D-A converter $\mathbf{65}_a$. The D-A converter $\mathbf{65}_a$ outputs potentials according to the data from the potential output terminals $T'_2$ to $T'_a$ and $T'_{a+b+1}$ to $T'_{m+1}$ corresponding to the respective data input terminals. At this time, $POL_1$ is at the high level. Therefore, the D-A converter $\mathbf{65}_a$ outputs negative potentials according to the data from the even-numbered potential output terminals $T'_2, T'_4, \ldots, T'_a, T'_{a+b+2}, \ldots T'_m$ from the left. Furthermore, it outputs positive potentials according to the data from the odd-numbered potential output terminals $T'_3, T'_5, \ldots, T'_{a-1}, T_{a+b+1}, \ldots T'_{m+1}$ from the left.

The respective potentials output from the D-A converter $\mathbf{65}_a$ are input to the potential input terminals $W_2$ to $W_a$ and data input terminals $W_{a+b+1}$ to $W_{m+1}$ of the voltage follower $\mathbf{66}_a$. Then the voltage follower $\mathbf{66}_a$ outputs potentials equal to the input potentials from the potential output terminals $D_2$ to $D_a$ and $D_{a+b+1}$ to $D_{m+1}$.

As a consequence, the potentials of the n source lines $S_2$ to $S_{n+1}$ are set, so that the potentials of the n pixel electrodes in the selected row become equal to the potentials of the right source lines as viewed from the viewer side. At this time, the even-numbered source lines from the left have negative potentials and the odd-numbered source lines from the left positive potentials. Therefore, the polarities of the pixels in the selected row are negative, positive, negative, positive, . . . from the left. At this time, the source line $S_1$ connected to the potential output terminal $D_1$ in the high impedance state is not used for the potential setting of the pixel electrodes.

Thereafter, the operations in the select periods of the two rows as described above are repeatedly carried out in this frame A2. Accordingly, the polarities of the respective pixels in this frame A2 are as shown in FIG. 11.

Next, the frame B2 in which $POL_1$ is at the low level will be described with reference to FIG. 18. The control unit $\mathbf{3}_a$ makes the first rise of STB in the frame. The control unit $\mathbf{3}_a$ changes $POL_1$ to the low level and raises $POL_2$ to the high level in conjunction with the rise of STB, as control in the select period of the first row (odd row). Thereafter, $POL_1$ is maintained at the low level in the frame B2. Furthermore, $POL_2$ alternates between the low level and the high level at every period of STB.

In the previous select period the first latch section 62 reads and stores data of n pixels in one row.

With a change of STB to the high level, the D-A converter $\mathbf{65}_a$ keeps the outputs of the respective potential output terminals $T'_1$ to $T'_{m+1}$ in the high impedance state during a high-level duration of STB.

With the next change of STB to the low level, the second latch section 63 captures the data from the first latch section 62, using the data input terminals $Q_1$ to $Q_a$ and $Q_{a+b+1}$ to $Q_m$, and outputs the data from the data output terminals $Q'_1$ to $Q'_a$ and $Q'_{a+b+1}$ to $Q'_m$.

Since $POL_2$ is at the high level at this time, the data output from the second latch section 63 are input to the data input terminals $U_1$ to $U_a$ and $U_{a+b+1}$ to $U_m$ of the level shifter $\mathbf{64}_a$. The level shifter $\mathbf{64}_a$ performs the level shift of each data and outputs the data after the level shift from the data output terminals $U'_1$ to $U'_a$ and $U'_{a+b+1}$ to $U'_m$.

Then the data of n pixels in one row output from the level shifter $\mathbf{64}_a$ are input to the data input terminals $T_1$ to $T_a$ and $T_{a+b+1}$ to $T_m$ of the D-A converter $\mathbf{65}_a$. The D-A converter $\mathbf{65}_a$ outputs potentials according to the data from the potential output terminals $T'_1$ to $T'_a$ and $T'_{a+b+1}$ to $T'_m$ corresponding to the respective data input terminals. At this time, $POL_1$ is at the low level. Therefore, the D-A converter $\mathbf{65}_a$ outputs negative potentials according to the data from the odd-numbered potential output terminals $T'_1$, $T'_{a-1}$, $T'_{a+b+1}$, . . . $T'_{m-1}$ from the left. Furthermore, it outputs positive potentials according to the data from the even-numbered potential output terminals $T'_2$, $T'_4$, $T'_{a+b+2}$, . . . $T'_m$ from the left.

The respective potentials output from the D-A converter $\mathbf{65}_a$ are input to the potential input terminals $W_1$ to $W_a$ and data input terminals $W_{a+b+1}$ to $W_m$ of the voltage follower $\mathbf{66}_a$. Then the voltage follower $\mathbf{66}_a$ outputs potentials equal to the input potentials from the potential output terminals $D_1$ to $D_a$ and $D_{a+b+1}$ to $D_m$.

As a consequence, the potentials of the n source lines $S_1$ to $S_n$ are set, so that the potentials of the n pixel electrodes in the selected row become equal to the potentials of the left source lines as viewed from the viewer side. At this time, the odd-numbered source lines from the left have negative potentials and the even-numbered source lines from the left positive potentials. Therefore, the polarities of the pixels in the selected row are negative, positive, negative, positive, . . . from the left. At this time, the source line $S_{n+1}$ connected to the potential output terminal $D_{m+1}$ in the high impedance state is not used for the potential setting of the pixel electrodes.

In the select period of the first row the first latch section 62 reads data of one row in accordance with instructions from the shift register 61.

Subsequently, the control unit $\mathbf{3}_a$ makes a rise of STB and changes $POL_2$ to the low level in a high-level duration of STB (cf. FIG. 18).

With a change of STB to the low level, the second latch section 63 captures the data from the first latch section 62, using the data input terminals $Q_1$ to $Q_a$ and $O_{a+b+1}$ to $Q_m$ and outputs the data from the data output terminals $Q'_1$ to $Q'_a$ and $Q'_{a+b+1}$ to $Q_m$.

Since $POL_2$ is at the low level at this time, the data output from second latch section 63 are input to the data input terminals $U_2$ to $U_a$ and $U_{a+b+1}$ to $U_{m+1}$ of the level shifter $\mathbf{64}_a$. The level shifter $\mathbf{64}_a$ performs the level shift of each data and outputs the data after the level shift from the data output terminals $U'_2$ to $U'_a$ and $U'_{a+b+1}$ to $U'_{m+1}$.

Then the data of n pixels in one row output from the level shifter $\mathbf{64}_a$ are input to the data input terminals $T_2$ to $T_a$ and $T_{a+b+1}$ to $T_{m+1}$ of the D-A converter $\mathbf{65}_a$. The D-A converter $\mathbf{65}_a$ outputs potentials according to the data from the potential output terminals $T'_2$ to $T'_a$ and $T'_{a+b+1}$ to $T'_{m+1}$ corresponding to the respective data input terminals. At this time, $POL_1$ is at the low level. Therefore, the D-A converter $\mathbf{65}_a$ outputs positive potentials according to the data from the even-numbered potential output terminals $T'_2$, $T'_4$, . . . , $T'_a$, $T'_{a+b+2}$, . . . $T'_m$ from the left. Furthermore, it outputs negative potentials according to the data from the odd-numbered potential output terminals $T'_3$, $T'_5$, . . . , $T'_{a-1}$, $T'_{a+b+1}$, . . . $T'_{m+1}$ from the left.

The respective potentials output from the D-A converter $\mathbf{65}_a$ are input to the potential input terminals $W_2$ to $W_a$ and data input terminals $W_{a+b+1}$ to $W_{m+1}$ of the voltage follower $\mathbf{66}_a$. Then the voltage follower $\mathbf{66}_a$ outputs potentials equal to the input potentials from the potential output terminals $D_2$ to $D_a$ and $D_{a+b+1}$ to $D_{m+1}$.

As a consequence, the potentials of the n source lines $S_2$ to $S_{n+1}$ are set, so that the potentials of the n pixel electrodes in the selected row become equal to the potentials of the right source lines as viewed from the viewer side. At this time, the even-numbered source lines from the left have positive potentials and the odd-numbered source lines from the left negative potentials. Therefore, the polarities of the pixels in the selected row are positive, negative, positive, negative, . . . from the left. At this time, the source line $S_1$ connected to the potential output terminal $D_1$ in the high impedance state is not used for the potential setting of the pixel electrodes.

Thereafter, the operations in the select periods of the two rows described above are repeatedly carried out in this frame B2. Therefore, the polarities of the respective pixels in this frame B2 are as shown in FIG. 13.

The driving device $\mathbf{1}_a$ alternately performs the operation in the frame A2 and the operation in the frame B2 described above, on a frame-by-frame basis. Accordingly, the polarities of adjacent pixels become opposite to each other in each frame. Furthermore, the polarity varies frame by frame even in an identical pixel (cf. FIGS. 11 and 13).

In each frame the potentials of each source line are not varied across $V_{COM}$. Therefore, power consumption is reduced.

In the fourth embodiment, the LCD panel 20 can also be driven without connecting the potential output terminals in the central region ($D_{a+1}$ to $D_{a+b}$ in the above example) out of the plurality of potential output terminals of the driving device to any source line.

[Embodiment 5]

The fifth embodiment of the present invention can be illustrated as in FIG. 14. Namely, the driving device $\mathbf{1}_a$ receives supply of voltages from the power supply unit 4 and drives the LCD panel 20 under control of the control unit $\mathbf{3}_a$. The power supply unit 4 and the LCD panel 20 are the same as those in the first and second embodiments.

The control unit $\mathbf{3}_a$ is the same as that in each of the second to fourth embodiments. Namely, the control unit $\mathbf{3}_a$ alternately changes the level of $POL_1$ between the high level and the low level on a frame-by-frame basis. The output modes of the control signals ($POL_2$, STB, SCLK, STH, etc.) except for $POL_1$ are the same as in each of the first to fourth embodiments.

The connection configuration between the driving device $\mathbf{1}_a$ and the source lines $S_1$ to $S_{n+1}$ is the same as in each of the second to fourth embodiments and thus the description thereof is omitted herein.

The operation of the driving device $\mathbf{1}_a$ is the same as in the second to fourth embodiments. Namely, with $POL_2$ at the high level, potentials according to pixel values are output from the n potential output terminals except for $D_{m+1}$, out of the potential output terminals $D_1$ to $D_a$ and $D_{a+b+1}$ to $D_{m+1}$, and the output state of $D_{m+1}$ is kept in the high impedance state. With $POL_2$ at the low level, potentials according to pixel values are output from the n potential output terminals except for $D_1$, out of the potential output terminals $D_1$ to $D_a$ and $D_{a+b+1}$ to $D_{m+1}$, and the output state of $D_1$ is kept in the high impedance state.

With $POL_1$ at the high level, the driving device $\mathbf{1}_a$ outputs positive potentials according to pixel values from the odd-numbered potential output terminals from the left and outputs negative potentials according to pixel values from the even-numbered potential output terminals from the left. With $POL_1$ at the low level, the driving device $\mathbf{1}_a$ outputs negative potentials according to pixel values from the odd-numbered potential output terminals from the left and outputs positive potentials according to pixel values from the even-numbered potential output terminals from the left. However, either of the potential output terminals $D_1$, $D_{m+1}$ is brought into the high impedance state, depending upon the level of $POL_2$ as described above. The potential output terminals $D_{a+1}$ to $D_{a+b}$ are always maintained in the high impedance state.

Figure 23:
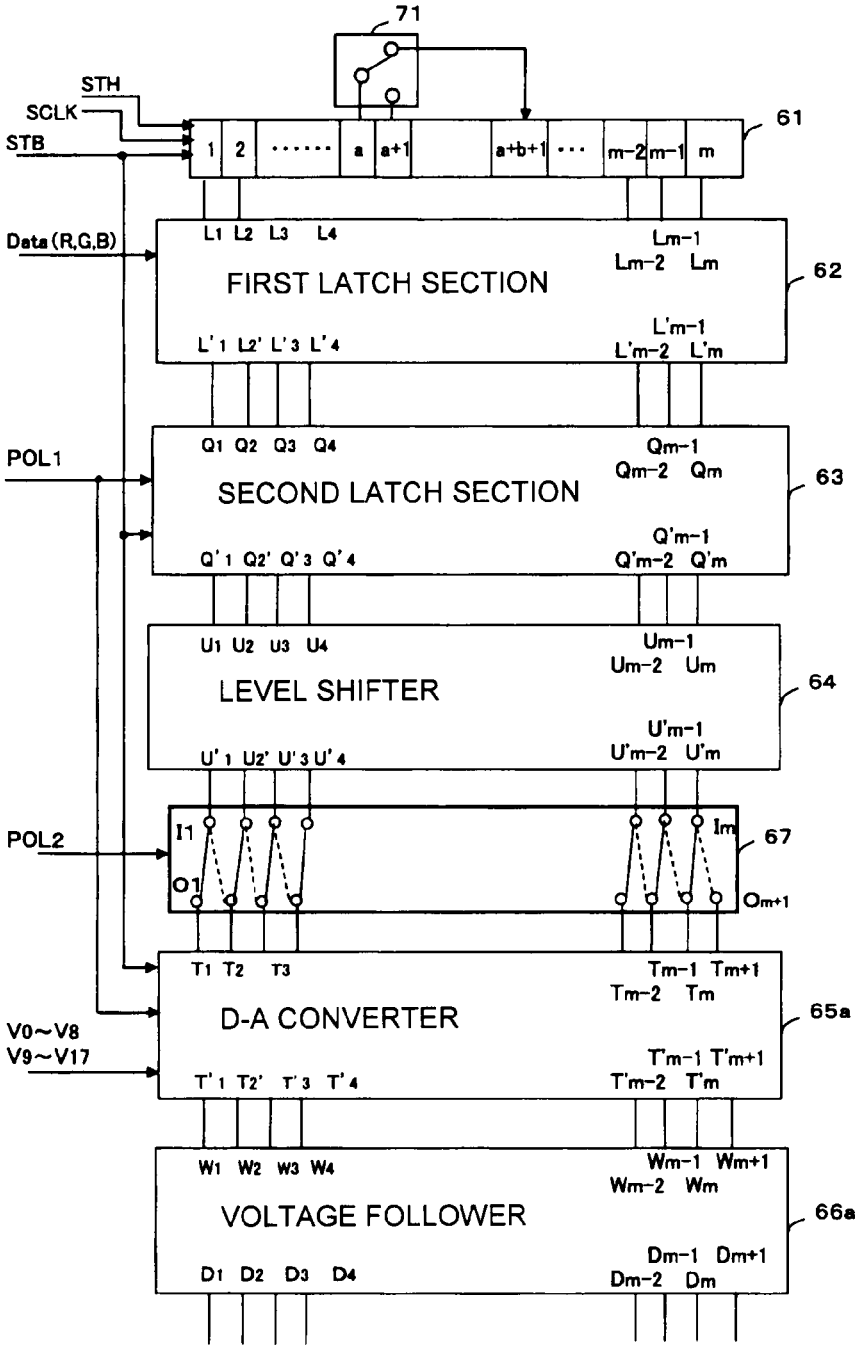
FIG. 23 is an explanatory drawing showing a configuration example of the driving device $\mathbf{1}_a$ in the fifth embodiment.
Figure 24:
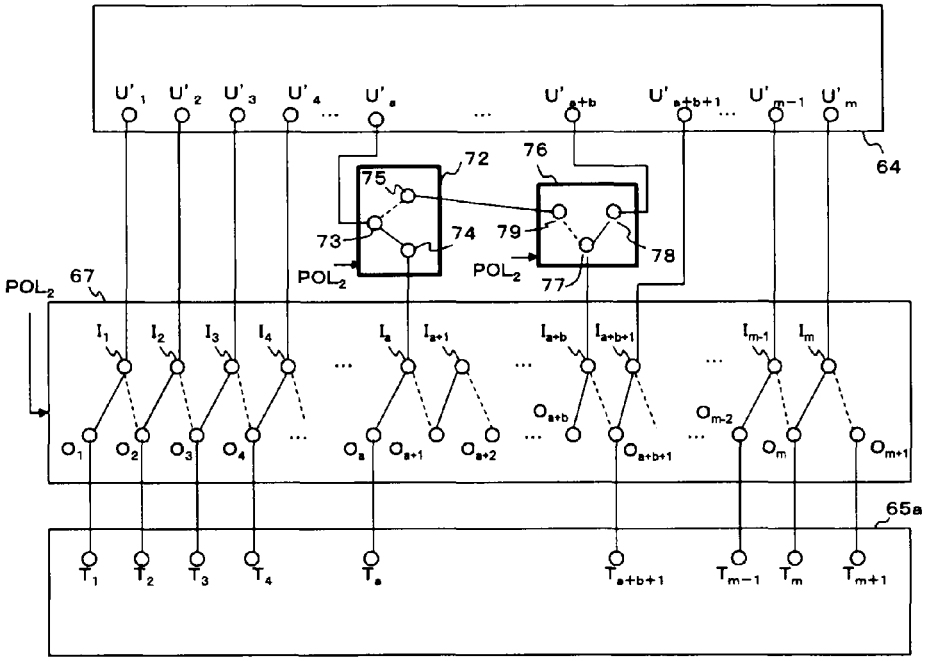
FIG. 24 is an explanatory drawing showing a configuration example of the driving device $\mathbf{1}_a$ in the fifth embodiment.

However, the configuration of the driving device $\mathbf{1}_a$ is different from that in each of the second to fourth embodiments. FIGS. 23 and 24 are explanatory drawings showing a configuration example of the driving device $\mathbf{1}_a$ in the fifth embodiment. The same constituent elements as in the first embodiment will be denoted by the same reference signs as those in FIGS. 7 and 8. Furthermore, the same constituent elements as in the second embodiment will be denoted by the same reference signs as those in FIGS. 15 and 16.

The driving device $\mathbf{1}_a$ in the fifth embodiment is provided with a shift register 61, a first latch section 62, a second latch section 63, a level shifter 64, an output switching section 67, a first changeover switch 72 and a second changeover switch 76 (which are not shown in FIG. 23; cf. FIG. 24), a D-A converter $\mathbf{65}_a$, and a voltage follower $\mathbf{66}_a$. The shift register 61 is provided with a shift register switch 71.

The shift register 61 and the shift register switch 71 are the same as those in each of the first to fourth embodiments and thus the description thereof is omitted herein.

The first latch section 62 and the second latch section 63 are also the same as those in the first embodiment and the detailed description thereof is omitted herein.

The level shifter 64 is also the same as that in the first embodiment and thus the detailed description thereof is omitted herein. In the fifth embodiment, the consecutive data output terminals $U'_1$ to $U'_a$ from the first to the a-th from the left in the level shifter 64 will be referred to as a first output terminal group. Furthermore, the consecutive data output terminals $U'_{a+1}$ to $U'_{a+b}$ from the (a+1)th to the (a+b)th from the left will be referred to as a second output terminal group. The consecutive data output terminals $U'_{a+b+1}$ to $U'_m$ from the (a+b+1)th to the m-th from the left will be referred to as a third output terminal group. Since no data is input to the data input terminals $U_{a+1}$ to $U_{a+b}$ in the level shifter 64, the second output terminal group outputs no data and thus does not contribute to the potential setting for the source lines. The number of data output terminals belonging to the first output terminal group is a, the number of data output terminals belonging to the second output terminal group is b, and the number of data output terminals belonging to the third output terminal group is c. When the number of pixels in one row in the LCD panel 20 is assumed to be n, n=a+c.

In the present embodiment, as shown in FIG. 24, the output switching section 67, the first switch 72, and the second switch 76 are provided in the subsequent stage to the level shifter 64. The connection configuration of the output switching section 67, the first switch 72, and the second switch 76 to the level shifter 64 is the same as that of the output switching section 67, the first switch 72, and the second switch 76 to the voltage follower 66 in the first embodiment.

Namely, the first to (a−1)th input terminals $I_1$ to $I_{a-1}$ from the left in the output switching section 67 are connected in order to the respective data output terminals $U'_1$ to $U'_{a-1}$ from the first to the (a−1)th from the left in the level shifter 64. Furthermore, the (a+b+1)th to m-th input terminals $I_{a+b+1}$ to $I_m$ from the left are also connected in order to the respective data output terminals $U'_{a+b+1}$ to $U'_m$ from the (a+b+1)th to the m-th from the left in the level shifter 64.

The first terminal 73 of the first switch 72 is connected to the a-th data output terminal $U'_a$ from the left in the level shifter 64 and the second terminal 74 of the first switch 72 is connected to the a-th input terminal $I_a$ from the left in the output switching section 67. The first terminal 77 of the second switch 76 is connected to the (a+b)th input terminal $I_{a+b}$ from the left in the output switching section 67 and the second terminal 78 of the second switch 76 is connected to the (a+b)th data output terminal $U'_{a+b}$ from the left in the level shifter 64. The third terminal 75 of the first switch 72 is connected to the third terminal 79 of the second switch 76.

The operations of the output switching section 67, the first switch 72, and the second switch 76 according to the levels of $POL_2$ are the same as those in the first embodiment.

The D-A converter $\mathbf{65}_a$ is the same as in the second embodiment. The D-A converter $\mathbf{65}_a$ is provided with (m+1) data input terminals $T_1$ to $T_{m+1}$ corresponding to the output terminals $O_1$ to $O_{m+1}$ of the output switching section 67 and with (m+1) data output terminals $T'_1$ to $T'_{m+1}$. The data of one row (n pixel values) are input to n data input terminals corresponding to n output terminals of the output switching section 67 becoming connected to the n data output terminals $U'_1$ to $U'_a$ and $U'_{a+b+1}$ to $U'_m$ of the level shifter 64, out of the first to a-th data input terminals $T_1$ to $T_a$ and the (a+b+1)th to (m+1)th data input terminals $T_{a+b+1}$ to $T_{m+1}$ from the left in the D-A converter $\mathbf{65}_a$. Then the D-A converter $\mathbf{65}_a$ converts the data into analog voltages according to the data and outputs potentials according to the data from the respective data output terminals corresponding to the data input terminals having received the data.

With $POL_2$ at the high level, the input terminal $I_k$ of the output switching section 67 is connected to the output terminal $O_k$. Furthermore, the first terminal 73 of the first switch 72 is connected to the second terminal 74. Therefore, the data output terminals $U'_1$ to $U'_a$ of the level shifter 64 become connected to the output terminals $O_1$ to $O_a$ of the output switching section 67. Similarly, the data output terminals $U'_{a+b+1}$ to $U'_m$ of the level shifter 64 become connected to the output terminals $O_{a+b+1}$ to $O_m$ of the output switching section 67. Therefore, the data output from the data output terminals $U'_1$ to $U'_a$ and $U'_{a+b+1}$ to $U'_m$ of the level shifter 64 are input to the data input terminals $T_1$ to $T_a$ and $T_{a+b+1}$ to $T_m$ of the D-A converter $\mathbf{65}_a$. The data output from the data output terminal $U'_a$ is input to the data input terminal $T_a$ via the first terminal 73 and the second terminal 74 of the first switch 72, the input terminal $I_a$, and the output terminal $O_a$.

At this time, the D-A converter $\mathbf{65}_a$ outputs potentials according to the data from the potential output terminals $T'_1$ to $T'_a$ and $T'_{a+b+1}$ to $T'_m$.

With $POL_2$ at the low level, the input terminal $I_k$ of the output switching section 67 is connected to the output terminal $O_{k+1}$. Furthermore, the first terminal 73 of the first switch 72 is connected to the third terminal 75 and the first terminal 77 of the second switch 76 is connected to the third terminal 79. Therefore, the data output terminals $U'_1$ to $U'_m$ of the level shifter 64 become connected to the output terminals $O_2$ to $O_a$ of the output switching section 67. The data output terminal $U'_a$ becomes connected to the output terminal $O_{a+b+1}$ through the first terminal 73 and the third terminal 75 of the first switch 72, the third terminal 79 and the first terminal 77 of the second switch 76, and the input terminal $I_{a+b}$ of the output switching section 67. The data output terminals $U'_{a+b+1}$ to $U'_m$ of the level shifter 64 become connected to the output terminals $O_{a+b+2}$ to $O_{m+1}$ of the output switching section 67. As a consequence, the data output from the data output terminals $U'_1$ to $U'_a$ and $U'_{a+b+1}$ to $U'_m$ of the level shifter 64 are input to the data input terminals $T_2$ to $T_a$ and $T_{a+b+1}$ to $T_{m+1}$ of the D-A converter $\mathbf{65}_a$. The data output from the data output terminal $U'_a$ is input to the data input terminal $T_{a+b+1}$ via the first terminal 73 and the third terminal 75 of the first switch 72, the third terminal 79 and the first terminal 77 of the second switch 76, and the input terminal $I_{a+b}$ and the output terminal $O_{a+b+1}$ of the output switching section 67.

At this time, the D-A converter $\mathbf{65}_a$ outputs potentials according to the data from the potential output terminals $T'_2$ to $T'_a$ and $T'_{a+b+1}$ to $T'_{m+1}$.

Therefore, the potential output from the D-A converter $\mathbf{65}_a$ with $POL_2$ at the high level and the potential output from the D-A converter $\mathbf{65}_a$ with $POL_2$ at the low level both are the same as in the second embodiment.

Furthermore, the voltage follower $\mathbf{66}_a$ is the same as in the second embodiment and thus the description thereof is omitted herein.

The below will describe states of the control signals $POL_1$, $POL_2$ and set potentials for the source lines. The output modes of $POL_1$, $POL_2$, and STB in the present embodiment are the same as those in the second embodiment (cf. FIGS. 17 and 18).

The frame A2 in which $POL_1$ is at the high level will be described with reference to FIG. 17. The control unit $\mathbf{3}_a$ makes the first rise of STB in the frame. The control unit $\mathbf{3}_a$ also raises $POL_1$ and $POL_2$ to the high level in conjunction with the rise of STB, as control in the select period of the first row (odd row). Thereafter, $POL_1$ is maintained at the high level in the frame A2. Furthermore, $POL_2$ alternates between the low level and the high level at every period of STB.

In the previous select period the first latch section 62 sequentially receives the data read indication signals from the shift register 61 to the signal input terminals $L_1$ to $L_a$ and $L_{a+b+1}$ to $L_m$ and reads and stores data of n pixels in one row.

With a change of STB to the high level, the D-A converter $\mathbf{65}_a$ keeps the outputs of the respective potential output terminals $T'_1$ to $T'_{m+1}$ in the high impedance state during a high-level duration of STB.

With the next change of STB to the low level, the second latch section 63 captures the data from the first latch section 62, using the data input terminals $Q_1$ to $Q_a$ and $Q_{a+b+1}$ to $Q_m$, and outputs the data from the data output terminals $Q'_1$ to $Q'_a$ and $Q'_{a+b+1}$ to $Q'_m$.

This data is input to the data input terminals $U_1$ to $U_a$ and $U_{a+b+1}$ to $U_m$ of the level shifter 64. The level shifter 64 performs the level shift of each data of the n pixels in one row and outputs the data after the level shift from the data output terminals $U'_1$ to $U'_a$ and $U'_{a+b+1}$ to $U'_m$.

Since $POL_2$ is at the high level at this time, the data output from the level shifter 64 are input to the data input terminals $T_1$ to $T_a$ and $T_{a+b+1}$ to $T_m$ of the D-A converter $\mathbf{65}_a$. The D-A converter $\mathbf{65}_a$ outputs potentials according to the data from the potential output terminals $T'_1$ to $T'_a$ and $T'_{a+b+1}$ to $T'_m$ corresponding to the respective data input terminals. At this time, $POL_1$ is at the high level. Therefore, the D-A converter $\mathbf{65}_a$ outputs positive potentials according to the data from the odd-numbered potential output terminals $T'_1$, $T'_3$, . . . , $T'_{a+b+1}$, . . . $T'_{m-1}$ from the left. Furthermore, it outputs negative potentials according to the data from the even-numbered potential output terminals $T'_2$, $T'_4$, . . . , $T'_{a+b+2}$, . . . $T'_m$ from the left.

The respective potentials output from the D-A converter $\mathbf{65}_a$ are input to the potential input terminals $W_1$ to $W_a$ and the data input terminals $W_{a+b+1}$ to $W_m$ of the voltage follower $\mathbf{66}_a$. Then the voltage follower $\mathbf{66}_a$ outputs potentials equal to the input potentials from the potential output terminals $D_1$ to $D_a$ and $D_{a+b+1}$ to $D_m$.

As a consequence, the potentials of the n source lines $S_1$ to $S_n$ are set, so that the potentials of the n pixel electrodes in the selected row become equal to the potentials of the left source lines as viewed from the viewer side. At this time, the odd-numbered source lines from the left have positive potentials and the even-numbered source lines from the left negative potentials. Therefore, the polarities of the pixels in the selected row are positive, negative, positive, negative, . . . from the left. At this time, the source line $S_{n+1}$ connected to the potential output terminal $D_{m+1}$ in the high impedance state is not used for the potential setting of the pixel electrodes.

In the select period of the first row the first latch section 62 reads data of one row in accordance with instructions from the shift register 61.

Subsequently, the control unit $\mathbf{3}_a$ makes a rise of STB and changes $POL_2$ to the low level in a duration in which STB is at the high level (cf. FIG. 17).

With a change of STB to the low level, the second latch section 63 captures the data from the first latch section 62, using the data input terminals $Q_1$ to $Q_a$ and $Q_{a+b+1}$ to $Q_m$, and outputs the data from the data output terminals $Q'_1$ to $Q'_a$ and $Q'_{a+b+1}$ to $Q'_m$.

This data is input to the data input terminals $U_1$ to $U_a$ and $U_{a+b+1}$ to $U_m$ of the level shifter 64. The level shifter 64 performs the level shift of each data of the n pixels in one row and outputs the data after the level shift from the data output terminals to $U'_a$ and $U'_{a+b+1}$ to $U'_m$.

Since $POL_2$ is at the low level at this time, the data output from the level shifter 64 is input to the data input terminals $T_2$ to $T_a$ and $T_{a+b+1}$ to $T_{m+1}$ of the D-A converter $\mathbf{65}_a$. The D-A converter $\mathbf{65}_a$ outputs potentials according to the data from the potential output terminals $T'_2$ to $T'_a$ and $T'_{a+b+1}$ to $T'_{m+1}$ corresponding to the respective data input terminals. At this time, $POL_1$ is at the high level. Therefore, the D-A converter $\mathbf{65}_a$ outputs negative potentials according to the data from the even-numbered potential output terminals $T'_2$, $T'_4$, . . . , $T_a$, $T'_{a+b+2}$, . . . $T'_m$ from the left. Furthermore, it outputs positive potentials according to the data from the odd-numbered potential output terminals $T'_3$, . . . , $T'_{a-1}$, $T'_{a+b+1}$, . . . $T'_{m+1}$ from the left.

The respective potentials output from the D-A converter $\mathbf{65}_a$ are input to the potential input terminals $W_2$ to $W_a$ and data input terminals $W_{a+b+1}$ to $W_{m+1}$ of the voltage follower $\mathbf{66}_a$. Then the voltage follower $\mathbf{66}_a$ outputs potentials equal to the input potentials from the potential output terminals $D_2$ to $D_a$ and $D_{a+b+1}$ to $D_{m+1}$.

As a consequence, the potentials of the n source lines $S_2$ to $S_{n+1}$ are set, so that the potentials of the n pixel electrodes in the selected row become equal to the potentials of the right source lines as viewed from the viewer side. At this time, the even-numbered source lines from the left have negative potentials and the odd-numbered source lines from the left positive potentials. Therefore, the polarities of the pixels in the selected row are negative, positive, negative, positive, . . . from the left. At this time, the source line $S_1$ connected to the potential output terminal $D_1$ in the high impedance state is not used for the potential setting of the pixel electrodes.

Thereafter, the operations in the select periods of the two rows as described above are repeatedly carried out in this frame A2. Accordingly, the polarities of the respective pixels in this frame A2 are as shown in FIG. 11.

Next, the frame B2 in which $POL_1$ is at the low level will be described with reference to FIG. 18. The control unit $\mathbf{3}_a$ makes the first rise of STB in the frame. The control unit $\mathbf{3}_a$ changes $POL_1$ to the low level and raises $POL_2$ to the high level in conjunction with the rise of STB, as control in the select period of the first row (odd row). Thereafter, $POL_1$ is maintained at the low level in the frame B2. Furthermore, $POL_2$ alternates between the low level and the high level at every period of STB.

In the previous select period, the first latch section 62 sequentially receives the data read indication signals from the shift register 61 through the signal input terminals $L_1$ to $L_a$ and $L_{a+b+1}$ to $L_m$ and reads and stores data of n pixels in one row.

With a change of STB to the high level, the D-A converter $\mathbf{65}_a$ keeps the outputs of the respective potential output terminals $T'_1$ to $T'_{m+1}$ in the high impedance state during a high-level duration of STB.

With the next change of STB to the low level, the second latch section 63 captures the data from the first latch section 62, using the data input terminals $Q_1$ to $Q_a$ and $Q_{a+b+1}$ to $Q_m$, and outputs the data from the data output terminals $Q'_1$ to $Q'_a$ and $Q'_{a+b+1}$ to $Q'_m$.

This data is input to the data input terminals $U_1$ to $U_a$ and $U_{a+b+1}$ to $U_m$ of the level shifter 64. The level shifter 64 performs the level shift of each data of the n pixels in one row and outputs the data after the level shift from the data output terminals $U'_1$ to $U'_a$ and $U'_{a+b+1}$ to $U_m$.

Since $POL_2$ is at the high level at this time, the data output from the level shifter 64 are input to the data input terminals $T_1$ to $T_a$ and $T_{a+b+1}$ to $T_m$ of the D-A converter $\mathbf{65}_a$. The D-A converter $\mathbf{65}_a$ outputs potentials according to the data from the potential output terminals $T'_1$ to $T'_a$ and $T'_{a+b+1}$ to $T'_m$ corresponding to the respective data input terminals. At this time, $POL_1$ is at the low level. Therefore, the D-A converter $\mathbf{65}_a$ outputs negative potentials according to the data from the odd-numbered potential output terminals $T'_1, T'_3, \ldots, T'_{a-1}, T'_{a+b+1}, \ldots T'_{m-1}$ from the left. Furthermore, it outputs positive potentials according to the data from the even-numbered potential output terminals $T'_2, T'_4, \ldots, T'_a, T'_{a+b+2}, \ldots T'_m$ from the left.

The respective potentials output from the D-A converter $\mathbf{65}_a$ are input to the potential input terminals $W_1$ to $W_a$ and data input terminals $W_{a+b+1}$ to $W_m$ of the voltage follower $\mathbf{66}_a$. Then the voltage follower $\mathbf{66}_a$ outputs potentials equal to the input potentials from the potential output terminals $D_1$ to $D_a$ and $D_{a+b+1}$ to $D_m$.

As a consequence, the potentials of the n source lines $S_1$ to $S_n$ are set, so that the potentials of the n pixel electrodes in the selected row become equal to the potentials of the left source lines as viewed from the viewer side. At this time, the odd-numbered source lines from the left have negative potentials and the even-numbered source lines from the left positive potentials. Therefore, the polarities of the pixels in the selected row are negative, positive, negative, positive, . . . from the left. At this time, the source line $S_{n+1}$ connected to the potential output terminal $D_{m+1}$ in the high impedance state is not used for the potential setting of the pixel electrodes.

In the select period of the first row the first latch section 62 reads data of one row in accordance with instructions from the shift register 61.

Subsequently, the control unit $\mathbf{3}_a$ makes a rise of STB and changes $POL_2$ to the low level in a high-level duration of STB (cf. FIG. 18).

With a change of STB to the low level, the second latch section 63 captures the data from the first latch section 62, using the data input terminals $Q'_1$ to $Q_a$ and $Q_{a+b+1}$ to $Q_m$, and outputs the data from the data output terminals $Q'_1$ to $Q'_a$ and $Q'_{a+b+1}$ to $Q'_m$.

This data is input to the data input terminals $U_1$ to $U_a$ and $U_{a+b+1}$ to $U_m$ of the level shifter 64. The level shifter 64 performs the level shift of each data of the n pixels in one row and outputs the data after the level shift from the data output terminals to $U'_a$ and $U'_{a+b+1}$ to $U'_m$.

Since $POL_2$ is at the low level at this time, the data output from the level shifter 64 is input to the data input terminals $T_2$ to $T_a$ and $T_{a+b+1}$ to $T_{m+1}$ of the D-A converter $\mathbf{65}_a$. The D-A converter $\mathbf{65}_a$ outputs potentials according to the data from the potential output terminals $T'_2$ to $T'_a$ and $T'_{a+b+1}$ to $T'_{m+1}$ corresponding to the respective data input terminals. At this time, $POL_1$ is at the low level. Therefore, the D-A converter $\mathbf{65}_a$ outputs positive potentials according to the data from the even-numbered potential output terminals $T'_2$, $T'_a$, $T'_{a+b+2}, \ldots T'_m$ from the left. Furthermore, it outputs negative potentials according to the data from the odd-numbered potential output terminals $T'_3, \ldots, T_{a-1}, T_{a+b+1}, \ldots T_{m+1}$ from the left.

The respective potentials output from the D-A converter $\mathbf{65}_a$ are input to the potential input terminals $W_2$ to $W_a$ and data input terminals $W_{a+b+1}$ to $W_{m+1}$ of the voltage follower $\mathbf{66}_a$. Then the voltage follower $\mathbf{66}_a$ outputs potentials equal to the input potentials from the potential output terminals $D_2$ to $D_a$ and $D_{a+b+1}$ to $D_{m+1}$.

As a consequence, the potentials of the n source lines $S_2$ to $S_{n+1}$ are set, so that the potentials of the n pixel electrodes in the selected row become equal to the potentials of the right source lines as viewed from the viewer side. At this time, the even-numbered source lines from the left have positive potentials and the odd-numbered source lines from the left negative potentials. Therefore, the polarities of the pixels in the selected row are positive, negative, positive, negative, . . . from the left. At this time, the source line $S_1$ connected to the potential output terminal $D_1$ in the high impedance state is not used for the potential setting of the pixel electrodes.

Thereafter, the operations in the select periods of the two rows described above are repeatedly carried out in this frame B2. Therefore, the polarities of the respective pixels in this frame B2 are as shown in FIG. 13.

The driving device $\mathbf{1}_a$ alternately performs the operation in the frame A2 and the operation in the frame B2 described above, on a frame-by-frame basis. Accordingly, the polarities of adjacent pixels become opposite to each other in each frame. Furthermore, the polarity varies frame by frame even in an identical pixel (cf. FIGS. 11 and 13).

In each frame the potentials of each source line are not varied across $V_{COM}$. Therefore, power consumption is reduced.

In the fifth embodiment, the LCD panel 20 can also be driven without connecting the potential output terminals in the central region ($D_{a+1}$ to $D_{a+b}$ in the above example) out of the plurality of potential output terminals of the driving device to any source line.

[Embodiment 6]

The sixth embodiment of the present invention can be illustrated as in FIG. 14. Namely, the driving device $\mathbf{1}_a$ receives supply of voltages from the power supply unit 4 and drives the LCD panel 20 under control of the control unit $\mathbf{3}_a$. The power supply unit 4 and the LCD panel 20 are the same as those in the first and second embodiments.

The control unit $\mathbf{3}_a$ is the same as in each of the second to fifth embodiments. Namely, the control unit $\mathbf{3}_a$ alternately changes the level of $POL_1$ between the high level and the low level on a frame-by-frame basis. The output modes of the control signals ($POL_2$, STB, SCLK, STH, etc.) except for $POL_1$ are the same as those in each of the first to fifth embodiments.

The connection configuration between the driving device $\mathbf{1}_a$ and the source lines $S_1$ to $S_{n+1}$ is the same as in each of the second to fifth embodiments and thus the description thereof is omitted herein.

The operation of the driving device $\mathbf{1}_a$ is the same as in the second to fifth embodiments. Namely, with $POL_2$ at the high level, potentials according to pixel values are output from the n potential output terminals except for $D_{m+1}$, out of the potential output terminals $D_1$ to $D_a$ and $D_{a+b+1}$ to $D_{m+1}$, and the output state of $D_{m+1}$ is kept in the high impedance state. With $POL_2$ at the low level, potentials according to pixel values are output from the n potential output terminals except for $D_1$, out of the potential output terminals $D_1$ to $D_a$ and $D_{a+b+1}$ to $D_{m+1}$, and the output state of $D_1$ is kept in the high impedance state.

With $POL_1$ at the high level, the driving device $\mathbf{1}_a$ outputs positive potentials according to pixel values from the odd-numbered potential output terminals from the left and outputs negative potentials according to pixel values from the even-numbered potential output terminals from the left. With $POL_1$ at the low level, the driving device $\mathbf{1}_a$ outputs negative potentials according to pixel values from the odd-numbered potential output terminals from the left and outputs positive potentials according to pixel values from the even-numbered potential output terminals from the left. However, either of the potential output terminals $D_1$, $D_{m+1}$ is brought into the high impedance state, depending upon the level of $POL_2$ as described above.

The potential output terminals $D_{a+1}$ to $D_{a+b}$ are maintained in the high impedance state, but the potential output terminals $D_{a+1}$, $D_{a+b}$ can be set at potentials according to data in some occasions. However, no source line is connected to the potential output terminals $D_{a+1}$, $D_{a+b}$, and thus the potentials of the source lines are never set by the potential output terminals $D_{a+1}$, $D_{a+b}$.

Figure 25:
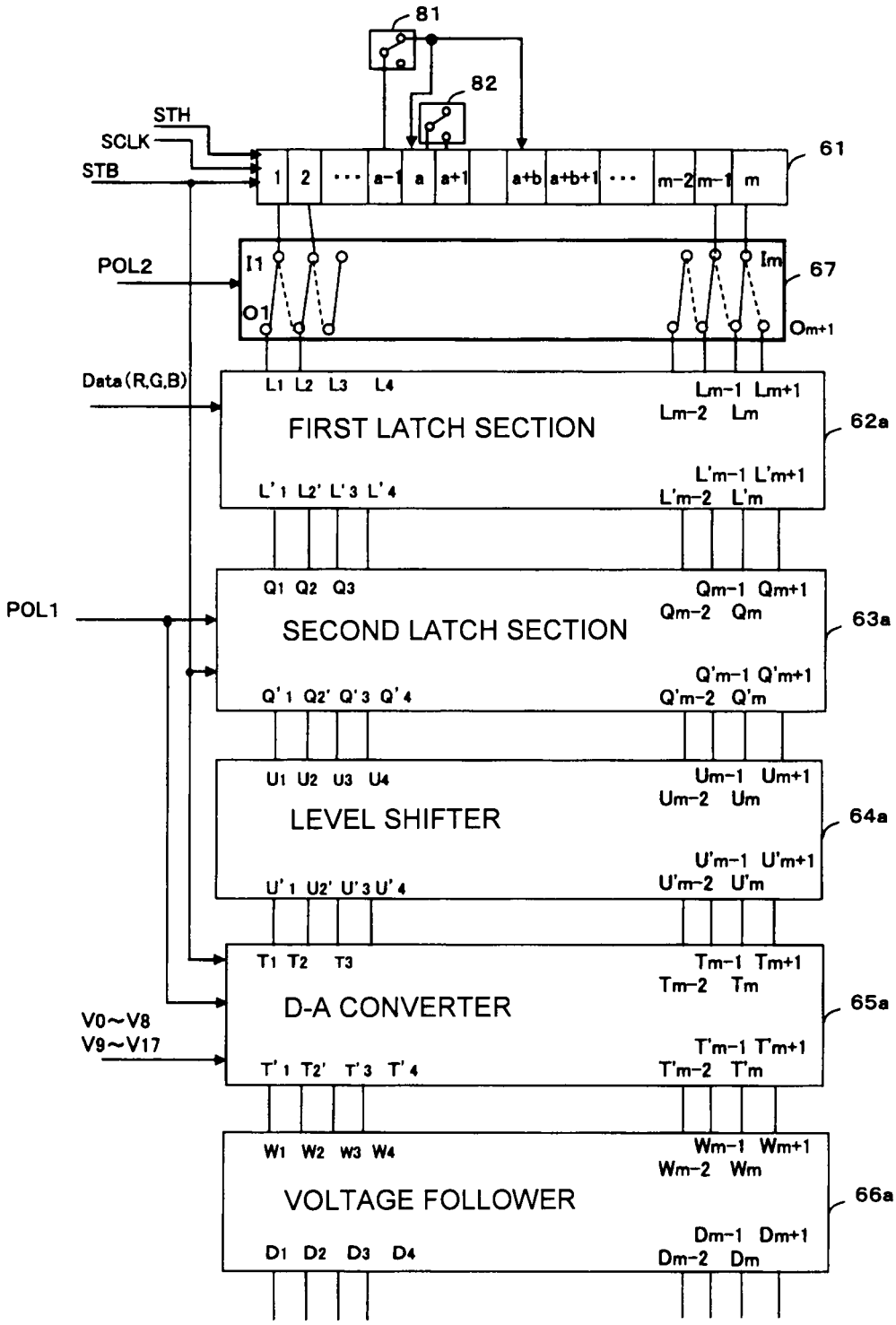
FIG. 25 is an explanatory drawing showing a configuration example of the driving device $\mathbf{1}_a$ in the sixth embodiment.

However, the configuration of the driving device $\mathbf{1}_a$ is different from that in each of the second to fifth embodiments. FIG. 25 is an explanatory drawing showing a configuration example of the driving device $\mathbf{1}_a$ in the sixth embodiment. The same constituent elements as in the first embodiment will be denoted by the same reference signs as those in FIGS. 7 and 8. Furthermore, the same constituent elements as in the second embodiment will be denoted by the same reference signs as those in FIG. 15.

The driving device $\mathbf{1}_a$ in the sixth embodiment is provided with a shift register 61, an output switching section 67, a first latch section $\mathbf{62}_a$, a second latch section $\mathbf{63}_a$, a level shifter $\mathbf{64}_a$, a D-A converter $\mathbf{65}_a$, and a voltage follower $\mathbf{66}_a$. The present embodiment is not provided with the first changeover switch 72 and the second changeover switch 76 (cf. FIG. 8).

The shift register 61 has m signal output portions and in principle, each signal output portion sends a carry signal to its adjacent signal output portion after output of a data read indication signal from its signal output terminal. However, the shift register 61 of the present embodiment is provided with a first switch 81 for control of carry signal (hereinafter referred to simply as switch 81) and a second switch 82 for control of carry signal ((hereinafter referred to simply as switch 82). The switches 81, 82 define modes of transmission and reception of the carry signal.

In the sixth embodiment, the consecutive signal output terminals from the first to the a-th from the left in the shift register 61 will be referred to as a first output terminal group. Furthermore, the consecutive signal output terminals from the (a+1)th to the (a+b)th from the left will be referred to as a second output terminal group. The consecutive signal output terminals from the (a+b+1)th to the m-th from the left will be referred to as a third output terminal group. The number of data output terminals belonging to the first output terminal group is a, the number of data output terminals belonging to the second output terminal group is b, and the number of data output terminals belonging to the third output terminal group is c. When the number of pixels in one row (or the number of pixel electrodes 21 in one row) in the LCD panel 20 is assumed to be n, n=a+c.

The switch 81 is a switch that switches a destination of the carry signal sent from the (a−1)th signal output portion from the left after output of the data read indication signal therefrom, either to both of the a-th and the (a+b)th signal output portions from the left or to none of the other signal output portions. In the present embodiment, the switch 81 is set so as to simultaneously transmit the carry signal from the (a−1)th signal output portion from the left, to the a-th and the (a+b)th signal output portions from the left.

The switch 82 is a switch that switches a destination of the carry signal sent from the a-th signal output portion from the left after output of the data read indication signal therefrom, either to the (a+1)th signal output portion from the left or to none of the other signal output portions. Namely, it is a switch to select either of two ways of drives, the normal drive and the skip drive without use of the central region. In the present embodiment, in accordance with a skip control signal from the control unit 3, the switch 82 is set so as not to transmit the carry signal from the a-th signal output portion from the left, to the other signal output portions.

Accordingly, in the shift register 61 of the present embodiment, the first to (a−1)th signal output portions from the left sequentially send the carry signal, whereby the signal output portions sequentially output their respective data read indication signals. The carry signal output after output of the data read indication signals from the signal output portions up to the (a−1)th is simultaneously transmitted through the switch 81 to the a-th signal output portion from the left and to the (a+b)th signal output portion from the left. Therefore, after the (a−1)th signal output portion from the left, the a-th signal output portion from the left and the (a+b)th signal output portion from the left simultaneously output their data read indication signals.

Since the carry signal from the a-th signal output portion from the left is not transmitted to the other signal output portions, each of the (a+1)th to (a+b−1)th signal output portions from the left outputs no data read indication signal.

After the (a+b)th signal output portion from the left outputs its data read indication signal, the carry signal is sequentially transmitted up to the m-th signal output portion from the left. Therefore, the signal output portions from the (a+b)th to the m-th from the left sequentially output their respective data read indication signals.

The output switching section 67 is the same as in each of the first to fifth embodiments. In the present embodiment, the input terminals $I_1$ to $I_m$ of the output switching section 67 are connected in order to the respective signal output terminals of the m signal output portions in the shift register 61.

The first latch section $\mathbf{62}_a$ is provided with (m+1) signal input terminals $L_1$ to $L_{m+1}$ corresponding to the (m+1) output terminals of the output switching section 67 and with (m+1) data output terminals $L'_1$ to $L'_{m+1}$ as the first latch section $\mathbf{62}_a$ in the second embodiment is. When k is assumed to be each value from 1 to m+1, the k-th output terminal from the left in the output switching section 67 is connected to the corresponding signal input terminal $L_k$.

In the present embodiment, when the data read indication signal is input to one or more signal input terminals out of the (m+1) signal input terminals $L_1$ to $L_{m+1}$, the first latch section $\mathbf{62}_a$ reads and stores data of one pixel according to the timing of input of the data read indication signal out of data (pixel values) of n pixels in one row. The data of n pixels in one row are sequentially input in time with input times of the data read indication signals from the outside.

For example, concerning the first to (a−1)th signal output terminals from the left and the (a+b+1)th to m-th signal output terminals from the left in the shift register 61, each of them has the output timing of the data read indication signal different from those of the other signal output terminals. Therefore, the data read indication signals output from these signal output terminals are input at different times to the signal input terminals of the first latch section $\mathbf{62}_a$ and the first latch section $\mathbf{62}_a$ reads and stores data of one pixel at every input of the data read indication signal. Then the data is taken into the second latch section $\mathbf{63}_a$ through the data output terminal corresponding to the signal input terminal having received the data read indication signal.

The a-th and (a+b)th signal output terminals from the left in the shift register 61 simultaneously output their data read indication signals. Therefore, the first latch section $\mathbf{62}_a$ simultaneously receives the two data read indication signals through two signal input terminals. For this reason, the first latch section $\mathbf{62}_a$ redundantly reads and stores two pieces of data of one pixel according to this signal input timing. Then the data are taken into the second latch section $\mathbf{63}_a$ through two data output terminals corresponding to the two signal input terminals. For example, when the data read indication signals are simultaneously input to the signal input portions $L_a$, $L_{a+b}$, the first latch section $\mathbf{62}_a$ redundantly reads and stores two pieces of data of the a-th pixel in one row. Then the data are taken into the second latch section $\mathbf{63}_a$ through the data output terminals $L'_a$, $L'_{a+b}$. When attention is focused on the number of data herein, the number of data input to the input terminals of the output switching section 67 is n+1. Namely, the number of data is the sum of the number of data from the first to the a-th (a), the number of data from the (a+b+1)th to the m-th (c), and one piece of the same data as the a-th input, to the (a+b)th, a+c+1=n+1.

The second latch section $\mathbf{63}_a$ is the same as in the second embodiment and has (m+1) data input terminals $Q_1$ to $Q_{m+1}$ and (m+1) data output terminals $Q'_1$ to $Q'_{m+1}$. The second latch section $\mathbf{63}_a$ captures data from the first latch section $\mathbf{62}_a$ through the data output terminals of the first latch section $\mathbf{62}_a$ corresponding to the signal input terminals of the first latch section $\mathbf{62}_a$ having received the data read indication signals and through the data input terminals corresponding to the data output terminals. Then it outputs the data from the data output terminals corresponding to the data input terminals used in the data capture. For example, concerning the data captured by the first latch section $\mathbf{62}_a$ with input of the data read indication signal to the signal input terminal $L_1$ of the first latch section $\mathbf{62}_a$, the second latch section $\mathbf{63}_a$ captures the data from the first latch section $\mathbf{62}_a$ through the data output terminal $L'_1$ corresponding to the signal input terminal $L_1$ and through the data input terminal $Q_1$. Then it outputs the data through the data output terminal $Q'_1$. The same also applies to the other data.

The level shifter $\mathbf{64}_a$ is the same as in the second embodiment and has (m+1) data input terminals $U_1$ to $U_{m+1}$ corresponding to the data output terminals $Q'_1$ to $Q'_{m+1}$ of the second latch section $\mathbf{63}_a$, and (m+1) data output terminals $U'_1$ to $U'_{m+1}$. The data output from the data output terminals of the second latch section $\mathbf{63}_a$ are input to the corresponding data input terminals in the level shifter $\mathbf{64}_a$. The level shifter $\mathbf{64}_a$ performs the level shift of the data and outputs the level-shifted data from the data output terminals corresponding to the data input terminals.

The D-A converter $\mathbf{65}_a$ is the same as in the second embodiment and has (m+1) data input terminals $T_1$ to $T_{m+1}$ corresponding to the data output terminals $U'_1$ to $U'_{m+1}$ of the level shifter, and (m+1) potential output terminals $T'_1$ to $T'_{m+1}$. The data output from the data output terminals of the level shifter $\mathbf{64}_a$ are input to the corresponding data input terminals in the D-A converter $\mathbf{65}_a$. The D-A converter $\mathbf{65}_a$ outputs potentials according to the data from the potential output terminals corresponding to the data input terminals.

The relationship between $POL_1$ input into the D-A converter $\mathbf{65}_a$ and the polarities of potentials output from the potential output terminals thereof is the same as in the second embodiment and others, and thus the description thereof is omitted herein.

The voltage follower $\mathbf{66}_a$ is the same as in the second embodiment and others and thus the description thereof is omitted herein.

The below will describe states of the control signals $POL_1$, $POL_2$ and set potentials for the source lines. The output modes of $POL_1$, $POL_2$, and STB in the present embodiment are the same as those in the second embodiment (cf. FIGS. 17 and 18).

The frame A2 in which $POL_1$ is at the high level will be described with reference to FIG. 17. The control unit $\mathbf{3}_a$ makes the first rise of STB in the frame. The control unit $\mathbf{3}_a$ also raises $POL_1$ and $POL_2$ to the high level in conjunction with the rise of STB, as control in the select period of the first row. In the frame A2, $POL_1$ is maintained thereafter at the high level. $POL_2$ alternates between the low level and the high level at every period of STB.

The shift register 61 outputs the data read indication signals from the respective signal output terminals from the first to the a-th from the left and from the (a+b)th to the m-th from the left. Since $POL_2$ is at the high level at this time, each input terminal $I_k$ of the output switching section 67 is connected to the output terminal $O_k$. Therefore, the data read indication signals are input to the signal input terminals $L_1$ to $L_a$ and $L_{a+b}$ to $L_m$ of the first latch section $\mathbf{62}_a$ and the first latch section $\mathbf{62}_a$ reads and stores data of n pixels in one row. However, since the a-th and the (a+b)th signal output terminals from the left in the shift register 61 simultaneously output the data read indication signals, the data read indication signals are simultaneously input to the signal input terminals $L_a$, $L_{a+b}$ of the first latch section $\mathbf{62}_a$ and at this time, the first latch section $\mathbf{62}_a$ redundantly reads and stores the data of the a-th pixel from the left in one row.

In the next select period, the second latch section $\mathbf{63}_a$ reads the data of the respective pixels in one row stored in the first latch section $\mathbf{62}_a$, and the second latch section $\mathbf{63}_a$ outputs the data. Specifically, after STB is changed to the high level at the time of switching of the select period and further changed to the low level, the second latch section $\mathbf{63}_a$ reads the data of one row. The second latch section $\mathbf{63}_a$ captures n pieces of data of one row from the first latch section $\mathbf{62}_a$ through the data output terminals $L'_1$ to $L'_a$ and $L'_{a+b}$ to $L'_m$ corresponding to the signal input terminals of the first latch section $\mathbf{62}_a$ having received the data read indication signals and through the data input terminals $Q_1$ to $Q_a$ and $Q_{a+b}$ to $Q_m$ of the second latch section $\mathbf{63}_a$. At this time, the data captured through the data input terminals $Q_a$, $Q_{a+b}$ are data of the same pixel and thus are redundant.

The respective pieces of data output from the second latch section $\mathbf{63}_a$ are input to the data input terminals $U_1$ to $U_a$ and $U_{a+b}$ to $U_m$ of the level shifter $\mathbf{64}_a$. The level shifter $\mathbf{64}_a$ performs the level shift of the data and outputs the data after the level shift from the data output terminals $U'_1$ to $U'_a$ and $U'_{a+b}$ to $U'_m$ corresponding to the respective data input terminals.

Then the data output from the level shifter $\mathbf{64}_a$ are input to the data input terminals $T_1$ to $T_a$ and $T_{a+b}$ to $T_m$ of the D-A converter $\mathbf{65}_a$. The D-A converter $\mathbf{65}_a$ outputs potentials according to the data from the potential output terminals $T'_1$ to $T'_a$ and $T'_{a+b}$ to $T'_m$ corresponding to the respective data input terminals. At this time, $POL_1$ is at the high level. Therefore, the D-A converter $\mathbf{65}_a$ outputs positive potentials according to the data from the odd-numbered potential output terminals $T'_1, T'_3, \ldots, T'_{a-1}, T'_{a+b+1}, \ldots T'_{m-1}$ from the left. Furthermore, it outputs negative potentials according to the data from the even-numbered potential output terminals $T'_2, T'_4, \ldots, T'_a, T'_{a+b}, T'_{a+b+2}, \ldots T'_m$ from the left.

The respective potentials output from the D-A converter $\mathbf{65}_a$ are input to the potential input terminals $W_1$ to $W_a$ and the data input terminals $W_{a+b}$ to $W_m$ of the voltage follower $\mathbf{66}_a$. Then the voltage follower $\mathbf{66}_a$ outputs potentials equal to the input potentials from the potential output terminals $D_1$ to $D_a$ and $D_{a+b}$ to $D_m$. However, since no source line is connected to the potential output terminal $D_{a+b}$, the potential output terminal $D_{a+b}$ is not used for the potential setting of the source lines. The potential output terminal $D_a$ outputs the potential equal to that of the potential output terminal $D_{a+b}$ and the source line connected to the potential output terminal $D_a$ sets the potential of the a-th pixel electrode from the left.

By the operation as described above, the potentials of the n source lines $S_1$ to $S_n$ are set, so that the potentials of the n pixel electrodes in the selected row become equal to the potentials of the left source lines as viewed from the viewer side. At this time, the odd-numbered source lines from the left have positive potentials and the even-numbered source lines from the left negative potentials. Therefore, the polarities of the pixels in the selected row are positive, negative, positive, negative, . . . from the left. At this time, the source line $S_{n+1}$ connected to the potential output terminal $D_{m+1}$ in the high impedance state is not used for the potential setting of the pixel electrodes.

The above description illustrated the case where the potentials were set for the respective source lines, based on the data captured by the first latch section during the high-level duration of $POL_2$. The below will describe the case where potentials are set for the respective source lines, based on data captured by the first latch section during a low-level duration of $POL_2$.

The shift register 61 outputs the data read indication signals from the respective signal output terminals from the first to the a-th from the left and from the (a+b)th to the m-th from the left. At this time, since $POL_2$ is at the low level, each input terminal $I_k$ of the output switching section 67 is connected to the output terminal $O_{k+1}$. Therefore, the data read indication signals are input to the signal input terminals $L_2$ to $L_{a+1}$ and $L_{a+b+1}$ to $L_{m+1}$ of the first latch section $\mathbf{62}_a$ and the first latch section $\mathbf{62}_a$ reads and stores data of n pixels in one row. However, since the a-th and (a+b)th signal output terminals from the left in the shift register 61 simultaneously output their data read indication signals, the data read indication signals are simultaneously input to the signal input terminals $L_{a+1}, L_{a+b+1}$ of the first latch section $\mathbf{62}_a$, and at this time, the first latch section $\mathbf{62}_a$ redundantly reads and stores data of the a-th pixel from the left in one row.

In the next select period the second latch section $\mathbf{63}_a$ reads the data of the respective pixels in one row stored in the first latch section $\mathbf{62}_a$ and the second latch section $\mathbf{63}_a$ outputs the data. The second latch section $\mathbf{63}_a$ captures the n pieces of data of one row from the first latch section $\mathbf{62}_a$, through the data output terminals $L'_2$ to $L'_{a+1}$ and $L'_{a+b+1}$ to $L'_{m+1}$ corresponding to the signal input terminals of the first latch section $\mathbf{62}_a$ having received the data read indication signals and through the data input the data captured using the data input terminals $Q_{a+1}, Q_{a+b+1}$ are data of the same pixel and thus are redundant.

The respective pieces of data output from the second latch section $\mathbf{63}_a$ are input to the data input terminals $U_2$ to $U_{a+1}$ and $U_{a+b+1}$ to $U_{m+1}$ of the level shifter $\mathbf{64}_a$. The level shifter $\mathbf{64}_a$ performs the level shift of the data and outputs the data after the level shift from the data output terminals $U'_2$ to $U'_{a+1}$ and $U'_{a+b+1}$ to $U'_{m+1}$ corresponding to the respective data input terminals.

Then the data output from the level shifter $\mathbf{64}_a$ are input to the data input terminals $T_2$ to $T_{a+1}$ and $T_{a+b+1}$ to $T_{m+1}$ of the D-A converter $\mathbf{65}_a$. The D-A converter $\mathbf{65}_a$ outputs potentials according to the data from the potential output terminals $T'_2$ to $T'_{a+1}$ and $T_{a+b+1}$ to $T_{m+1}$ corresponding to the respective data input terminals. At this time, $POL_1$ is at the high level. Therefore, the D-A converter $\mathbf{65}_a$ outputs negative potentials according to the data from the even-numbered potential output terminals $T'_2, T'_4, \ldots, T'_a, T'_{a+b}, T'_{a+b+2}, \ldots T'_m$ from the left. Furthermore, it outputs positive potentials according to the data from the odd-numbered potential output terminals $T'_3, \ldots, T'_{a+1}, T'_{a+b+1}, \ldots T'_{m+1}$ from the left.

The respective potentials output from the D-A converter $\mathbf{65}_a$ are input to the potential input terminals $W_2$ to $W_{a+1}$ and the data input terminals $W_{a+b+1}$ to $W_{m+1}$ of the voltage follower $\mathbf{66}_a$. Then the voltage follower $\mathbf{66}_a$ outputs potentials equal to the input potentials from the potential output terminals $D_2$ to $D_{a+1}$ and $D_{a+b+1}$ to $D_{m+1}$. However, since no source line is connected to the potential output terminal $D_{a+1}$, the potential output terminal $D_{a+1}$ is not used for the potential setting of the source lines. The potential output terminal $D_{a+b+1}$ outputs the potential equal to that of the potential output terminal $D_{a+1}$ and the source line connected to the potential output terminal $D_{a+b+1}$ sets the potential of the a-th pixel electrode from the left.

By the operation as described above, the potentials of the n source lines $S_2$ to $S_{n+1}$ are set, so that the potentials of the n pixel electrodes in the selected row become equal to the potentials of the right source lines as viewed from the viewer side. At this time, the even-numbered source lines from the left have negative potentials and the odd-numbered source lines from the left positive potentials. Therefore, the polarities of the pixels in the selected row are negative, positive, negative, positive, . . . from the left. At this time, the source line $S_1$ connected to the potential output terminal $D_1$ in the high impedance state is not used for the potential setting of the pixel electrodes.

Since $POL_2$ is switched at every period of STB, the polarities of adjacent pixels become opposite to each other in the frame A2.

FIG. 18 shows the example of changes of STB, $POL_1$, and $POL_2$ output from the control unit $\mathbf{3}_a$ to the driving device $\mathbf{1}_a$. FIG. 18 shows the control signals in the frame B2 in which $POL_1$ is at the low level.

The operation up to the input of data into the D-A converter $\mathbf{65}_a$ in the frame B2 is the same as in the case of the frame A2. Since $POL_1$ is at the low level in the frame B2, the operation in the frame B2 is different only in that the polarities of the potentials output as potentials according to data from the D-A converter $\mathbf{65}_a$ are inverted from those in the frame A2.

In the frame B2, therefore, the polarities of adjacent pixels are also opposite to each other.

Since the driving device $\mathbf{1}_a$ alternately repeats the operation in the frame A2 and the operation in the frame B2, the polarities of the respective pixels in the LCD panel 20 are inverted frame by frame.

In either of the frames A2, B2, the potentials of each source line are not varied across $V_{COM}$ because of the operation as described above. Therefore, power consumption is reduced.

In the sixth embodiment, the LCD panel 20 can also be driven without connecting the potential output terminals in the central region ($D_{a+1}$ to $D_{a+b}$ in the above example) out of the plurality of potential output terminals of the driving device, to any source line.

[Embodiment 7]

The seventh embodiment of the present invention can be illustrated as in FIG. 14. Namely, the driving device $\mathbf{1}_a$ receives supply of voltages from the power supply unit 4 and drives the LCD panel 20 under control of the control unit $\mathbf{3}_a$. The power supply unit 4 and the LCD panel 20 are the same as those in the first and second embodiments.

The control unit $\mathbf{3}_a$ is the same as in each of the second to sixth embodiments. Namely, the control unit $\mathbf{3}_a$ alternately changes the level of $POL_1$ between the high level and the low level on a frame-by-frame basis. The output modes of the control signals ($POL_2$, STB, SCLK, STH, etc.) except for $POL_1$ are the same as in each of the first to sixth embodiments.

The connection configuration between the driving device $\mathbf{1}_a$ and the source lines $S_1$ to $S_{n+1}$ is the same as in each of the second to sixth embodiments and thus the description thereof is omitted herein.

Figure 26:
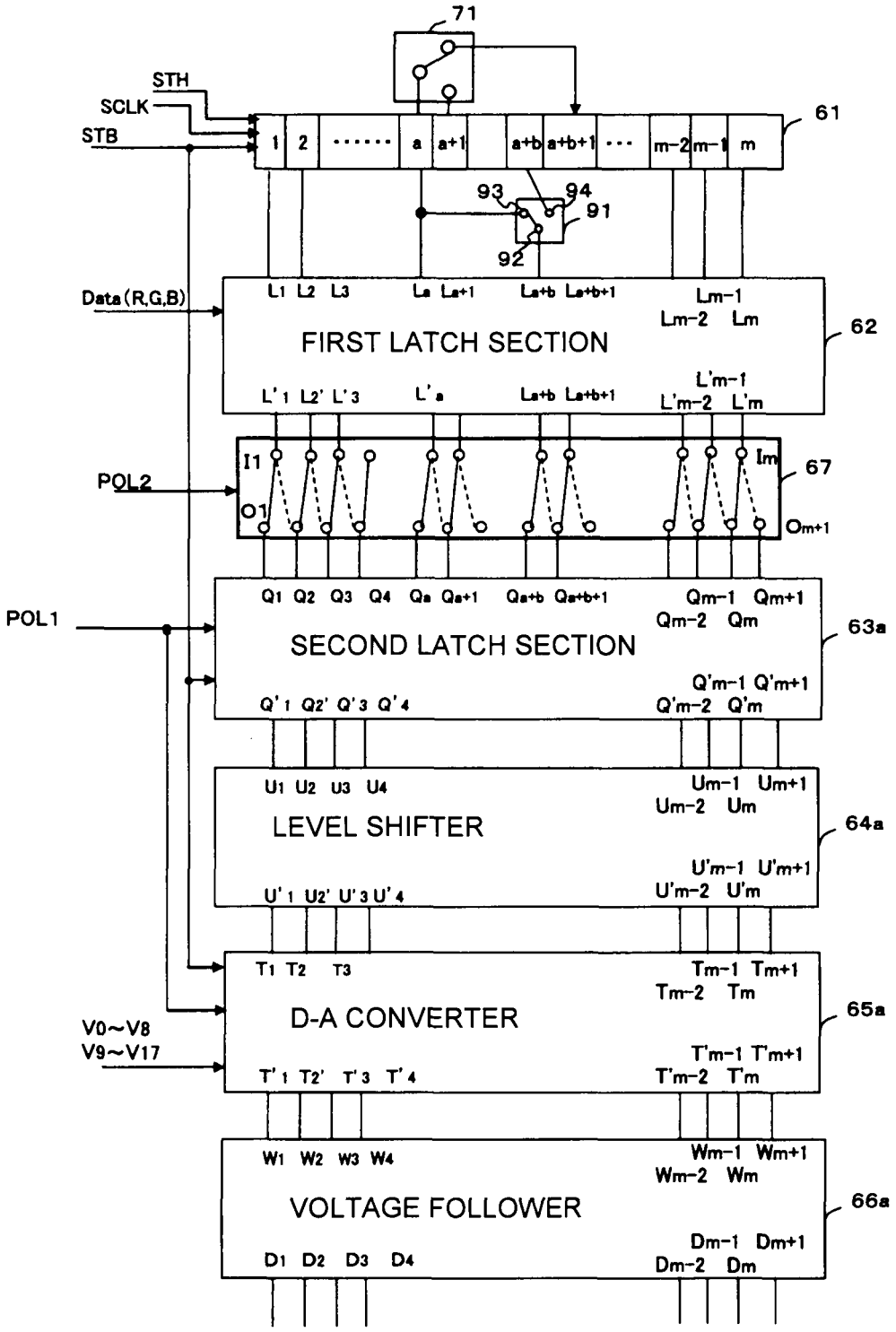
FIG. 26 is an explanatory drawing showing a configuration example of the driving device $\mathbf{1}_a$ in the seventh embodiment.

The operation of the driving device $\mathbf{1}_a$ is the same as in the sixth embodiment. However, the configuration of the driving device $\mathbf{1}_a$ is different from that in the sixth embodiment. FIG. 26 is an explanatory drawing showing a configuration example of the driving device $\mathbf{1}_a$ in the seventh embodiment. The same constituent elements as in the first embodiment will be denoted by the same reference signs as those in FIGS. 7 and 8. Furthermore, the same constituent elements as in the second embodiment will be denoted by the same reference signs as those in FIG. 15.

The driving device $\mathbf{1}_a$ in the seventh embodiment is provided with a shift register 61, a signal path control switch 91 (hereinafter referred to simply as switch 91), a first latch section 62, an output switching section 67, a second latch section $\mathbf{63}_a$, a level shifter $\mathbf{64}_a$, a D-A converter $\mathbf{65}_a$, and a voltage follower $\mathbf{66}_a$. The present embodiment is not provided with the first changeover switch 72 and the second changeover switch 76 (cf. FIG. 8).

The shift register 61 has a shift register switch 71 and performs the same operation as in the first embodiment. Namely, the shift register 61 has m signal output terminals, among which the signal output terminals other than the signal output terminals from the (a+1)th to the (a+b)th from the left sequentially output their data read indication signals.

The switch 91 has a first terminal 92, a second terminal 93, and a third terminal 94. The first terminal 92 is connected to either of the second terminal 93 and the third terminal 94. In the present embodiment the first terminal 92 is set so as to be connected to the second terminal 93. The first terminal 92 is connected to the (a+b)th signal input terminal $L_{a+b}$ from the left in the first latch section 62. The second terminal 93 is connected to the a-th signal output terminal from the left in the shift register 61. The third terminal 94 is connected to the (a+b)th signal output terminal from the left in the shift register 61.

The signal output terminals from the first to the a-th and from the (a+b+1)th to the m-th from the left in the shift register 61 are connected in order to the respective signal input terminals $L_1$ to $L_a$ and $L_{a+b+1}$ to $L_m$ from the first to the a-th and from the (a+b+1)th to the m-th from the left in the first latch section.

Therefore, the a-th signal output terminal from the left in the shift register 61 is connected to the signal input terminal $L_a$ of the first latch section 62 and is also connected through the switch 91 to the signal input terminal $L_{a+b}$. Namely, the data read indication signal output from the a-th signal output terminal from the left in the shift register 61 is simultaneously input to the signal input terminal $L_a$ and to the signal input terminal $L_{a+b}$.

The first latch section 62 is provided with m signal input terminals $L_1$ to $L_m$ corresponding to the m output terminals of the shift register 61, and with m data output terminals $L'_1$ to $L'_m$ as the first latch section 62 in the first embodiment is.

In the present embodiment, when the data read indication signal is input to one or more signal input terminals out of the m signal input terminals $L_1$ to $L_m$, the first latch section 62 reads and stores data of one pixel according to the input timing of the data read indication signal out of data (pixel values) of n pixels in one row. This is the same as in the case of the first latch section $\mathbf{62}_a$ in the sixth embodiment.

For example, the data read indication signal is simultaneously input to the signal input terminals $L_a$, $L_{a+b}$ of the first latch section 62. Therefore, the first latch section 62 redundantly reads and stores two pieces of data of one pixel according to this signal input timing. Then the data is taken into the second latch section $\mathbf{63}_a$ from the data output terminals $L_a$, $L'_{a+b}$.

The data read indication signals are input at individual times to the signal input terminals except for the signal input terminals $L_a$, $L_{a+b}$.

The output switching section 67 is the same as in each of the first to sixth embodiments. In the present embodiment, the respective input terminals $I_1$ to $I_m$ of the output switching section 67 are connected in order to the m data output terminals $L'_1$ to $L'_m$ of the first latch section 62.

The second latch section $\mathbf{63}_a$ is the same as in the second embodiment. In the present embodiment, the second latch section $\mathbf{63}_a$ has (m+1) data input terminals $Q_1$ to $Q_{m+1}$ individually connected to the output terminals $O_1$ to $O_{m+1}$ of the output switching section 67 and (m+1) data output terminals $Q'_1$ to $Q'_{m+1}$ corresponding to the respective data input terminals. The second latch section $\mathbf{63}_a$ reads the data in the first latch section through the data input terminals connected to the output terminals of the output switching section 67 becoming connected to the data output terminals of the first latch section corresponding to the respective signal input terminals having received the data read signals. For example, a data read signal is input to the signal input terminal $L_1$ of the first latch section. The data output terminal $L'_1$ corresponding to the signal input terminal $L_1$ is assumed herein to be connected to the output terminal $O_1$ through the input terminal $I_1$ of the output switching section 67. At this time, the second latch section $\mathbf{63}_a$ captures the data through the data input terminal $Q_1$ corresponding to the output terminal $O_1$ and through the data output terminal $L'_1$ of the first latch section 62. Then the second latch section $\mathbf{63}_a$ outputs the data from the data output terminal $Q'_1$ corresponding to the data input terminal $Q_1$. The same also applies to the other data.

The level shifter $\mathbf{64}_a$, the D-A converter $\mathbf{65}_a$, and the voltage follower $\mathbf{66}_a$ are the same as those in the second embodiment and the sixth embodiment, and thus the description thereof is omitted herein.

The below will describe states of the control signals $POL_1$, $POL_2$ and set potentials for the source lines. The output modes of $POL_1$, $POL_2$, and STB in the present embodiment are the same as those in the second embodiment (cf. FIGS. 17 and 18).

The frame A2 in which $POL_1$ is at the high level will be described with reference to FIG. 17. The control unit $\mathbf{3}_a$ makes the first rise of STB in the frame. The control unit $\mathbf{3}_a$ also raises $POL_1$ and $POL_2$ to the high level in conjunction with the rise of STB, as control in the select period of the first row. In the frame A2, $POL_1$ is maintained thereafter at the high level. $POL_2$ alternates between the low level and the high level at every period of STB.

The shift register 61 sequentially outputs the data read indication signals from the respective signal output terminals from the first to the a-th from the left and from the (a+b+1)th to the m-th from the left. The data read indication signals are sequentially input to the signal input terminals $L_1$ to $L_a$ and $L_{a+b}$ to $L_m$ of the first latch section 62. As a result, the first latch section 62 reads and stores data of n pixels in one row. However, the data read indication signal output from the a-th signal output terminal from the left in the shift register 61 is simultaneously input to the signal input terminals $L_a$, $L_{a+b}$ of the first latch section 62. At this time, the first latch section 62 redundantly reads and stores data of the a-th pixel from the left in one row. When attention is focused herein on the number of data, the number of data input to the input terminals of the output switching section 67 is n+1. Namely, the number of data herein is the sum of the number of data from the first to the a-th (a), the number of data from the (a+b+1)th to the m-th (c), and one piece of the same data as the a-th input, to the (a+b)th, a+c+1=n+1.

In the next select period, the second latch section $\mathbf{63}_a$ reads the data of the respective pixels in one row stored in the first latch section 62 and the second latch section $\mathbf{63}_a$ outputs the data. Specifically, after STB is switched to the high level at the time of switching of the select period and further switched to the low level, the second latch section $\mathbf{63}_a$ reads the data of one row. At this time, $POL_2$ is at the high level and the input terminal $I_k$ of the output switching section 67 is connected to $O_k$. Therefore, the second latch section $\mathbf{63}_a$ captures the n pieces of data of one row from the first latch section 62 through the data output terminals $L'_1$ to $L'_a$, $L'_{a+b}$ to $L'_m$ of the first latch section 62 and through the data input terminals $Q_1$ to $Q_a$, $Q_{a+b}$ to $Q_m$ of the second latch section $\mathbf{63}_a$. At this time, the data captured using the data input terminals $Q_a$, $Q_{a+b}$ are data of the same pixel and thus are redundant.

The respective pieces of data output from the second latch section $\mathbf{63}_a$ are input to the data input terminals $U_1$ to $U_a$ and $U_{a+b}$ to $U_m$ of the level shifter $\mathbf{64}_a$. The level shifter $\mathbf{64}_a$ performs the level shift of the data and outputs the data after the level shift from the data output terminals $U'_1$ to $U'_a$ and $U'_{a+b}$ to $U'_m$ corresponding to the respective data input terminals.

Then the data output from the level shifter $\mathbf{64}_a$ are input to the data input terminals $T_1$ to $T_a$ and $T_{a+b}$ to $T_m$ of the D-A converter $\mathbf{65}_a$. The D-A converter $\mathbf{65}_a$ outputs potentials according to the data from the potential output terminals $T'_1$ to $T'_a$ and $T'_{a+b}$ to $T'_m$ corresponding to the respective data input terminals. At this time, $POL_1$ is at the high level. Therefore, the D-A converter $\mathbf{65}_a$ outputs positive potentials according to the data from the odd-numbered potential output terminals $T'_1, T'_3, \ldots, T'_{a-1}, T'_{a+b+1}, \ldots T'_{m-1}$ from the left. Furthermore, it outputs negative potentials according to the data from the even-numbered potential output terminals $T'_2, T'_4, \ldots, T_a, T'_{a+b}, T'_{a+b+2}, \ldots T'_m$ from the left.

The respective potentials output from the D-A converter $\mathbf{65}_a$ are input to the potential input terminals $W_1$ to $W_a$ and the data input terminals $W_{a+b}$ to $W_m$ of the voltage follower $\mathbf{66}_a$. Then the voltage follower $\mathbf{66}_a$ outputs potentials equal to the input potentials from the potential output terminals $D_1$ to $D_a$ and $D_{a+b}$ to $D_m$. However, since no source line is connected to the potential output terminal $D_{a+b}$, the potential output terminal $D_{a+b}$ is not used for the potential setting of the source lines. The potential output terminal $D_a$ outputs the potential equal to that of the potential output terminal $D_{a+b}$ and the source line connected to the potential output terminal $D_a$ sets the potential of the a-th pixel electrode from the left.

By the operation described above, the potentials of the n source lines $S_1$ to $S_n$ are set, so that the potentials of the n pixel electrodes in the selected row become equal to the potentials of the left source lines as viewed from the viewer side. At this time, the odd-numbered source lines from the left have positive potentials and the even-numbered source lines from the left negative potentials. Therefore, the polarities of the pixels in the selected row are positive, negative, positive, negative, . . . from the left. At this time, the source line $S_{n+1}$ connected to the potential output terminal $D_{m+1}$ in the high impedance state is not used for the potential setting of the pixel electrodes.

The above description illustrated the case where the potentials were set for the respective source lines, based on the data captured by the second latch section from the first latch section during the high-level duration of $POL_2$. The below will describe the case where the potentials are set for the respective source lines, based on the data captured by the second latch section from the first latch section during a low-level duration of $POL_2$.

The operation up to the storage of data by the first latch section 62 is the same as above and the description thereof is omitted herein.

With $POL_2$ at the low level, when the second latch section $\mathbf{63}_a$ captures data from the first latch section 62, the input terminal $I_k$ of the output switching section 67 is connected to $O_w$. Therefore, the second latch section $\mathbf{63}_a$ captures the n pieces of data of one row from the first latch section 62 through the data output terminals $L'_1$ to $L'_a$, $L'_{a+b}$ to $L'_m$ of the first latch section 62 and through the data input terminals n to $Q_2$ to $Q_{a+1}$, $Q_{a+b+1}$ to $Q_{m+1}$ of the second latch section $\mathbf{63}_a$. At this time, the data captured using the data input terminals $Q_{a+1}$, $Q_{a+b+1}$ are the data of the same pixel and thus are redundant.

The respective pieces of data output from the second latch section $\mathbf{63}_a$ are input to the data input terminals $U_2$ to $U_{a+1}$ and $U_{a+b+1}$ to $U_{m+1}$ of the level shifter $\mathbf{64}_a$. The level shifter $\mathbf{64}_a$ performs the level shift of the data and outputs the data after the level shift from the data output terminals $U'_2$ to $U'_{a+1}$ and $U'_{a+b+1}$ to $U'_{m+1}$ corresponding to the respective data input terminals.

Then the data output from the level shifter $\mathbf{64}_a$ are input to the data input terminals $T_2$ to $T_{a+1}$ and $T_{a+b+1}$ to $T_{m+1}$ of the D-A converter $\mathbf{65}_a$. The D-A converter $\mathbf{65}_a$ outputs potentials according to the data from the potential output terminals $T'_2$ to $T'_{a+1}$ and $T'_{a+b+1}$ to $T'_{m+1}$ corresponding to the respective data input terminals. At this time, $POL_1$ is at the high level. Therefore, the D-A converter $\mathbf{65}_a$ outputs negative potentials according to the data from the even-numbered potential output terminals $T'_2, T'_4, \ldots, T'_a, T'_{a+b+2}, \ldots T'_m$ from the left. Furthermore, it outputs positive potentials according to the data from the odd-numbered potential output terminals $T'_3, \ldots, T'_{a+1}, T'_{a+b+1}, \ldots T'_{m+1}$ from the left.

The respective potentials output from the D-A converter $\mathbf{65}_a$ are input to the potential input terminals $W_2$ to $W_{a+1}$ and the data input terminals $W_{a+b+1}$ to $W_{m+1}$ of the voltage follower $\mathbf{66}_a$. Then the voltage follower $\mathbf{66}_a$ outputs potentials equal to the input potentials from the potential output terminals $D_2$ to $D_{a+1}$ and $D_{a+b+1}$ to $D_{m+1}$. However, since no source line is connected to the potential output terminal $D_{a+1}$, the potential output terminal $D_{a+1}$ is not used for the potential setting of the source lines. The potential output terminal $D_{a+b+1}$ outputs the potential equal to that of the potential output terminal $D_{a+1}$ and the source line connected to the potential output terminal $D_{a+b+1}$ sets the potential of the a-th pixel electrode from the left.

By the operation as described above, the potentials of the n source lines $S_2$ to $S_{n+1}$ are set, so that the potentials of the n pixel electrodes in the selected row become equal to the potentials of the right source lines as viewed from the viewer side. At this time, the even-numbered source lines from the left have negative potentials and the odd-numbered source lines from the left positive potentials. Therefore, the polarities of the pixels in the selected row are negative, positive, negative, positive, . . . from the left. At this time, the source line $S_1$ connected to the potential output terminal $D_1$ in the high impedance state is not used for the potential setting of the pixel electrodes.

Since $POL_2$ is switched at every period of STB, the polarities of adjacent pixels are opposite to each other in the frame A2.

FIG. 18 shows the example of changes of STB, $POL_1$, and $POL_2$ output from the control unit $\mathbf{3}_a$ to the driving device $\mathbf{1}_a$. FIG. 18 shows the control signals in the frame B2 in which $POL_1$ is at the low level.

The operation up to the input of data into the D-A converter $\mathbf{65}_a$ in the frame B2 is the same as in the case of the frame A2. Since $POL_1$ is at the low level in the frame B2, the operation therein is different only in that the polarities of the potentials output as potentials according to data by the D-A converter $\mathbf{65}_a$ are inverted from those in the frame A2.

Therefore, the polarities of adjacent pixels are also opposite to each other in the frame B2.

Since the driving device $\mathbf{1}_a$ alternately repeats the operation in the frame A2 and the operation in the frame B2, the polarities of the respective pixels in the LCD panel 20 are inverted frame by frame.

In either of the frames A2, B2, the potentials of each source line are not varied across $V_{COM}$ because of the operation as described above. Therefore, power consumption is reduced.

In the seventh embodiment, the LCD panel 20 can also be driven without connecting the potential output terminals in the central region ($D_{a+1}$ to $D_{a+b}$ in the above example) out of the plurality of potential output terminals of the driving device, to any source line.

The sixth embodiment and the seventh embodiment are applied to cases where the first latch section serially reads image data.

[Embodiment 8]

The eighth embodiment of the present invention can be expressed as shown in FIG. 14. Namely, the driving device $\mathbf{1}_a$ receives supply of voltages from the power supply unit 4 and drives the LCD panel 20 under control of the control unit $\mathbf{3}_a$. The power supply unit 4 and the LCD panel 20 are the same as those in the first and second embodiments. In the LCD panel 20 driven in the present embodiment, columns of R (red) pixels, columns of G (green) pixels, and columns of B (blue) pixels are repeatedly arranged, thereby enabling color display. However, connections between potential output terminals and source lines will be described later.

The control unit $\mathbf{3}_a$ is the same as in each of the second to seventh embodiments. Namely, the control unit $\mathbf{3}_a$ alternately changes the level of $POL_1$ between the high level and the low level on a frame-by-frame basis. The output modes of the control signals ($POL_2$, STB, SCLK, STH, etc.) except for $POL_1$ are the same as those in each of the first to seventh embodiments.

The connection configuration between the driving device $\mathbf{1}_a$ and each of the source lines $S_1$ to $S_{n+1}$ is also the same as in each of the second to seventh embodiments. In the present embodiment, the number of potential output terminals $D_1$ to $D_{m+1}$ of the driving device 1, (cf. FIG. 14) is a value obtained by adding 1 to a multiple of 3. Namely, m is assumed to be a multiple of 3.

The operation of the driving device 1, is the same as in the second to seventh embodiments. However, the first latch section $\mathbf{62}_a$ (cf. FIG. 27 described later) in the driving device 1, captures data indicative of pixel values of R, G, and B pixels in parallel. Namely, when the shift register $\mathbf{61}_a$ (cf. FIG. 27 described below) outputs one data read indication signal, the first latch section $\mathbf{62}_a$ simultaneously reads data indicative of pixel values of three pixels of R, G, and B (three pieces of data). As described below, the shift register 61, has (m/3) signal output terminals. The consecutive signal output terminals from the first to the a-th from the left as viewed from the viewer side, out of the (m/3) signal output terminals will be referred to as a first output terminal group. The consecutive signal output terminals from the (a+1)th to the (a+b)th from the left will be referred to as a second output terminal group. Furthermore, the consecutive signal output terminals from the (a+b+1)th to the (m/3)th from the left will be referred to as a third output terminal group. The first output terminal group and the third output terminal group sequentially output the data read indication signals, but the second output terminal group outputs no data read indication signal.

In the present embodiment, the number of signal output terminals belonging to the first output terminal group is a, the number of signal output terminals belonging to the second output terminal group is b, and the number of signal output terminals belonging to the third output terminal group is c. When the number of pixels per row is n, n is a multiple of 3 because combinations of R, G, and B pixels are aligned in each row. It is assumed that $3\cdot(a+c)=n$. Furthermore, $a+b+c=m/3$.

In the present embodiment, based on this premise, the $(3\cdot a)$ potential output terminals $D_1$ to $D_{3\cdot a}$ from the first to the $(3\cdot a)$th from the left in the driving device $\mathbf{1}_a$ are connected in order to the source lines $S_1$ to $S_{3\cdot a}$, respectively. Furthermore, the $(3\cdot c+1)$ potential output terminals $D_{3\cdot(a+b+1)-2}$ to $D_{m+1}$ from the $\{3\cdot(a+b+1)-2\}$th to the (m+1)th from the left are connected in order to the source lines $S_{3\cdot a}$ to $S_{n+1}$, respectively. The number of potential output terminals $D_1$ to $D_{3\cdot a}$ and $D_{3\cdot(a+b+1)-2}$ to $D_{m+1}$ of the driving device $\mathbf{1}_a$ is the same as the number of source lines, n+1.

The operation of the driving device $\mathbf{1}_a$ is the same as in the other embodiments. However, when $POL_2$ is at the high level, the driving device $\mathbf{1}_a$ outputs potentials according to pixel values from the n potential output terminals except for $D_{m+1}$, out of the potential output terminals $D_1$ to $D_{3\cdot a}$ and $D_{3\cdot(a+b+1)-2}$ to $D_{m+1}$, and keeps the output state of $D_{m+1}$ in a high impedance state. When $POL_2$ is at the low level, the driving device $\mathbf{1}_a$ outputs potentials according to pixel values from the n potential output terminals except for $D_1$, out of the potential output terminals $D_1$ to $D_{3\cdot a}$ and $D_{3\cdot(a+b+1)-2}$ to $D_{m+1}$, and keeps the output state of $D_1$ in a high impedance state.

With $POL_1$ at the high level, the driving device $\mathbf{1}_a$ outputs positive potentials according to pixel values from the odd-numbered potential output terminals from the left and outputs negative potentials according to pixel values from the even-numbered potential output terminals from the left. With $POL_1$ at the low level, the driving device $\mathbf{1}_a$ outputs negative potentials according to pixel values from the odd-numbered potential output terminals from the left and outputs positive potentials according to pixel values from the even-numbered potential output terminals from the left. However, as described above, either of the potential output terminals $D_1$, $D_{m+1}$ is kept in the high impedance state, depending upon the level of $POL_2$.

The outputs of the potential output terminals $D_{3\cdot a}$ to $D_{3\cdot(a+b)}$ are kept in the high impedance state, independent of $POL_1$.

Figure 27:
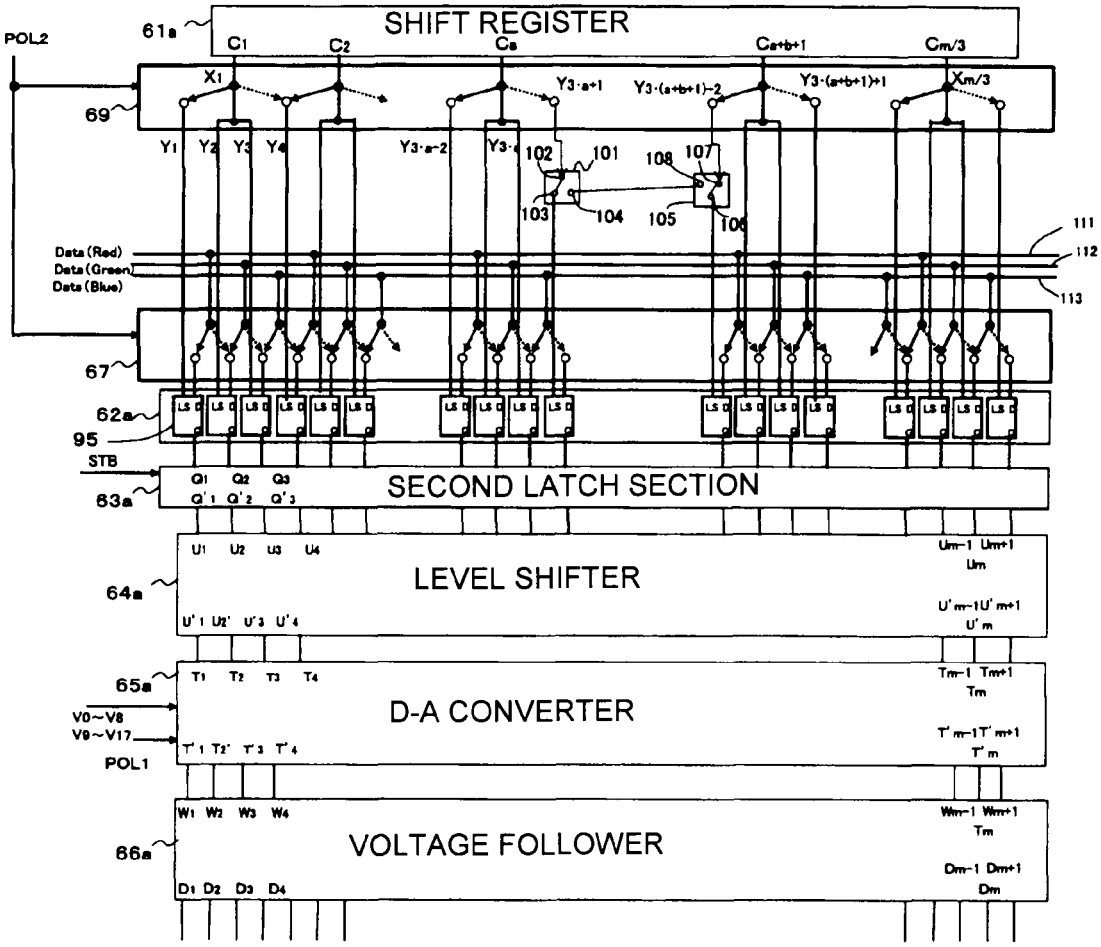
FIG. 27 is an explanatory drawing showing a configuration example of the driving device $\mathbf{1}_a$ in the eighth embodiment.

FIG. 27 is an explanatory drawing showing a configuration example of the driving device $\mathbf{1}_a$ in the eighth embodiment.

The same elements as those described in the other embodiments are denoted by the same reference signs as the elements described previously, without detailed description thereof. The driving device $\mathbf{1}_a$ in the present embodiment is provided with a shift register $\mathbf{61}_a$, a signal branch section 69, a first changeover switch 101, a second changeover switch 105, an output switching section 67, a first latch section $\mathbf{62}_a$, a second latch section $\mathbf{63}_a$, a level shifter $\mathbf{64}_a$, a D-A converter $\mathbf{65}_a$, and a voltage follower $\mathbf{66}_a$.

As described above, the shift register $\mathbf{61}_a$ is provided with the (m/3) signal output terminals. The signal output terminals are denoted by $C_1$ to $C_{m/3}$ in order from the left signal output terminal as viewed from the viewer side. In the present embodiment, the data read indication signals are sequentially output from the a signal output terminals $C_1$ to $C_a$ belonging to the first output terminal group and from the c signal output terminals $C_{a+b+1}$ to $C_{m/3}$ belonging to the third output terminal group. No data read indication signal is output from the b signal output terminals $C_{a+1}$ to $C_{a+b}$ belonging to the second output terminal group.

The signal branch section 69 is provided with (m/3) signal input terminals individually connected to the signal output terminals $C_1$ to $C_{m/3}$ of the shift register and with (m+1) signal output terminals, and is configured to output each data read indication signal input at one signal input terminal, from three signal output terminals. The signal input terminals of the signal branch section 69 are denoted by $X_1$ to $X_{m/3}$. The signal output terminals of the signal branch section 69 are denoted by $Y_1$ to $Y_{m+1}$. $POL_2$ is input to the signal branch section 69 and the signal output terminal to output the data read indication signal is switched to another in accordance with $POL_2$. Specifically, i donates each value from 1 to m/3 and the i-th signal input terminal from the left in the signal branch section 69 is denoted by X. When $POL_2$ is at the high level, the signal branch section 69 outputs the data read indication signal input at the signal input terminal $X_i$, from the signal output terminals $Y_{3\cdot i-2}$, $Y_{3\cdot i-1}$, $Y_{3\cdot i}$. On the other hand, when $POL_2$ is at the low level, the signal branch section 69 outputs the data read indication signal input at the signal input terminal $X_i$, from the signal output terminals $Y_{3\cdot i-1}$, $Y_{3\cdot i}$, $Y_{3\cdot 1+1}$.

The first latch section $\mathbf{62}_a$ in the present embodiment has (m+1) latch circuits 95 each of which latches data of one pixel. Each latch circuit 95 is provided with a signal input terminal LS to receive input of the data read indication signal from the shift register $\mathbf{61}_a$, a terminal D to read data, and a terminal Q used for data capture by the second latch section $\mathbf{63}_a$. When the data read indication signal is input to the signal input terminal LS, each latch circuit 95 reads data of one pixel through the terminal D.

The signal output terminals $Y_1$ to $Y_{3\cdot a}$ of the signal branch section 69 are connected in order to the signal input terminals LS of the first to (3·a)th latch circuits from the left in the first latch section $\mathbf{62}_a$. The signal output terminals $Y_{3\cdot(a+b+1)-1}$ to $Y_{m+1}$ of the signal branch section 69 are connected in order to the signal input terminals LS of the {3·(a+b+1)−1}th to (m+1) th latch circuits from the left in the first latch section $\mathbf{62}_a$.

The first changeover switch 101 is provided with a first terminal 102, a second terminal 103, and a third terminal 104. When the first switch 101 receives $POL_2$, the first terminal 102 and the second terminal 103 are connected with $POL_2$ at the high level and the first terminal 102 and the third terminal 104 are connected with $POL_2$ at the low level.

The operation of the second changeover switch 105 is the same as that of the first changeover switch 101. Specifically, the second switch 105 is provided with a first terminal 106, a second terminal 107, and a third terminal 108. When the second switch 105 also receives $POL_2$, the first terminal 106 and the second terminal 107 are connected with $POL_2$ at the high level, and the first terminal 106 and the third terminal 108 are connected with $POL_2$ at the low level.

The first terminal 102 of the first switch 101 is connected to the signal output terminal $Y_{3\cdot a+1}$ of the signal branch section 69, and the second terminal 103 of the first switch 101 is connected to the signal input terminal LS of the (3·a+1)th latch circuit from the left in the first latch section $\mathbf{62}_a$.

The second terminal 107 of the second switch 105 is connected to the signal output terminal $Y_{3\cdot(a+b+1)-2}$ of the signal branch section 69, and the first terminal 106 of the second switch 105 is connected to the signal input terminal LS of the {3·(a+b+1)−2}th latch circuit from the left in the first latch section $\mathbf{62}_a$.

The third terminal 104 of the first switch 101 is connected to the third terminal 108 of the second switch 105.

Therefore, with $POL_2$ at the high level, the data read indication signal input to the signal output terminal $X_a$ of the signal branch section 69 is output from the signal output terminals $Y_{3\cdot a-2}$, $Y_{3\cdot a-1}$, and $Y_{3\cdot a}$ to be input to the terminals LS of the (3·a−2)th, (3·a−1)th, and (3·a)th latch circuits from the left in the first latch section $\mathbf{62}_a$. At this time, the terminal $Y_{3\cdot a+1}$ is connected through the first switch 101 to the (3·a+1)th terminal LS in the first latch section $\mathbf{62}_a$, but no signal is input to the (3·a+1)th terminal LS from the left because no data read indication signal is input to the signal output terminal $X_{a+1}$.

With $POL_2$ at the high level, the data read indication signal input to the signal output terminal $X_{(a+b+1)}$ of the signal branch section 69 is output from the signal output terminals $Y_{3\cdot(a+b+1)-2}$, $Y_{3\cdot(a+b+1)-1}$, and $Y_{3\cdot(a+b+1)}$ to be input to the terminals LS of the {3·(a+b+1)−2}th, {3·(a+b+1)−1}th, and {3·(a+b+1)}th latch circuits from the left in the first latch section $\mathbf{62}_a$. The signal from the signal output terminal $Y_{3\cdot(a+b+1)-2}$ is input through the second switch 105 to the {3·(a+b+1)−2}th terminal LS in the first latch section $\mathbf{62}_a$.

With $POL_2$ at the low level, the data read indication signal input to the signal output terminal $X_a$ of the signal branch section 69 is output from the signal output terminals $Y_{3\cdot a-1}$, $Y_{3\cdot a}$, and $Y_{3\cdot a+1}$ to be input to the terminals LS of the (3·a−1) th, (3·a)th, and {3·(a+b+1)−2}th latch circuits from the left in the first latch section $\mathbf{62}_a$. The signal from the signal output terminal $Y_{3\cdot a+1}$ is input through the first terminal 102 and the third terminal 104 of the first switch 101 and through the third terminal 108 and the first terminal 106 of the second switch 105 to the terminal LS of the {3·(a+b+1)−2}th latch circuit in the first latch section $\mathbf{62}_a$.

With $POL_2$ at the low level, the data read indication signal input to the signal output terminal $X_{(a+b+1)}$ of the signal branch section 69 is output from the signal output terminals $Y_{3\cdot(a+b+1)-1}$, $Y_{3\cdot(a+b+1)}$, and $Y_{3\cdot(a+b+1)+1}$ to be input to the terminals LS of the {3·(a+b+1)−1}th, the {3·(a+b+1)}th, and the {3·(a+b+1)+1}th latch circuits from the left in the first latch section $\mathbf{62}_a$.

The driving device $\mathbf{1}_a$ is provided with an R data line (red data wire) 111 to supply (or transfer) data indicative of pixel values of R pixels, a G data line (green data wire) 112 to supply (or transfer) data indicative of pixel values of G pixels, and a B data line (blue data wire) 113 to supply (or transfer) data indicative of pixel values of B pixels.

The output switching section 67 is the same as the output switching section 67 in each of the other embodiments, and has m input terminals $I_1$ to $I_m$ and (m+1) output terminals $O_1$ to $O_{m+1}$. The input terminals $I_{3\cdot k-2}$ (specifically, $I_1$, $I_4$, $I_7$ . . . ) out of the input terminals are connected to the R data line (red data wire) 111. Similarly, the input terminals $I_{3\cdot k-}$(specifically, $I_2$, $I_5$, $I_5$, . . . ) out of the input terminals are connected to the G data line 112. The input terminals $I_{3\cdot i}$(specifically, $I_3$, $I_6$, $I_9$ . . . ) out of the input terminals are connected to the B data line 113.

The output terminals $O_1$ to $O_{m+1}$ of the output switching section 67 are connected in one-to-one relation to the terminals D of the (m+1) latch circuits in the first latch section $\mathbf{62}_a$.

The second latch section $\mathbf{63}_a$ is the same as that in the second embodiment and has (m+1) data input terminals $Q_1$ to $Q_{m+1}$ corresponding to the (m+1) latch circuits 95, and (m+1) data output terminals $Q'_1$ to $Q'_{m+1}$. The second latch section $\mathbf{63}_a$ captures data from the latch circuits of the first latch section storing captured data and outputs the captured data from the data output terminals corresponding to the data input terminals used in the data capture. The second latch section $\mathbf{63}_a$ stores the data of n pixels in one row, and thus the second latch section $\mathbf{63}_a$ stores the data in its n latch circuits. The second latch section $\mathbf{63}_a$ reads the data through the data input terminals corresponding to the latch circuits and outputs the data from the data output terminals corresponding to the data input terminals.

The level shifter $\mathbf{64}_a$ is the same as that in the second embodiment and has (m+1) data input terminals $U_1$ to $U_{m+1}$ corresponding to the data output terminals $Q'_1$ to $Q'_{m+1}$ of the second latch section $\mathbf{63}_a$, and (m+1) data output terminals $U'_1$ to $U'_{m+1}$. The data output from the data output terminals of the second latch section $\mathbf{63}_a$ are input to the corresponding data input terminals in the level shifter $\mathbf{64}_a$. The level shifter $\mathbf{64}_a$ performs the level shift of the data and outputs the level-shifted data from the data output terminals corresponding to the data input terminals.

The D-A converter $\mathbf{65}_a$ is the same as that in the second embodiment and has (m+1) data input terminals $T_1$ to $T_{m+1}$ corresponding to the data output terminals $U'_1$ to $U'_{m+1}$ of the level shifter, and (m+1) potential output terminals $T'_1$ to $T'_{m+1}$. The data output from the data output terminals of the level shifter $\mathbf{64}_a$ are input to the corresponding data input terminals of the D-A converter $\mathbf{65}_a$. The D-A converter $\mathbf{65}_a$ outputs potentials according to the data from the potential output terminals corresponding to the data input terminals. The relationship between $POL_1$ input into the D-A converter $\mathbf{65}_a$ and the polarities of the potentials output from the potential output terminals is the same as that in the second embodiment and others, and thus the description thereof is omitted herein.

The voltage follower $\mathbf{66}_a$ is the same as that in the second embodiment and others, and thus the description thereof is omitted herein.

The below will describe states of the control signals $POL_1$, $POL_2$ and set potentials for the source lines. The output modes of $POL_1$, $POL_2$, and STB in the present embodiment are the same as those in the second embodiment (cf. FIG. 17 and FIG. 18).

The frame A2 in which $POL_1$ is at the high level will be described with reference to FIG. 17. The control unit $\mathbf{3}_a$ makes the first rise of STB in the frame. The control unit $\mathbf{3}_a$ also raises $POL_1$ and $POL_2$ to the high level in conjunction with the rise of STB, as control in the select period of the first row. In the frame A2, $POL_1$ is maintained thereafter at the high level. $POL_2$ alternates between the low level and the high level at every period of STB.

The shift register sequentially outputs the data read signals from the signal output terminals $C_1$ to $C_a$ belonging to the first output terminal group and the signal output terminals $C_{a+b+1}$ to $C_{m/3}$ belonging to the third output terminal group.

Since $POL_2$ is at the high level at this time, the signal branch section 69 outputs the data read indication signal input at each signal input terminal $X_i$ from the signal output terminals $Y_{3\cdot i-2}$, $Y_{3\cdot i-1}$ and $Y_{3\cdot i}$. However, since no data read signal is output from the signal output terminals $C_{a+1}$ to $C_{a+b}$ belonging to the second output terminal group, this reference sign i does not include the values in the range of (a+1) to (a+b). As a result, the {3·(a+c)} (or n) data read indication signals are output from the signal output terminals $Y_1$ to $Y_{3\cdot a}$ and $Y_{3\cdot(a+b+1)-2}$ to $Y_m$ of the signal branch section 69. These data read indication signals are input to the signal input terminals LS of the respective latch circuits from the first to the (3·a)th and from the {3·(a+b+1)−2}th to the m-th from the left in the first latch section $\mathbf{62}_a$. The data read indication signal output from the terminal $Y_{3\cdot(a+b+1)-2}$ is input through the second switch 105 to the {3·(a+b+1)−2}th latch circuit from the left.

Each latch circuit, receiving the data read indication signal at the signal input terminal LS, reads and stores data of one pixel from the R data line 111, from the G data line 112, or from the B data line 113.

Since $POL_2$ is at the high level at this time, the input terminal $I_k$ of the output switching section 67 is connected to the output terminal $O_k$. Therefore, the (3·k−2)th latch circuit from the left out of the latch circuits receiving the respective data read indication signals reads data of one pixel from the R data line 111. The (3·k−1)th latch circuit from the left out of the latch circuits receiving the respective data read indication signals reads data of one pixel from the G data line 112. Similarly, the (3·k)th latch circuit from the left out of the latch circuits receiving the respective data read indication signals reads data of one pixel from the B data line 113.

In the next select period, the second latch section $\mathbf{63}_a$ reads the data of the respective pixels in one row stored in the first latch section $\mathbf{62}_a$ and the second latch section $\mathbf{63}_a$ outputs the data. Specifically, after STB is switched to the high level at the time of switching of the select period and further switched to the low level, the second latch section $\mathbf{63}_a$ reads the data of one row. At this time, the second latch section $\mathbf{63}_a$ captures the data from the first latch section $\mathbf{62}_a$ through the data input terminals $Q_1$ to $Q_{3\cdot a}$ and $Q_{3\cdot(a+b+1)-2}$ to $Q_m$ corresponding to the latch circuits having received the data read indication signals and having stored the data, and outputs the data from the data output terminals $Q'_1$ to $Q'_{3\cdot a}$ and $Q'_{3\cdot(a+b+1)-2}$ to $Q'_m$ corresponding to the data input terminals.

Then the data of n pixels in one row output from the second latch section $\mathbf{63}_a$ are input to the data input terminals $U_1$ to $U_{3\cdot a}$ and $U_{3\cdot(a+b+1)-2}$ to $U_m$ of the level shifter $\mathbf{64}_a$. The level shifter $\mathbf{64}_a$ performs the level shift of the data and outputs the data after the level shift from the data output terminals $U'_1$ to $U'_{3\cdot a}$ and $U'_{3\cdot(a+b+1)-2}$ to $U'_m$ corresponding to the respective data input terminals.

Then the data of n pixels in one row output from the level shifter $\mathbf{64}_a$ are input to the data input terminals $T_1$ to $T_{3\cdot a}$ and $T_{3\cdot(a+b+1)-2}$ to $T_m$ of the D-A converter $\mathbf{65}_a$. The D-A converter $\mathbf{65}_a$ outputs potentials according to the data from the potential output terminals $T'_1$ to $T'_{3\cdot a}$ and $T'_{3\cdot(a+b+1)-2}$ to $T'_m$ corresponding to the respective data input terminals. The outputs of the other potential output terminals are kept in the high impedance state.

$POL_1$ is at the high level at this point. Therefore, the D-A converter $\mathbf{65}_a$ outputs positive potentials as output potentials from the odd-numbered potential output terminals from the left and negative potentials as output potentials from the even-numbered potential output terminals from the left, out of the potential output terminals to output the potentials according to the data.

The respective potentials output from the D-A converter $\mathbf{65}_a$ are input to the potential input terminals $W_1$ to $W_{3\cdot a}$ and the data input terminals $W_{3\cdot(a+b+1)-2}$ to $W_m$ of the voltage follower $\mathbf{66}_a$. Then the voltage follower $\mathbf{66}_a$ outputs potentials equal to the input potentials from the potential output terminals $D_1$ to $D_3$ and $D_{3\cdot(a+b+1)-2}$ to $D_m$.

As a consequence, the potentials of the n source lines $S_1$ to $S_n$ are set, so that the potentials of the n pixel electrodes in the selected row become equal to the potentials of the left source lines as viewed from the viewer side. At this time, the odd-numbered source lines from the left have positive potentials and the even-numbered source lines from the left negative potentials. Therefore, the polarities of the pixels in the selected row are positive, negative, positive, negative, . . . from the left. At this time, the source line $S_{n+1}$ connected to the potential output terminal $D_{m+1}$ in the high impedance state is not used for the potential setting of the pixel electrodes.

The above description illustrated the case where the potentials were set for the respective source lines, based on the data captured by the first latch section with $POL_2$ at the high level. The below will describe the case where the potentials are set for the respective source lines, based on the data captured by the first latch section with $POL_2$ at the low level.

The shift register sequentially outputs the data read signals from the signal output terminals $C_1$ to $C_a$ belonging to the first output terminal group and the signal output terminals $C_{a+b+1}$ to $C_{m/3}$ belonging to the third output terminal group. This is the same as in the aforementioned case.

Since $POL_2$ is at the low level herein, the signal branch section 69 outputs the data read indication signal input at each signal input terminal $X_i$ from the signal output terminals $Y_{3\cdot i-1}$, $Y_{3\cdot i}$, and $Y_{3\cdot i+1}$. However, since no data read signal is output from the signal output terminals $C_{a+1}$ to $C_{a+b}$ belonging to the second output terminal group, this reference sign i does not include the values in the range of (a+1) to (a+b). As a result, the {3·(a+c)} (or n) data read indication signals are output from the signal output terminals $Y_2$ to $Y_{3\cdot a}$ and $Y_{3\cdot(a+b+1)-2}$ to $Y_{m+1}$ of the signal branch section 69. These data read indication signals are input to the signal input terminals LS of the respective latch circuits from the second to the (3·a)th and from the {3·(a+b+1)−2}th to the (m+1)th from the left in the first latch section $\mathbf{62}_a$. The data read indication signal output from the terminal $Y_3$ a+1 is input through the first switch 101 and the second switch 105 to the {3·(a+b+1)−2}th latch circuit from the left.

Each latch circuit, receiving the data read indication signal at the signal input terminal LS, reads and stores data of one pixel from the R data line 111, from the G data line 112, or from the B data line 113.

Since $POL_2$ is at the low level at this time, the input terminal $I_k$ of the output switching section 67 is connected to the output terminal $O_{k+1}$. Therefore, the (3·k−1)th latch circuit from the left out of the latch circuits receiving the respective data read indication signals reads data of one pixel from the R data line 111. Furthermore, the (3·k)th latch circuit from the left out of the latch circuits receiving the respective data read indication signals reads data of one pixel from the G data line 112. The (3·k+1)th latch circuit from the left out of the latch circuits receiving the respective data read indication signals reads data of one pixel from the B data line 113.

In the next select period, the second latch section $\mathbf{63}_a$ reads the data of the respective pixels in one row stored in the first latch section $\mathbf{62}_a$, and the second latch section $\mathbf{63}_a$ outputs the data. Specifically, after STB is switched to the high level at the time of switching of the select period and further switched to the low level, the second latch section $\mathbf{63}_a$ captures the data of one row. At this time, the second latch section $\mathbf{63}_a$ captures the data from the first latch section $\mathbf{62}_a$ through the data input terminals $Q_2$ to $Q_{3\cdot a}$ and $Q_{3\cdot(a+b+1)-2}$ to $Q_{m+1}$ corresponding to the latch circuits having received the data read indication signals and having stored the data, and outputs the data from the data output terminals $Q'_2$ to $Q'_{3\cdot a}$ and $Q'_{3\cdot(a+b+1)-2}$ to $Q'_{m+1}$ corresponding to the data input terminals.

Then the data of the n pixels in one row output from the second latch section $\mathbf{63}_a$ are input to the data input terminals $U_2$ to $U_{3\cdot a}$ and $U_{3\cdot}$(a+b+1)−2 to $U_{m+1}$ of the level shifter $\mathbf{64}_a$. The level shifter $\mathbf{64}_a$ performs the level shift of the data and outputs the data after the level shift from the data output terminals $U'_2$ to $U'_{3\cdot a}$ and $U'_{3\cdot(a+b+1)-2}$ to $U'_{m+1}$ corresponding to the respective data input terminals.

Then the data of the n pixels in one row output from the level shifter $\mathbf{64}_a$ are input to the data input terminals $T_2$ to $T_{3\cdot a}$ and $T_{3\cdot(a+b+1)-2}$ to $T_{m+1}$ of the D-A converter $\mathbf{65}_a$. The D-A converter $\mathbf{65}_a$ outputs potentials according to the data from the potential output terminals $T'_2$ to $T'_{3\cdot a}$ and $T'_{3\cdot(a+b+1)-2}$ to $T'_{m+1}$ corresponding to the respective data input terminals. The outputs of the other potential output terminals are kept in the high impedance state.

$POL_1$ is at the high level at this point. Therefore, the D-A converter $\mathbf{65}_a$ outputs negative potentials as output potentials from the even-numbered potential output terminals from the left and positive potentials as output potentials from the odd-numbered potential output terminals from the left, out of the potential output terminals to output the potentials according to the data.

The potentials output from the D-A converter $\mathbf{65}_a$ are input to the potential input terminals $W_2$ to $W_{3\cdot a}$ and data input terminals $W_{3\cdot(a+b+1)-2}$ to $W_{m+1}$ the voltage follower $\mathbf{66}_a$. Then the voltage follower $\mathbf{66}_a$ outputs potentials equal to the input potentials from the potential output terminals $D_2$ to $D_{3\cdot a}$ and $D_{3\cdot(a+b+1)-2}$ to $D_{m+1}$.

As a consequence, the potentials of the n source lines $S_2$ to $S_{n+1}$ are set, so that the potentials of the n pixel electrodes in the selected row become equal to the potentials of the right source lines as viewed from the viewer side. At this time, the even-numbered source lines from the left have negative potentials and the odd-numbered source lines from the left positive potentials. Therefore, the polarities of the pixels in the selected row are negative, positive, negative, positive, . . . from the left. At this time, the source line $S_1$ connected to the potential output terminal $D_1$ in the high impedance state is not used for the potential setting of the pixel electrodes.

Since $POL_2$ is switched at every period of STB, the polarities of adjacent pixels are opposite to each other in the frame A2.

FIG. 18 shows the example of changes of STB, $POL_1$, and $POL_2$ output from the control unit $\mathbf{3}_a$ to the driving device $\mathbf{1}_a$. FIG. 18 shows the control signals in the frame B2 in which $POL_1$ is at the low level.

The operation up to the input of data into the D-A converter $\mathbf{65}_a$ in the frame B2 is the same as in the frame A2. Since $POL_1$ is at the low level in the frame B2, the operation in the frame B2 is different only in that the polarities of potentials output as potentials according to the data from the D-A converter $\mathbf{65}_a$ are inverted from those in the frame A2.

Therefore, the polarities of adjacent pixels are also opposite to each other in the frame B2.

Since the driving device $\mathbf{1}_a$ alternately repeats the operation in the frame A2 and the operation in the frame B2, the polarities of the respective pixels in the LCD panel 20 are inverted frame by frame.

In either of the frames A2, B2, the potentials of each source line are not varied across $V_{COM}$ because of the operation as described above. Therefore, power consumption is reduced.

In the eighth embodiment, the LCD panel 20 can also be driven without connecting the potential output terminals in the central region ($D_{3\cdot a+1}$ to $D_{3\cdot(a+b)}$ in the above example) out of the plurality of potential output terminals of the driving device, to any source line.

The eighth embodiment is applied to cases where the first latch section reads data of R, G, and B in parallel.

Figure 28:
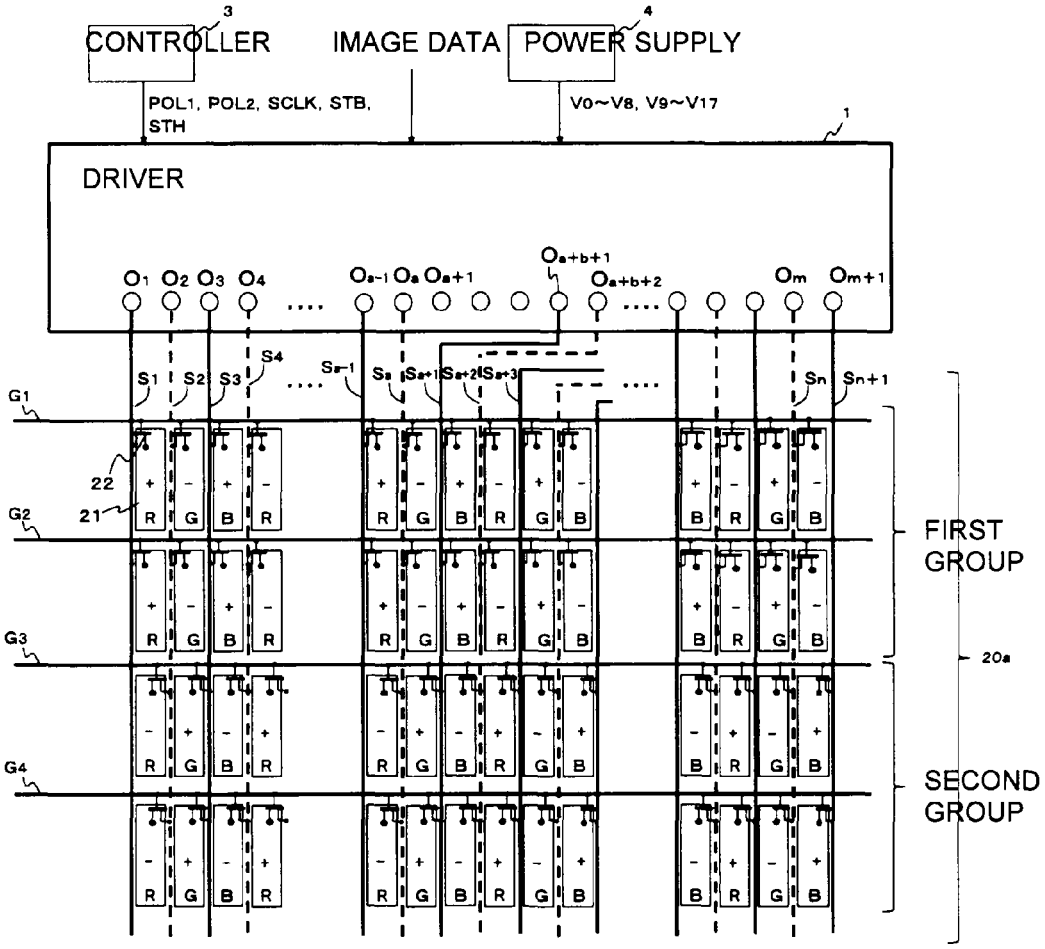
FIG. 28 is an explanatory drawing showing another example of the LCD panel to which the present invention is applied.
Figure 29:
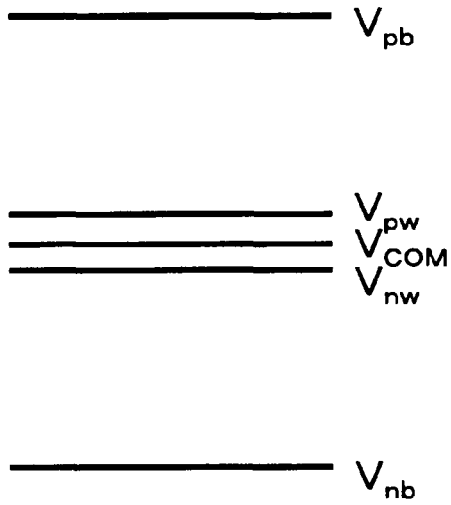
FIG. 29 is an explanatory drawing showing an example of a potential of a common electrode and potentials to set a pixel in white or in black by each of polarities.
Figure 30:
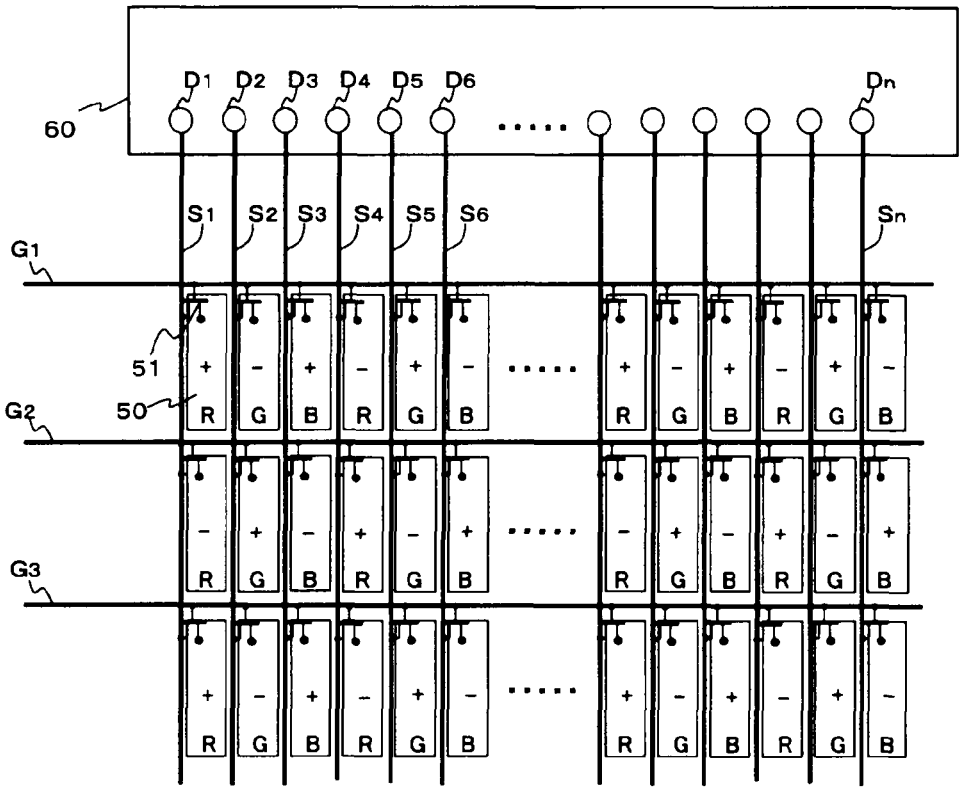
FIG. 30 is an explanatory drawing showing a general liquid crystal display device.

Each of the above embodiments may be applied to the drive of the LCD panel $\mathbf{20}_a$ illustrated in FIG. 28. In FIG. 28, the same elements as those shown in FIG. 1 are denoted by the same reference sings as those in FIG. 1, without detailed description thereof. The LCD panel $\mathbf{20}_a$ has a configuration wherein a plurality of consecutive rows are defined as one group, the pixel electrodes in each row in the odd-numbered groups are connected to the left source lines, and the pixel electrodes in each row in the even-numbered groups are connected to the right source lines.

The LCD panel $\mathbf{20}_a$ is provided with source lines on the left side of respective columns of pixel electrodes and with a source line on the right side of the rightmost pixel column as well. Namely, the number of source lines is by one larger than the number of columns of pixel electrodes. Furthermore, the pixel electrodes in one column are arranged between adjacent source lines. The connection configuration between the individual source lines $S_1$ to $S_{n+1}$ and the driving device 1 is the same as in each of the other embodiments.

In the LCD panel $\mathbf{20}_a$, rows of pixel electrodes 21 are grouped in such a manner that each set of consecutive rows constitutes a group. FIG. 28 shows an example in which each set of two consecutive rows is defined as one group. It is, however, noted that the number of rows in one group does not have to be limited to 2, but each group may be composed, for example, of three or four consecutive rows. When the number of rows of pixel electrodes 21 is N, the number of rows in one group may be at most N−1.

The description below concerns the example in which each group includes two consecutive rows. Therefore, the first group includes the first row and the second row of pixel electrodes 21, and the second group includes the third row and the fourth row. The subsequent rows are also grouped in the same manner.

Each pixel electrode 21 in each row in the odd-numbered groups is connected to the left source line through a TFT 22. In the odd-numbered groups, the TFT 22 is located, for example, on the left side of each pixel electrode 21. However, the arrangement location of TFT 22 is not limited to this location but may be optional.

Each pixel electrode 21 in each row in the even-numbered groups is connected to the right source line through a TFT 22. In the even-numbered groups, the TFT 22 is located, for example, on the right side of each pixel electrode 21. However, the arrangement location of TFT is not limited to this location but may be optional as in the above case.

When each of the above embodiments is applied to the LCD panel $\mathbf{20}_a$ of this kind, the operations of the control unit 3, $\mathbf{3}_a$ and the driving device 1, $\mathbf{1}_a$ are the same as the operations described above. However, in the embodiment wherein the levels of $POL_1$ and $POL_2$ are switched at every select period as shown in FIGS. 10 and 12, the control unit alternately switches the levels of $POL_1$ and $POL_2$ between the high level and the low level on a group-by-group basis in one frame. Furthermore, in the embodiments wherein the level of $POL_1$ is switched frame by frame and wherein the level of $POL_2$ is switched at every select period as shown in FIGS. 17 and 18, the control unit alternately switches the level of $POL_1$ between the high level and the low level on a frame-by-frame basis and alternately switches the level of $POL_2$ between the high level and the low level on a group-by-group basis in one frame.

This configuration also provides the same effects as in each of the above-described embodiments. The LCD panel 20 in each of the previously-described embodiments corresponds to the case of the LCD panel $\mathbf{20}_a$ shown in FIG. 28 in which the number of rows belonging to each group is only one. Therefore, the LCD panel 20 in each embodiment can be said to be one of modes of the LCD panel $\mathbf{20}_a$ shown in FIG. 28.

INDUSTRIAL APPLICABILITY

The present invention is suitably applied to the active-matrix liquid crystal display devices.

LIST OF REFERENCE SIGNS

1, $\mathbf{1}_a$ driving device
3, $\mathbf{3}_a$ control unit
4 power supply unit
20, $\mathbf{20}_a$ liquid crystal display panel
61, $\mathbf{61}_a$ shift register
62, $\mathbf{62}_a$ first latch section
63, $\mathbf{63}_a$ second latch section
64, $\mathbf{64}_a$ level shifter
65, $\mathbf{65}_a$ D-A converter
66, $\mathbf{66}_a$ voltage follower
71 shift register switch
72, 101 first changeover switch
76, 105 second changeover switch The entire disclosure of Japanese Patent Application No. 2010-256628 filed on Nov. 17, 2010 including specification, claims, drawings and summary are incorporated herein by reference in its entirety.

What is claimed is:

1. An LCD panel driving device for driving a liquid crystal display panel which comprises a common electrode, a plurality of pixel electrodes arranged in a matrix pattern, and source lines the number of which is by one larger than the number of columns of the pixel electrodes, in which each column of the pixel electrodes is arranged between adjacent source lines, and in which when rows of the pixel electrodes are grouped so that each group includes one row or a plurality of consecutive rows, each pixel electrode in each row in each odd-numbered group is connected to a source line on a predetermined side out of source lines present on both sides of the pixel electrode and each pixel electrode in each row in each even-numbered group is connected to a source line on the opposite side to the predetermined side out of source lines present on both sides of the pixel electrode, the driving device comprising:

an output switching section having m input terminals and (m+1) output terminals, and configured so that when the k-th input terminal from the predetermined side is defined as $I_k$, when the k-th and the (k+1)th output terminals from the predetermined side are defined as $O_k$ and $O_{k+1}$, respectively, and when k is defined as each value from 1 to m, the output switching section connects the input terminal $I_k$ to the output terminal $O_k$ if a control signal to define a terminal to be connected to the input terminal $I_k$ is at a first level and the output switching section connects the input terminal $I_k$ to the output terminal $O_{k+1}$ if the control signal is at a second level; and output means having m output terminals arranged in a row direction of pixels, and configured so that when, among the m output terminals, a plurality of output terminals consecutively arranged from the predetermined side are defined as a first output terminal group, a plurality of output terminals arranged following the first output terminal group are defined as a second output terminal group, and a plurality of output terminals arranged following the second output terminal group are defined as a third output terminal group, the second output terminal group does not contribute to potential setting for the source lines and so that the output means outputs data or signals about pixels from the first output terminal group and the third output terminal group, wherein the relation of a+c=n is met where n represents the number of pixels in one row, a the number of the output terminals belonging to the first output terminal group, b the number of the output terminals belonging to the second output terminal group, and c the number of the output terminals belonging to the third output terminal group, wherein the number of data or signals input to the input terminals of the output switching section is n, wherein the input terminals $I_1$ to $I_{a-1}$ of the output switching section are connected to the first to (a−1)th respective output terminals from the predetermined side belonging to the first output terminal group, the number of data or signals input to the input terminals $I_1$ to $I_{a-1}$ is (a−1), the input terminals $I_{a+b+1}$ to $I_m$ of the output switching section are connected to the respective output terminals belonging to the third output terminal group, and the number of data or signals input to the input terminals $I_{a+b+1}$ to $I_m$ is c, and wherein data or a signal output from the a-th output terminal from the predetermined side of the output means is input to the input terminal $I_a$ of the output switching section or to the input terminal $I_{a+b}$ of the output switching section.

2. The LCD panel driving device according to claim 1, comprising:

a switch having a first terminal, a second terminal, and a third terminal, and configured to connect the first terminal to the second terminal if the control signal is at the first level and to connect the first terminal to the third terminal if the control signal is at the second level, wherein the data or signal output from the a-th output terminal from the predetermined side of the output means is supplied to the third terminal of the switch, wherein the first terminal of the switch is connected to the input terminal $I_{a+b}$ of the output switching section and the second terminal of the switch is connected to the (a+b)th output terminal from the predetermined side of the output means, and wherein the output terminals $O_1$ to $O_a$ and $O_{a+b+1}$ to $O_{m+1}$ of the output switching section individually correspond to the source lines and are connected to the corresponding source lines or to respective paths continuous to the corresponding source lines.

3. The LCD panel driving device according to claim 2, further comprising:

another switch having a first terminal, a second terminal, and a third terminal, and configured to connect the first terminal to the second terminal if the control signal is at the first level and to connect the first terminal to the third terminal if the control signal is at the second level, wherein the first terminal of the other switch is connected to the a-th output terminal from the predetermined side of the output means and the second terminal of the other switch is connected to the input terminal $I_a$ of the output switching section, and wherein the third terminal of the other switch is connected to the third terminal of the above-defined switch.

4. The LCD panel driving device according to claim 3, wherein the output means is a D-A converter which converts data indicative of n pixel values in one row to potentials according to the pixel values and which outputs the potentials according to the pixel values in the individual pixels from the respective output terminals belonging to the first output terminal group and the respective output terminals belonging to the third output terminal group.

5. The LCD panel driving device according to claim 4, wherein the input terminals $I_1$ to $I_{a-1}$ of the output switching section are connected through a voltage follower to the first to (a−1)th respective output terminals from the predetermined side belonging to the first output terminal group and the input terminals $I_{a+b+1}$ to $I_m$ of the output switching section are connected through the voltage follower to the respective output terminals belonging to the third output terminal group, and wherein the first terminal of the other switch is connected through the voltage follower to the a-th output terminal from the predetermined side of the output means.

6. The LCD panel driving device according to claim 3, wherein the output means is a shift register having m output terminals and configured to sequentially output data read indication signals each to indicate read of a pixel value of one pixel, from the first to a-th output terminals from the predetermined side and the (a+b+1)th to m-th output terminals from the predetermined side, the driving device further comprising:

a first latch section having (m+1) signal input terminals and (m+1) data output terminals, and configured to read and store data indicative of a pixel value of one pixel at every input of the sequential data read indication signals to n signal input terminals out of the first to a-th signal input terminals from the predetermined side and the (a+b+1)th to (m+1)th signal input terminals from the predetermined side among the (m+1) signal input terminals, and to output data indicative of pixel values of one row from n data output terminals corresponding to the respective signal input terminals receiving the data read indication signals;

a second latch section having (m+1) data input terminals and (m+1) data output terminals, and configured to capture the data indicative of the pixel values of one row through the n data output terminals of the first latch section and through n data input terminals corresponding to the n data output terminals and to output the data indicative of the pixel values of one row from n data output terminals corresponding to the n data input terminals;

a level shifter having (m+1) data input terminals and (m+1) data output terminals, and configured to capture the data indicative of the pixel values of one row through n data input terminals corresponding to the n data output terminals of the second latch section outputting the data indicative of the pixel values, to perform a level shift of the data, and to output the data after the level shift from n data output terminals corresponding to the n data input terminals; and a D-A converter having (m+1) data input terminals and (m+1) potential output terminals, and configured to capture the data indicative of the pixel values of one row from n data input terminals corresponding to the n data output terminals of the level shifter outputting the data indicative of the pixel values, and to output potentials according to the pixel values from n potential output terminals corresponding to the n data input terminals, wherein the output terminals $O_1$ to $O_a$ of the output switching section are connected to the first to a-th respective signal input terminals from the predetermined side of the first latch section and the output terminals $O_{a+b+1}$ to $O_{m+1}$ of the output switching section are connected to the (a+b+1)th to (m+1)th respective signal input terminals from the predetermined side of the first latch section, and wherein the first to a-th potential output terminals from the predetermined side and the (a+b+1)th to (m+1)th potential output terminals from the predetermined side in the D-A converter individually correspond to the source lines and are connected through a voltage follower to the corresponding source lines.

7. The LCD panel driving device according to claim 3, comprising:

a shift register having m signal output terminals, and configured to sequentially output data read indication signals each to indicate read of a pixel value of one pixel, from the first to a-th signal output terminals from the predetermined side and the (a+b+1)th to m-th signal output terminals from the predetermined side out of the m signal output terminals, wherein the output means is a first latch section having m signal input terminals, and configured to read and store data indicative of a pixel value of one pixel at every input of the sequential data read indication signals to the first to a-th signal input terminals from the predetermined side and the (a+b+1)th to m-th signal input terminals from the predetermined side out of the m signal input terminals, and to output data indicative of pixel values of one row from n output terminals corresponding to the respective signal input terminals receiving the data read indication signals, the driving device further comprising:

a second latch section having (m+1) data input terminals and (m+1) data output terminals, and configured to capture the data indicative of the pixel values of one row through n data input terminals corresponding to n output terminals of the output switching section becoming connected to the n output terminals of the first latch section, and to output the data indicative of the pixel values of one row from n data output terminals corresponding to the n data input terminals;

a level shifter having (m+1) data input terminals and (m+1) data output terminals, and configured to capture the data indicative of the pixel values of one row through n data input terminals corresponding to the n data output terminals of the second latch section outputting the data indicative of the pixel values, to perform a level shift of the data, and to output the data after the level shift from n data output terminals corresponding to the n data input terminals; and a D-A converter having (m+1) data input terminals and (m+1) potential output terminals, and configured to capture the data indicative of the pixel values of one row through n data input terminals corresponding to the n data output terminals of the level shifter outputting the data indicative of the pixel values, and to output potentials according to the pixel values from n potential output terminals corresponding to the n data input terminals, wherein the output terminals $O_1$ to $O_a$ of the output switching section are connected to the first to a-th respective data input terminals from the predetermined side of the second latch section and the output terminals $O_{a+b+1}$ to $O_{m+1}$ of the output switching section are connected to the (a+b+1)th to (m+1)th respective data input terminals from the predetermined side of the second latch section, and wherein the first to a-th potential output terminals from the predetermined side and the (a+b+1)th to (m+1)th potential output terminals from the predetermined side in the D-A converter individually correspond to the source lines and are connected through a voltage follower to the corresponding source lines.

8. The LCD panel driving device according to claim 3, comprising:

a shift register having m signal output terminals, and configured to sequentially output data read indication signals each to indicate read of a pixel value of one pixel, from the first to a-th signal output terminals from the predetermined side and the (a+b+1)th to m-th signal output terminals from the predetermined side out of the m signal output terminals; and a first latch section having m signal input terminals and m data output terminals, and configured to read and store data indicative of a pixel value of one pixel at every input of the sequential data read indication signals to the first to a-th signal input terminals from the predetermined side and the (a+b+1)th to m-th signal input terminals from the predetermined side out of the m signal input terminals, and to output data indicative of pixel values of one row from n data output terminals corresponding to the respective signal input terminals receiving the data read indication signals, wherein the output means is a second latch section having m data input terminals, and configured to capture the data indicative of the pixel values of one row from the first latch section through the first to a-th data input terminals from the predetermined side and the (a+b+1)th to m-th data input terminals from the predetermined side, and to output the data indicative of the pixel values of one row from n output terminals corresponding to the n data input terminals capturing the data;

the driving device further comprising:

a level shifter having (m+1) data input terminals and (m+1) data output terminals, and configured to capture the data indicative of the pixel values of one row through n data input terminals corresponding to the n output terminals of the second latch section outputting the data indicative of the pixel values, to perform a level shift of the data, and to output the data after the level shift from n data output terminals corresponding to the n data input terminals; and a D-A converter having (m+1) data input terminals and (m+1) potential output terminals, and configured to capture the data indicative of the pixel values of one row through n data input terminals corresponding to the n data output terminals of the level shifter outputting the data indicative of the pixel values, and to output potentials according to the pixel values from n potential output terminals corresponding to the n data input terminals, wherein the output terminals $O_1$ to $O_a$ of the output switching section are connected to the first to a-th respective data input terminals from the predetermined side of the level shifter and the output terminals $O_{a+b+1}$ to $O_{m+1}$ of the output switching section are connected to the (a+b+1)th to (m+1)th respective data input terminals from the predetermined side of the level shifter, and wherein the first to a-th potential output terminals from the predetermined side and the (a+b+1)th to (m+1)th potential output terminals from the predetermined side in the D-A converter individually correspond to the source lines and are connected through a voltage follower to the corresponding source lines.

9. The LCD panel driving device according to claim 3, comprising:

a shift register having m signal output terminals, and configured to sequentially output data read indication signals each to indicate read of a pixel value of one pixel, from the first to a-th signal output terminals from the predetermined side and the (a+b+1)th to m-th signal output terminals from the predetermined side out of the m signal output terminals;

a first latch section having m signal input terminals and m data output terminals, and configured to read and store data indicative of a pixel value of one pixel at every input of the sequential data read indication signals to the first to a-th signal input terminals from the predetermined side and the (a+b+1)th to m-th signal input terminals from the predetermined side out of the m signal input terminals, and to output data indicative of pixel values of one row from n output terminals corresponding to the respective signal input terminals receiving the data read indication signals; and a second latch section having m data input terminals and m data output terminals, and configured to capture the data indicative of the pixel values of one row from the first latch section through the first to a-th data input terminals from the predetermined side and the (a+b+1)th to m-th data input terminals from the predetermined side, and to output the data indicative of the pixel values of one row from n output terminals corresponding to the n data input terminals capturing the data, wherein the output means is a level shifter having m data input terminals, and configured to capture the data indicative of the pixel values of one row from the second latch section through the first to a-th data input terminals from the predetermined side and the (a+b+1)th to m-th data input terminals from the predetermined side, to perform a level shift of the data, and to output the data after the level shift indicative of the pixel values of one row from n output terminals corresponding to the n data input terminals capturing the data, the driving device further comprising:

a D-A converter having (m+1) data input terminals and (m+1) potential output terminals, and configured to capture the data indicative of the pixel values of one row through n data input terminals corresponding to the n data output terminals of the level shifter outputting the data indicative of the pixel values, and to output potentials according to the pixel values from n potential output terminals corresponding to the n data input terminals, wherein the output terminals $O_1$ to $O_a$ of the output switching section are connected to the first to a-th respective data input terminals from the predetermined side of the D-A converter and the output terminals $O_{a+b+1}$ to $O_{m+1}$ of the output switching section are connected to the (a+b+1)th to (m+1)th respective data input terminals from the predetermined side of the D-A converter, and wherein the first to a-th potential output terminals from the predetermined side and the (a+b+1)th to (m+1)th potential output terminals from the predetermined side in the D-A converter individually correspond to the source lines and are connected through a voltage follower to the corresponding source lines.

10. An LCD panel driving device for driving a liquid crystal display panel which comprises a common electrode, a plurality of pixel electrodes arranged in a matrix pattern, and source lines the number of which is by one larger than the number of columns of the pixel electrodes, in which each column of the pixel electrodes is arranged between adjacent source lines, and in which when rows of the pixel electrodes are grouped so that each group includes one row or a plurality of consecutive rows, each pixel electrode in each row in each odd-numbered group is connected to a source line on a predetermined side out of source lines present on both sides of the pixel electrode and each pixel electrode in each row in each even-numbered group is connected to a source line on the opposite side to the predetermined side out of source lines present on both sides of the pixel electrode, the driving device comprising:

an output switching section having m input terminals and (m+1) output terminals, and configured so that when the k-th input terminal from the predetermined side is defined as $I_k$, when the k-th and the (k+1)th output terminals from the predetermined side are defined as $O_k$ and $O_{k+1}$, respectively, and when k is defined as each value from 1 to m, the output switching section connects the input terminal $I_k$ to the output terminal $O_k$ if a control signal to define a terminal to be connected to the input terminal $I_k$ is at a first level and the output switching section connects the input terminal $I_k$ to the output terminal $O_{k+1}$ if the control signal is at a second level; and output means having m output terminals arranged in a row direction of pixels, and configured so that when, among the m output terminals, a plurality of output terminals consecutively arranged from the predetermined side are defined as a first output terminal group, a plurality of output terminals arranged following the first output terminal group are defined as a second output terminal group, and a plurality of output terminals arranged following the second output terminal group are defined as a third output terminal group, the second output terminal group does not contribute to potential setting for the source lines and so that the output means outputs data or signals about pixels from the first output terminal group and the third output terminal group, wherein the relation of a+c=n is met where n represents the number of pixels in one row, a the number of the output terminals belonging to the first output terminal group, b the number of the output terminals belonging to the second output terminal group, and c the number of the output terminals belonging to the third output terminal group, wherein the number of data or signals input to the input terminals of the output switching section is n+1, wherein the input terminals $I_1$ to $I_a$ of the output switching section are connected to the first to a-th respective output terminals from the predetermined side belonging to the first output terminal group, the number of data or signals input to the input terminals $I_1$ to $I_a$ is a, the input terminals $I_{a+b+1}$ to $I_m$ of the output switching section are connected to the respective output terminals belonging to the third output terminal group, and the number of data or signals input to the input terminals $I_{a+b+1}$ to $I_m$ is c, and wherein data or a signal input from the (a+b)th output terminal from the predetermined side of the output means to the input terminal $I_{a+b}$ of the output switching section is identical to data or a signal input from the a-th output terminal from the predetermined side of the output means to the input terminal $I_a$ of the output switching section.

11. The LCD panel driving device according to claim 10, wherein the output means is a shift register having m signal output terminals, and configured to output data read indication signals each to indicate read of a pixel value of one pixel, from the first to a-th signal output terminals from the predetermined side and the (a+b+1)th to m-th signal output terminals from the predetermined side out of the m signal output terminals, wherein the m input terminals of the output switching section are individually connected to the m signal output terminals of the shift register, the driving device further comprising:

a first latch section having (m+1) signal input terminals individually connected to the output terminals $O_1$ to $O_{m+1}$ of the output switching section, and (m+1) data output terminals corresponding to the signal input terminals, and configured to read and store data indicative of a pixel value of one pixel according to input timing of a data read indication signal out of pixels in one row, with input of the data read indication signal to one or more signal input terminals out of the (m+1) signal input terminals, and to undergo capture of the stored data from a data output terminal corresponding to each signal input terminal receiving the data read indication signal;

a second latch section having (m+1) data input terminals and (m+1) data output terminals, and configured to capture data from the first latch section through data output terminals of the first latch section corresponding to the signal input terminals of the first latch section receiving the data read indication signals and through data input terminals corresponding to the data output terminals, and to output the data from data output terminals corresponding to the data input terminals used in the capture of the data;

a level shifter having (m+1) data input terminals and (m+1) data output terminals, and configured to capture the data through data input terminals corresponding to the data output terminals of the second latch section outputting the data indicative of pixel values, to perform a level shift of the data, and to output the data after the level shift from data output terminals corresponding to the data input terminals; and a D-A converter having (m+1) data input terminals and (m+1) potential output terminals, and configured to capture the data through data input terminals corresponding to the data output terminals of the level shifter outputting the data indicative of the pixel values, and to output potentials according to the data from potential output terminals corresponding to the data input terminals, wherein the first to a-th potential output terminals from the predetermined side and the (a+b+1)th to (m+1)th potential output terminals from the predetermined side in the D-A converter individually correspond to the source lines and are connected through a voltage follower to the corresponding source lines, and wherein the shift register sequentially outputs the data read indication signals from the first to (a−1)th signal output terminals from the predetermined side; the shift register simultaneously outputs the data read indication signals from the a-th and the (a+b)th signal output terminals from the predetermined side, after output of the data read indication signal from the (a−1)th signal output terminal from the predetermined side; the shift register sequentially outputs the data read indication signals from the (a+b+1)th to m-th signal output terminals from the predetermined side, after the simultaneous output of the data read indication signals from the a-th and (a+b)th signal output terminals.

12. The LCD panel driving device according to claim 10, comprising:

a shift register having m signal output terminals, and configured to output data read indication signals each to indicate read of a pixel value of one pixel, from the first to a-th signal output terminals from the predetermined side and the (a+b+1)th to m-th signal output terminals from the predetermined side, out of the m signal output terminals; and a first latch section having m signal input terminals and m data output terminals, and configured to read and store data indicative of a pixel value of one pixel according to input timing of a data read indication signal out of pixels in one row, with input of the data read indication signal to one or more signal input terminals, and to undergo capture of stored data from the data output terminal corresponding to each signal input terminal receiving the data read indication signal, wherein the m input terminals of the output switching section are individually connected to the m data output terminals of the first latch section, the driving device further comprising:

a second latch section having (m+1) data input terminals individually connected to the output terminals $O_1$ to $O_{m+1}$ of the output switching section, and (m+1) data output terminals corresponding to the data input terminals, and configured to capture data from the first latch section through a data input terminal connected to an output terminal of the output switching section becoming connected to the data output terminal of the first latch section corresponding to each signal input terminal receiving the data read indication signal, and to output data indicative of a pixel value from a data output terminal corresponding to the data input terminal;

a level shifter having (m+1) data input terminals and (m+1) data output terminals, and configured to capture data through data input terminals corresponding to the data output terminals of the second latch section outputting data indicative of pixel values, to perform a level shift of the data, and to output the data after the level shift from data output terminals corresponding to the data input terminals; and a D-A converter having (m+1) data input terminals and (m+1) potential output terminals, and configured to capture the data through data input terminals corresponding to the data output terminals of the level shifter outputting the data indicative of the pixel values, and to output potentials according to the data from potential output terminals corresponding to the data input terminals, wherein the first to a-th potential output terminals from the predetermined side and the (a+b+1)th to (m+1)th potential output terminals from the predetermined side in the D-A converter individually correspond to the source lines and are connected through a voltage follower to the corresponding source lines, wherein the first to (a−1)th signal output terminals from the predetermined side of the shift register are individually connected to the first to (a−1)th signal input terminals from the predetermined side of the first latch section, the a-th signal output terminal from the predetermined side of the shift register is connected to the a-th and the (a+b)th signal input terminals from the predetermined side of the first latch section, and the (a+b+1)th to m-th signal output terminals from the predetermined side of the shift register are individually connected to the (a+b+1)th to m-th signal input terminals from the predetermined side of the first latch section, and wherein the shift register sequentially outputs the data read indication signals from the first to a-th signal output terminals from the predetermined side and, subsequently, the shift register sequentially outputs the data read indication signals from the (a+b+1)th to m-th signal output terminals from the predetermined side.

13. An LCD panel driving device for driving a liquid crystal display panel which comprises a common electrode, a plurality of pixel electrodes arranged in a matrix pattern, and source lines the number of which is by one larger than the number of columns of pixel electrodes, in which the number of columns of the pixel electrodes is a multiple of 3, in which columns of red pixels, columns of green pixels, and columns of blue pixels are repeatedly alternated, in which each column of the pixel electrodes is arranged between adjacent source lines, in which each pixel electrode in each odd-numbered row is connected to a source line on a predetermined side out of source lines present on both sides of the pixel electrode, and in which each pixel electrode in each even-numbered row is connected to a source line on the opposite side to the predetermined side out of source lines present on both sides of the pixel electrode, the driving device comprising:

a first latch section comprising an array of (m+1) latch circuits each of which has a signal input terminal for input of a data read indication signal to indicate read of data indicative of a pixel value of a pixel, a data read terminal for read of data indicative of a pixel value of one pixel with input of the data read indication signal to the signal input terminal, and an output terminal for output of the data;

a shift register having (m/3) signal output terminals for output of respective data read indication signals, and configured so that when, among the (m/3) signal output terminals, a plurality of signal output terminals consecutively arranged from the predetermined side are defined as a first output terminal group, a plurality of signal output terminals arranged following the first output terminal group are defined as a second output terminal group, and a plurality of signal output terminals up to the most distant signal output terminal from the predetermined side arranged following the second output terminal group are defined as a third output terminal group, the shift register outputs no data read indication signal from the second output terminal group and outputs the data read indication signals from the first output terminal group and the third output terminal group;

a signal branch section having (m/3) signal input terminals corresponding to the (m/3) signal output terminals of the shift register, and (m+1) signal output terminals, and configured so that when the (m+1) signal output terminals are defined as $Y_1$ to $Y_{m+1}$ from the predetermined side, when the i-th signal input terminal from the predetermined side is defined as $X_i$ and when i is defined as each value from 1 to m/3, the signal branch section outputs the data read indication signal input to the signal input terminal $X_i$ from signal output terminals $Y_{3\cdot i-2}$, $Y_{3\cdot i-1}$, $Y_{3\cdot i}$ if a predetermined control signal is at a high level and outputs the data read indication signal input to the signal input terminal $X_i$ from signal output terminals $Y_{3\cdot i-1}$, $Y_{3\cdot i}$, $Y_{3\cdot i+1}$ if the predetermined control signal is at a low level;

a first switch having a first terminal, a second terminal, and a third terminal, and configured to connect the first terminal to the second terminal if the control signal is at the high level and to connect the first terminal to the third terminal if the control signal is at the low level;

a second switch having a first terminal, a second terminal, and a third terminal, and configured to connect the first terminal to the second terminal if the control signal is at the high level and to connect the first terminal to the third terminal if the control signal is at the low level;

an output switching section having m input terminals and (m+1) output terminals, and configured so that when the k-th input terminal from the predetermined side is defined as $I_k$, when the k-th and the (k+1)th output terminals from the predetermined side are defined as $O_k$ and $O_{k+1}$, respectively, and when k is defined as each value from 1 to m, the output switching section connects the input terminal $I_k$ to the output terminal $O_k$ if a control signal to define a terminal to be connected to the input terminal $I_k$ is at a high level and the output switching section connects the input terminal $I_k$ to the output terminal $O_{k+1}$ if the control signal is at a low level;

a second latch section having (m+1) data input terminals and (m+1) data output terminals, and configured to capture data from the first latch section through data input terminals corresponding to the latch circuits storing data in the first latch section and to output the data from data output terminals corresponding to the data input terminals;

a level shifter having (m+1) data input terminals and (m+1) data output terminals, and configured to capture the data through data input terminals corresponding to the data output terminals of the second latch section outputting the data indicative of pixel values, to perform a level shift of the data, and to output the data after the level shift from data output terminals corresponding to the data input terminals;

a D-A converter having (m+1) data input terminals and (m+1) potential output terminals, and configured to capture the data through data input terminals corresponding to the data output terminals of the level shifter outputting the data indicative of the pixel values, and to output potentials according to the data from potential output terminals corresponding to the data input terminals;

a red data line for supply of data indicative of pixel values of red pixels;

a green data line for supply of data indicative of pixel values of green pixels; and a blue data line for supply of data indicative of pixel values of blue pixels, wherein the relation of $3\cdot(a+c)=n$ is satisfied where n represents the number of pixels in one row, a the number of the signal output terminals belonging to the first output terminal group, b the number of the signal output terminals belonging to the second output terminal group, and c the number of the signal output terminals belonging to the third output terminal group, wherein the signal output terminals $Y_1$ to $Y_{3\cdot a}$ of the signal branch section are connected to the signal input terminals of the respective latch circuits from the first to the (3·a)th from the predetermined side, and the signal output terminals $Y_{3\cdot(a+b+1)-1}$ to $Y_{m+1}$ of the signal branch section are connected to the signal input terminals of the respective latch circuits from the $\{3\cdot(a+b+1)-1\}$th to the (m+1)th from the predetermined side, wherein the first terminal of the first switch is connected to the signal output terminal $Y_{3\cdot a+1}$ of the signal branch section and the second terminal of the first switch is connected to the signal output terminal of the (3·a+1)th latch circuit from the predetermined side, wherein the first terminal of the second switch is connected to the signal input terminal of the {3·(a+b+1)−2}th latch circuit from the predetermined side and the second terminal of the second switch is connected to the signal output terminal $Y_{3\cdot(a+b+1)-2}$ of the signal branch section, wherein the third terminal of the first switch is connected to the third terminal of the second switch, wherein the input terminals of the output switching section are connected to respective data lines in an order of the red data line, the green data line, and the blue data line, starting from the input terminal on the predetermined side, wherein the output terminals of the output switching section are connected to the data read terminals of the respective latch circuits, in order from the output terminal on the predetermined side, and wherein the first to (3·a)th potential output terminals from the predetermined side and the {3·(a+b+1)−2}th to (m+1)th potential output terminals from the predetermined side in the D-A converter are individually connected to the (n+1) source lines in order from the predetermined side.

* * * * *